US010480888B2

(12) United States Patent
Barrett

(10) Patent No.: US 10,480,888 B2
(45) Date of Patent: Nov. 19, 2019

(54) SILENCER FOR FIREARM

(71) Applicant: Sturm, Ruger & Company, Inc., Southport, CT (US)

(72) Inventor: Jonathan Barrett, Georges Mills, NH (US)

(73) Assignee: STURM, RUGER & COMPANY, INC., Southport, CT (US)

( * ) Notice: Subject to any disclaimer, the term of this patent is extended or adjusted under 35 U.S.C. 154(b) by 0 days.

(21) Appl. No.: 16/015,496

(22) Filed: Jun. 22, 2018

(65) Prior Publication Data

US 2018/0299223 A1 Oct. 18, 2018

Related U.S. Application Data

(63) Continuation-in-part of application No. 15/855,523, filed on Dec. 27, 2017, which is a continuation of application No. 14/950,132, filed on Nov. 24, 2015, now Pat. No. 9,857,137.

(60) Provisional application No. 62/096,977, filed on Dec. 26, 2014, provisional application No. 62/525,824, filed on Jun. 28, 2017.

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/28; F41A 21/30; F41A 21/32; F41A 21/325
USPC ..... 89/14.05, 14.4
See application file for complete search history.

(56) References Cited

U.S. PATENT DOCUMENTS

| | | | |
|---|---|---|---|
| 958,934 | A | 5/1910 | Maxim |
| 981,584 | A | 1/1911 | Miller |
| 1,111,202 | A | 9/1914 | Westfall |

(Continued)

FOREIGN PATENT DOCUMENTS

| | | |
|---|---|---|
| AT | 63622 | 2/1914 |
| CN | 202614087 | 12/2012 |

(Continued)

OTHER PUBLICATIONS

Search Report for Corresponding EP Application No. 15874001.9, dated Jul. 24, 2018. EP.

(Continued)

*Primary Examiner* — Samir Abdosh
(74) *Attorney, Agent, or Firm* — The Belles Group, P.C.

(57) ABSTRACT

A silencer assembly for a firearm in one embodiment includes a support tube and plurality of baffles defining combustion gas expansion chambers. A coupling member including a ratchet mechanism removably mounts the silencer on a muzzle device on a firearm barrel. The ratchet mechanism comprises first and second arrays of teeth each disposed on the coupling member. The first array is infinitely rotatable on the coupling member when not coupled to the muzzle device and locks in rotational position when the coupling member is coupled to the device. The second array is rotationally fixed in position on the coupling member. In one embodiment, the muzzle device and coupling member have interlocking rotational stops which prevent the first array of teeth from rotating when the coupling member is coupled to the muzzle device.

21 Claims, 45 Drawing Sheets

(56) References Cited

U.S. PATENT DOCUMENTS

| | | | | |
|---|---|---|---|---|
| 1,173,687 | A | 2/1916 | Thompson | |
| 1,259,251 | A | 3/1918 | Love | |
| 1,874,326 | A | 8/1932 | Mason | |
| 1,990,837 | A | 2/1935 | Morgenstern | |
| 2,166,468 | A * | 7/1939 | Greenstreet | F41A 21/32 42/106 |
| 2,444,910 | A | 7/1948 | Barker | |
| 2,448,593 | A | 9/1948 | Heising | |
| 2,792,760 | A | 5/1957 | Hammer | |
| 3,748,956 | A | 7/1973 | Hubner | |
| 4,576,083 | A | 3/1986 | Seberger, Jr. | |
| 4,588,043 | A | 5/1986 | Finn | |
| 5,029,512 | A | 7/1991 | Latka | |
| 5,559,302 | A * | 9/1996 | Latka | F41A 21/325 89/14.05 |
| 5,679,916 | A | 10/1997 | Weichert | |
| 5,773,746 | A | 6/1998 | Vaden | |
| 6,079,311 | A | 6/2000 | O'Quinn et al. | |
| 6,308,609 | B1 | 10/2001 | Davies | |
| 6,374,718 | B1 | 4/2002 | Rescigno et al. | |
| 6,421,945 | B1 | 7/2002 | Hengstenberg | |
| 6,425,310 | B1 | 7/2002 | Champion | |
| 6,575,074 | B1 | 6/2003 | Gaddini | |
| 6,899,008 | B2 | 5/2005 | Breuer | |
| 7,237,467 | B1 | 7/2007 | Melton | |
| 7,308,967 | B1 | 12/2007 | Hoel | |
| 7,587,969 | B2 | 9/2009 | Silvers | |
| 7,789,008 | B2 | 9/2010 | Petersen | |
| 7,856,914 | B2 | 12/2010 | Shults et al. | |
| 7,874,238 | B2 | 1/2011 | Silvers | |
| D651,680 | S | 1/2012 | DeGroat | |
| 8,087,338 | B1 | 1/2012 | Hines | |
| 8,100,224 | B1 | 1/2012 | Olson | |
| 8,162,100 | B2 | 4/2012 | Shults et al. | |
| 8,210,087 | B2 | 7/2012 | Latka | |
| 8,453,789 | B1 | 6/2013 | Honigmann et al. | |
| 8,459,405 | B1 | 6/2013 | Dueck | |
| 8,459,406 | B1 | 6/2013 | Dueck | |
| 8,474,361 | B2 | 7/2013 | Brittingham | |
| 8,505,680 | B2 | 8/2013 | Dueck | |
| 8,511,425 | B2 | 8/2013 | Larue | |
| 8,528,691 | B1 | 9/2013 | Carmichael et al. | |
| 8,567,556 | B2 | 10/2013 | Dueck et al. | |
| 8,579,075 | B2 | 11/2013 | Brittingham et al. | |
| 8,584,794 | B2 | 11/2013 | Dueck | |
| 8,714,301 | B2 | 5/2014 | Shults | |
| 8,739,922 | B2 | 6/2014 | Wirth et al. | |
| 8,807,005 | B2 | 8/2014 | Moss et al. | |
| 8,844,422 | B1 | 9/2014 | Klett | |
| 8,857,307 | B2 | 10/2014 | Torre et al. | |
| 8,875,612 | B1 | 11/2014 | Klett et al. | |
| 8,910,745 | B2 | 12/2014 | Latka | |
| 8,950,546 | B2 | 2/2015 | Shults et al. | |
| 8,973,481 | B2 | 3/2015 | Dueck et al. | |
| 8,978,818 | B2 | 3/2015 | Proske | |
| 8,991,550 | B2 | 3/2015 | Coley | |
| 8,991,551 | B2 | 3/2015 | Latka | |
| 8,991,552 | B2 | 3/2015 | Latka | |
| 9,086,248 | B2 | 7/2015 | Young | |
| 9,097,482 | B1 | 8/2015 | Holden et al. | |
| 9,102,010 | B2 | 8/2015 | Wilson | |
| 9,958,227 | B2 * | 5/2018 | Whitson | F41A 21/325 |
| 10,054,384 | B1 * | 8/2018 | Marfione | F41A 21/30 |
| 10,184,744 | B2 * | 1/2019 | Young | F41A 21/325 |
| 10,267,586 | B1 * | 4/2019 | Marfione | F41A 21/30 |
| 10,281,228 | B1 * | 5/2019 | Marfione | F41A 21/30 |
| 2008/0251060 | A1 | 10/2008 | Thurber | |
| 2010/0180759 | A1 | 7/2010 | Petersen | |
| 2011/0297477 | A1 | 12/2011 | Koumbis | |
| 2012/0152093 | A1 | 6/2012 | Koumbis | |
| 2012/0180623 | A1 * | 7/2012 | Graham, II | F41A 21/325 89/14.4 |
| 2012/0272818 | A1 | 11/2012 | Dueck et al. | |
| 2012/0291614 | A1 | 11/2012 | Koumbis | |
| 2013/0180150 | A1 | 7/2013 | Dueck | |
| 2013/0180796 | A1 | 7/2013 | Dueck | |
| 2013/0180797 | A1 | 7/2013 | Dueck | |
| 2014/0020976 | A1 | 1/2014 | Shults | |
| 2014/0157640 | A1 | 6/2014 | Whelan | |
| 2014/0158249 | A1 | 6/2014 | Schlosser | |
| 2014/0224574 | A1 | 8/2014 | Latka | |
| 2014/0224575 | A1 | 8/2014 | Latka | |
| 2014/0231168 | A1 | 8/2014 | Dueck | |
| 2014/0237881 | A1 | 8/2014 | Mack | |
| 2014/0262604 | A1 | 9/2014 | Proske | |
| 2014/0262605 | A1 | 9/2014 | Washburn, III et al. | |
| 2014/0299405 | A1 | 10/2014 | Miller et al. | |
| 2014/0374189 | A1 | 12/2014 | Young et al. | |
| 2015/0001002 | A1 | 1/2015 | Wirth et al. | |
| 2015/0090105 | A1 | 4/2015 | Pace | |
| 2015/0159971 | A1 | 6/2015 | Salva | |
| 2015/0184968 | A1 | 7/2015 | Fischer et al. | |
| 2015/0226506 | A1 | 8/2015 | Shults et al. | |
| 2015/0338184 | A1 | 11/2015 | White et al. | |
| 2016/0003570 | A1 | 1/2016 | Tonkin | |
| 2016/0187093 | A1 | 6/2016 | Barrett | |
| 2017/0191780 | A1 | 7/2017 | Barrett | |
| 2018/0106569 | A1 * | 4/2018 | Smith | F41A 21/30 |
| 2018/0292164 | A1 * | 10/2018 | Thompson | F41A 21/325 |

FOREIGN PATENT DOCUMENTS

| | | |
|---|---|---|
| CN | 204373498 | 6/2015 |
| EP | 2587209 A2 | 5/2013 |
| GB | 190814310 | 11/1908 |
| GB | 190900455 | 2/1909 |
| GB | 191024766 | 7/1911 |
| GB | 579168 | 7/1946 |
| RU | 2307991 | 10/2007 |
| RU | 2345305 | 1/2009 |
| WO | 2013057139 | 4/2013 |
| WO | 2014000805 | 1/2014 |
| WO | 2014076356 | 5/2014 |
| WO | 2014076357 | 5/2014 |

OTHER PUBLICATIONS

Ranb, "Offset silencer design", Silencer Talk and Modern Rifle, Sound Suppressor Discussion, Apr. 10, 2011.

Bev Fitchett's Guns Magazine—Improvised Weaponry, 'Ram Pipe Cross Sections', Dec. 28, 2015, Atlanta, GA.

VBulletin Solutions, Inc., 'Forum—Community—Off-Topic Discussion—Off-Topic—Suppressor or Silencer', Thread: Suppressor or Silencer.

Corresponding International Search Report and Written Opinion for PCT/US15/62288 dated Jun. 3, 2016. WO.

* cited by examiner

SILENCER FOR FIREARM

CROSS-REFERENCE TO RELATED APPLICATIONS

The present application is a continuation-in-part of U.S. application Ser. No. 15/855,523 filed Dec. 27, 2017, which is a continuation of U.S. Ser. No. 14/950,132 filed Nov. 24, 2015 (now U.S. Pat. No. 9,857,137), which claims the benefit of U.S. Provisional Application No. 62/096,977 filed Dec. 26, 2014. The present application also claims the benefit of U.S. Provisional Application No. 62/525,824 filed Jun. 28, 2017. The entireties of the foregoing disclosures are incorporated herein by reference.

BACKGROUND OF THE DISCLOSURE

The present disclosure generally relates to firearms, and more particularly to silencers or suppressors which reduce the muzzle noise produced by discharging the firearm.

Silencers or suppressors generally comprise multiple combustion gas expansion chambers in which the high pressure gas is allowed to partially expand prior to leaving the firearm. The projectile such as a bullet is propelled through the barrel of the firearm and silencer by the combustion gas. In an unsuppressed discharge firearm, the rapid expansion and depressurization of the high pressure gas at the muzzle end of the barrel produces a loud sound referred to as muzzle blast or noise. The partial pre-expansion of gas inside the silencer acts to reduce muzzle noise which is desirable in some circumstances. Silencers are typically configured for threadable and removable mounting on the muzzle end of the firearm barrel.

Improvements in silencer designs and mounting systems are desired

SUMMARY OF THE DISCLOSURE

The present invention provides a silencer including an outer housing or tube and a plurality of interconnected internal baffle segments which are joined together in stacked relationship to create a substantially gas-tight internal volume. The baffles have cone sections which are longitudinally spaced apart and create a plurality of gas expansion chambers therebetween which allow for partial expansion of the high pressure combustion gases prior to exiting the silencer, thereby reducing the muzzle blast or noise. In some configurations, the primary baffles may have an asymmetrically shaped skewed cone section configured to maximize gas expansion and noise reduction performance. Advantageously, the gas impinging the rear face of the primary baffles upon discharging the firearm is momentarily directed to pool at the lowest most recessed part of the face. As pressure builds on the face of the baffle, the gas spills over and flows into the central aperture of the cone creating cross-jetting gas flow pattern into the direct main flow of gas through the central aperture from the barrel.

In one implementation, an anti-rotational locking feature is provided which is formed by mating keyed parts of the outer tube and proximal muzzle mount. The muzzle mount may comprise a male rotational locking feature and the tube may comprise a complementary configured and mating female locking feature to form an interlock that prevents relative movement of the mount with respect to the tube so that the tube cannot be inadvertently disassembled and/or loosened from the muzzle mount of the silencer when removing the silencer from the barrel of the firearm. In other implementations possible, the male and female locking features on the tube and muzzle mount may be reversed so that the tube contains the male feature and the muzzle mount the female feature. In one non-limiting embodiment, the locking features may be formed by mating radial splines and grooves formed in the muzzle mount and tube.

In one exemplary embodiment, a silencer for a firearm includes a longitudinal axis; an outer tube defining a proximal end configured for mounting on a firearm barrel, a distal end, and an internal passageway extending between the proximal and distal ends; and a plurality of first baffles longitudinally stacked in the internal passageway between the proximal and distal ends of the outer tube. Each of the first baffles comprise an annular mounting sleeve disposed adjacent the outer tube and a cone projecting axially rearward from the mounting sleeve towards the proximal end of the outer tube, the cone defining an oblong central opening concentrically aligned with the longitudinal axis for receiving a projectile therethrough. The oblong central opening is obliquely angled to the longitudinal axis of the silencer. A plurality of gas expansion chambers are formed between the first baffles.

A firearm with silencer includes a barrel having a barrel bore for receiving a projectile and a threaded muzzle end; a longitudinal axis coaxial with the barrel bore; and a silencer. The silencer comprises an outer tube defining an internal passageway extending between proximal and distal ends of the outer tube; a distal end cap attached to the distal end of the outer tube and defining an exit aperture coaxially aligned with the longitudinal axis; a proximal end cap attached to the proximal end of the outer tube and defining an entrance aperture coaxially aligned with the longitudinal axis; a muzzle mount disposed in the proximal end of the outer tube, the muzzle mount threadably engaging the threaded muzzle end of the barrel coupling the silencer thereto; a plurality of primary baffles longitudinally stacked inside the outer tube between the proximal and distal end caps; and a blast baffle disposed between the primary baffles and proximal end cap. An anti-rotation feature is provided comprising a plurality of circumferentially spaced apart radial splines formed on one of the muzzle mount or outer tube, each radial spline engaging a mating axial groove formed in the other one of the muzzle mount or outer tube without the splines. The anti-rotation feature prevents relative rotation between the muzzle mount and outer tube when the silencer is threaded onto the barrel.

A method for assembling a silencer for a firearm is provided. The method includes: providing an outer tube, a rear end cap, a front end cap, and a muzzle mount, the outer tube defining a rear end for threadable mounting on a firearm barrel, a front end, and an internal passageway extending between the front and rear ends; slideably inserting a plurality of baffles into the internal passageway through the rear or front end of the outer tube; axially aligning a plurality of radial splines on the muzzle mount or the outer tube with a mating plurality of axial grooves on the other of the muzzle mount or the outer tube without the radial splines; slideably inserting the muzzle mount through the rear end of the outer tube towards the front end by slideably engaging the splines in the grooves; and threadably coupling the rear end cap onto the rear end of the outer tube, the muzzle mount being locked into the outer tube by the rear end cap; wherein relative rotation between the muzzle mount and outer tube is prevented by engagement between the radial splines and the axial grooves.

According to another aspect, a quick-coupling ratcheting silencer is provided.

In one embodiment, a quick-coupling silencer assembly for a firearm includes a longitudinal axis; a muzzle device configured for attachment to a muzzle end of a firearm barrel, the muzzle device including a first rotational stop; a support tube having a proximal end and a distal end; a plurality of baffles arranged in a longitudinal stack and supported by the support tube, the baffles defining a plurality of gas expansion chambers; a coupling member attached to the proximal end of the support tube and having a second rotational stop engageable with the first rotational stop of the muzzle device, the coupling member rotatably securing the support tube to the muzzle device; a ratcheting mechanism comprising a freely rotatable first array of radial teeth disposed on the coupling member and a second array of radial teeth disposed on the coupling member in a fixed rotational position; and a biasing member biasing the second array of radial teeth into engagement with the first array of radial teeth. The first array of radial teeth is infinitely rotatable in opposing directions when the coupling member is not secured to the muzzle device, and the first array of radial teeth is locked in rotational position when the coupling member is secured to the muzzle device. In one embodiment, the muzzle device may be a muzzle brake.

In another embodiment, a quick-coupling silencer assembly for a firearm includes: a longitudinal axis; a muzzle device configured for attachment to a muzzle end of a firearm barrel; a support tube assembly including proximal end, a distal end, and a longitudinal stack of baffles defining a plurality of gas expansion chambers; an annular adapter threadably coupling the support tube assembly to the muzzle device; a ratchet ring movably coupled to the annular adapter and comprising first radial teeth, the ratchet ring being freely and infinitely rotatable on the adapter when the adapter is not coupled to the muzzle device; a detent ring disposed on the adapter and comprising second radial teeth, the detent ring locked in rotational position on the coupling member; an annular biasing member biasing the second radial teeth of the detent ring into engagement with the first radial teeth of the ratchet ring which collectively defines a ratchet mechanism. The ratchet ring is lockable in rotational position when the adapter is coupled to the muzzle device and the detent ring rotates with the adapter.

In another embodiment, a method for installing a silencer on a firearm is provided. The method includes: providing a silencer comprising a support tube with array of stacked baffles and an annular coupling adapter attached to a rear end of the silencer; axially moving the silencer rearward a first distance onto the muzzle device while applying a rearward pushing force on the silencer; engaging an abutment surface of a toothed ratchet ring disposed on the coupling adapter with a mating abutment surface on the muzzle device while applying the rearward pushing force on the silencer, the ratchet ring being freely rotatable on the coupling adapter; rotating the silencer while applying the rearward pushing force, the ratchet ring and coupling adapter rotating with the silencer; automatically axially aligning a rotational stop on the ratchet ring with a mating rotational stop on the muzzle device via rotating the silencer; slideably engaging the rotational stops of the ratchet ring and muzzle device, the engagement rotationally locking the ratchet ring in position on the muzzle device such that the ratchet ring no longer rotates with rotation of the silencer and coupling adapter; axially moving the silencer rearward a second distance while applying the rearward pushing force on the silencer; and threadably engaging the coupling adapter with the muzzle device. In one embodiment, also provided is a spring-biased toothed detent ring rotationally engaged with the toothed ratchet ring, the detent ring rotationally locked to the coupling adapter such that rotating the silencer in turn rotates the detent ring on the coupling adapter in unison therewith. In any of the foregoing embodiments, the automatically axially aligning step does not require a user manually rotating the ratchet ring to axially align the rotational stop on the ratchet ring with the mating rotational stop on the muzzle device.

Any of the features or aspects of the invention disclosed herein may be used in various combinations with other features or aspects of the invention. Accordingly, the invention is not limited to the exemplary combinations of features disclosed herein.

BRIEF DESCRIPTION OF THE DRAWINGS

The features of the exemplary embodiments will be described with reference to the following drawings where like elements are labeled similarly, and in which:

Parts shown and/or given a reference numerical designation in one figure may be considered to be the same parts where they appear in other figures without a numerical designation for brevity unless specifically labeled with a different part number and described herein. References herein to a figure number (e.g. FIG. 1) shall be construed to be a reference to all subpart figures in the group (e.g. FIGS. 1A, 1B, etc.) unless otherwise indicated

DESCRIPTION OF EMBODIMENTS

Figure 1:
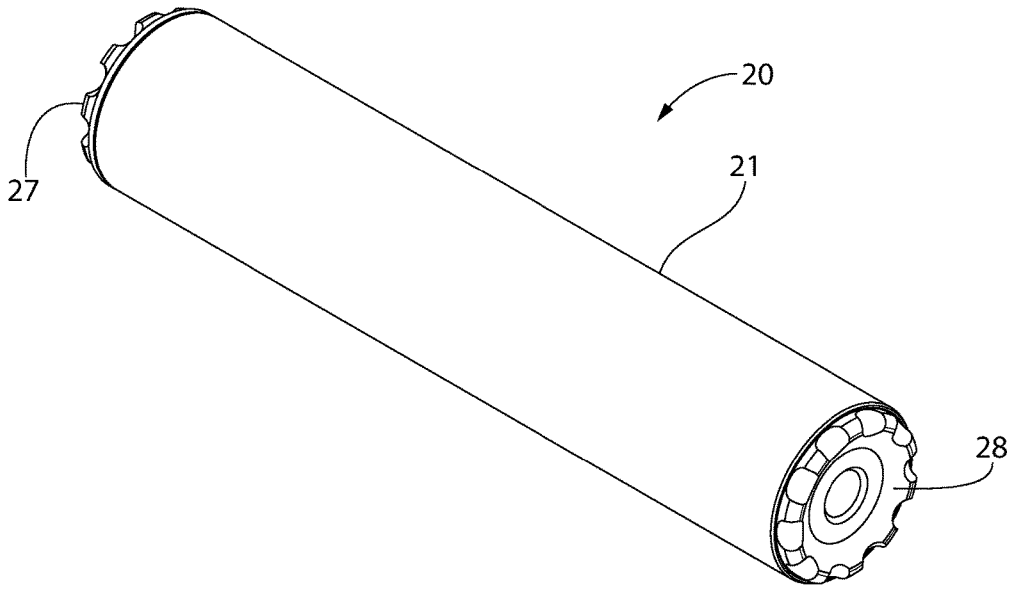
FIGS. 1 and 2 are front and rear perspective views respectively of a silencer for a firearm according to the present disclosure.
Figure 2:
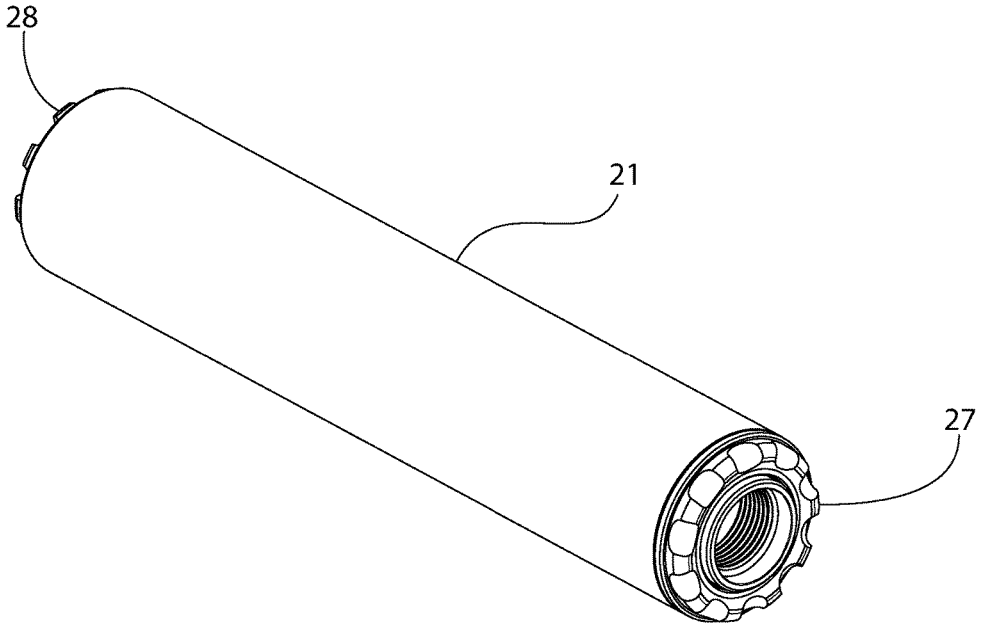

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

As used throughout, any ranges disclosed herein are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

An exemplary embodiment will now be described with initial reference to FIGS. 1-8. The silencer described herein is usable with many types of firearms including without limitation rifles, pistols, and revolvers. Accordingly, the invention is not limited in application to any particular type of firearm.

Silencer 20 generally includes an elongated outer tube 21 defining a longitudinal axis LA (and corresponding axial direction) coaxial with the barrel bore 18*a*, a plurality of horizontally stacked baffles including a proximal blast baffle 50 and plurality of primary baffles 70 all removably inserted in the tube, a rear proximal end cap 27 removably attached to the tube at one end closest to the firearm barrel 18, a front distal end cap 28 removably attached to the tube at an opposite end farthest from the firearm barrel, and a muzzle mount 90 removably disposed at least partially inside the tube. The proximal or rear end of the silencer 20 is defined as the end which mounts on the muzzle end 18*c* of the firearm barrel 18 and receives a projectile therethrough from the barrel bore 18*a* (see, e.g. FIGS. 3 AND 7B) while the distal or front end of the silencer is defined as the opposite end from which the projectile exits the silencer when the firearm is fired.

The outer tube 21 has a hollow tubular body including a cylindrical sidewall 24 that defines a rear or proximal muzzle mount end 22 ("proximal end" for brevity), a front or distal projectile discharge end 23 ("distal end" for brevity), and an internal passageway 25 extending axially between the ends. The ends 22 and 23 may be fully open in one embodiment without any flanges or other inwardly or outwardly radially extending protrusions which simplifies manufacture of the tube. The interior surface 26 of the tube (e.g. sidewall 21) is generally smooth with internal threading at the proximal and distal ends 22, 23 for threadably mounting the externally threaded proximal and distal end caps 27, 28 thereto. The outer surface 29 of the tube 21 may be solid in structure (i.e. free of through holes or apertures) and generally plain without threading or other type surface features in one embodiment.

The internal passageway 25 of the tube 21 and particularly central bores or apertures of baffles 50, 70 collectively define a projectile pathway P through the silencer 20 which extends along the longitudinal axis LA in a direction from the proximal end 22 to distal end 23 of the silencer. Pathway P coincides with the direction followed by a projectile from the barrel bore 18*a* when the firearm is discharged and exiting the distal end 28 (see, e.g. directional passageway P arrows in FIGS. 7A-B).

With additional reference to FIGS. 9-13, the front or distal end cap 28 is generally annular in shape including front end 30, rear end 31, and a cylindrical circumferential sidewall 32 extending between the ends. The front end 30 includes a circular substantially vertical end wall 38 in end view and a rearwardly open recess 38*a* defined by the sidewall 32. External threads 33*a* disposed on sidewall 32 proximate to rear end 31 engage mating threads 33*b* formed on the interior surface 26 of the outer tube 21 proximate to its distal end 23 for mounting the end cap to the tube.

The distal end cap 28 has a partially closed front end 30 formed by vertical end wall 38 which is interrupted by a centered exit aperture 35 that is in fluid communication with the internal passageway 25 of the silencer 20. Aperture 35 is sized to allow a fired projectile such as a bullet or slug to pass therethrough. Exit aperture 35 is coaxially and concentrically aligned with the longitudinal axis LA and barrel bore 18*a,* respectively. In one non-limiting embodiment, the exit aperture 35 continues and opens rearward into an axial bore formed by tubular extension 34 disposed in cavity 38*a* inside the end cap 28. The tubular extension 34 may be integrally formed with end wall 38 in one embodiment and extends rearwardly/proximally from the wall towards the rear end 31. In one implementation, the tubular extension 34 may project rearwards beyond the sidewall 32 at rear end 31 of the distal end cap 28. Extension 34 has a smaller inside diameter than the inside diameter of the end cap sidewall 32 creating an annular gap therebetween in which combustion gas may continue to expand partially. The front end 30 of the cap 28 may be castellated in some embodiments for grasping by the hand and/or tool (e.g. specially configured wrench) to facilitate assembling the silencer. A circumferential groove 36 may be provided on the outer surface of the distal end cap 28 which receives a complementary configured annular seal 37. Seal 37 may be an O-ring formed of suitable material such as rubber to help prevent loss of torque due to the repeated firing of a mounted firearm.

Referring to FIGS. 2-4, 6-8, and 26, the rear or proximal end cap 27 is generally annular in shape including front end 40, rear end 41, and a cylindrical circumferential sidewall 42 extending between the ends. Sidewall 42 defines a mounting portion of the end cap 27. External threads 43*a* disposed on sidewall 32 proximate to front end 40 engage mating internal threads 43*b* formed on the interior surface 26 of the outer tube 21 proximate to its proximal end 22 for mounting the end cap to the tube.

An entrance aperture 44 is formed in rear end 41 of proximal end cap 27 sized to receive a portion of the muzzle mount 90 therethrough to allow a projectile such as a bullet or slug to pass from the bore 18*a* of the firearm barrel 18 directly into the muzzle mount and silencer 20, as further described herein. Entrance aperture 44 is coaxially and concentrically aligned with the longitudinal axis and barrel bore 18*a,* respectively. The rear end 41 of the proximal cap 27 may be castellated in some embodiments to facilitate grasping by the hand and/or tool (e.g. specially configured wrench) to assemble the silencer. A radially protruding rim 45 extending outwards from sidewall 42 abuttingly engages the rear facing end surface on the proximal end 22 of the outer tube 21 when the proximal cap 27 is threaded onto the tube to form an end closure. The outside diameter of rim 45 is thus larger than the inside diameter of the proximal end 22 of the outer tube in this embodiment to form the surface contact. This arrangement limits the insertion depth of the proximal end cap 27 inside the outer tube 21.

Referring now to FIGS. 2-3, 6-8, 14-18, and 25-26, muzzle mount 90 is mounted at the proximal end 22 of the outer tube 21 inside the internal passageway 25 and configured to threadably and removably couple silencer 20 to the muzzle end 18*c* of the firearm barrel 18. Muzzle mount 90 comprises a front end 91, rear end 92, and a cylindrical sidewall 93 extending axially between the ends. The sidewall 93 defines an open and tubular annular mounting sleeve 94 sized for placement adjacent the inside surface 26 of the silencer outer tube 21. Sleeve 94 thus has an outside diameter which is slightly smaller than the inside diameter of outer tube 21 sufficient to allow the muzzle mount 90 to be slid inside the tube from the open proximal end 22. Preferably, relatively close contact is maintained between the tubular sleeve 94 and inside of the outer tube to prevent excessive lateral movement (i.e. transverse to longitudinal axis LA) of the muzzle mount when discharging the firearm to avoid excessive vibration. The interior of the tubular sleeve 94 forms a forwardly open cavity 104 that in turn defines one of several combustion gas expansion chambers 110 when the silencer is assembled, as further described herein.

Muzzle mount 90 further includes an internally threaded bore 95 configured to rotatably engage mating external threads 18*b* formed on muzzle end 18*c* of the firearm barrel 18 (see, e.g. FIGS. 3 and 7B) for removably mounting the silencer 20 thereto. In one implementation, threaded bore 95 may be formed inside a rearwardly open nozzle 96 concentrically aligned with the bore 18*a* of barrel 18. Barrel 18 is inserted into the nozzle 96 and then rotated to mutually engage the threading (see, e.g. FIGS. 7 and 8). The rear end 92 of the muzzle mount 90 is defined by the terminal edge of the nozzle 96.

In one embodiment, nozzle 96 has a reduced outside diameter with respect to the outside diameter of the tubular sleeve 94 of muzzle mount 90. This creates a rearwardly open annular space 97 between the nozzle and inside of the outer sleeve that receives the threaded sidewall 42 of the rear or proximal end cap 27 (best shown in FIG. 27 without end cap 27 in place). The internal threads 43*b* on the interior surface 26 of the outer tube 21 are exposed in space 97 to engage the mating threads 43*a* on the exterior of proximal end cap 27 when attached. A circumferential groove 99 is formed on the nozzle 96 between the rear end 92 and the tubular sleeve 94 which receives a complementary configured annular seal 100. Seal 100 may be an O-ring formed of suitable material such as rubber that helps prevent loss of torque due to the repeated firing of a mounted firearm.

A shoulder 98 is formed between nozzle 96 and tubular sleeve 94 that defines a rear facing annular seating surface 101 arranged to abuttingly engage a front facing end surface on the front end 40 of proximal end cap 27. When the silencer 20 is assembled, this compresses the stack of baffles 50 and 70 between the front or distal end cap 28 and the seating surface 101.

According to one aspect of the invention, the muzzle mount 90 is keyed to the outer tube 21 via an anti-rotation mechanism that prevents relative rotation between the two components. In one embodiment, the anti-rotation mechanism is provided a plurality of radially protruding splines 102 formed on the exterior of muzzle mount 90 which engage complementary configured and arranged axial grooves 103 formed inside the rear end 27 of the tube 21. This rotational keyed arrangement allows for the user to apply torque to the outer tube 21 when removing the silencer 20 from the firearm barrel 18 without fear of accidentally disassembling or loosening the silencer assembly.

Figure 27:
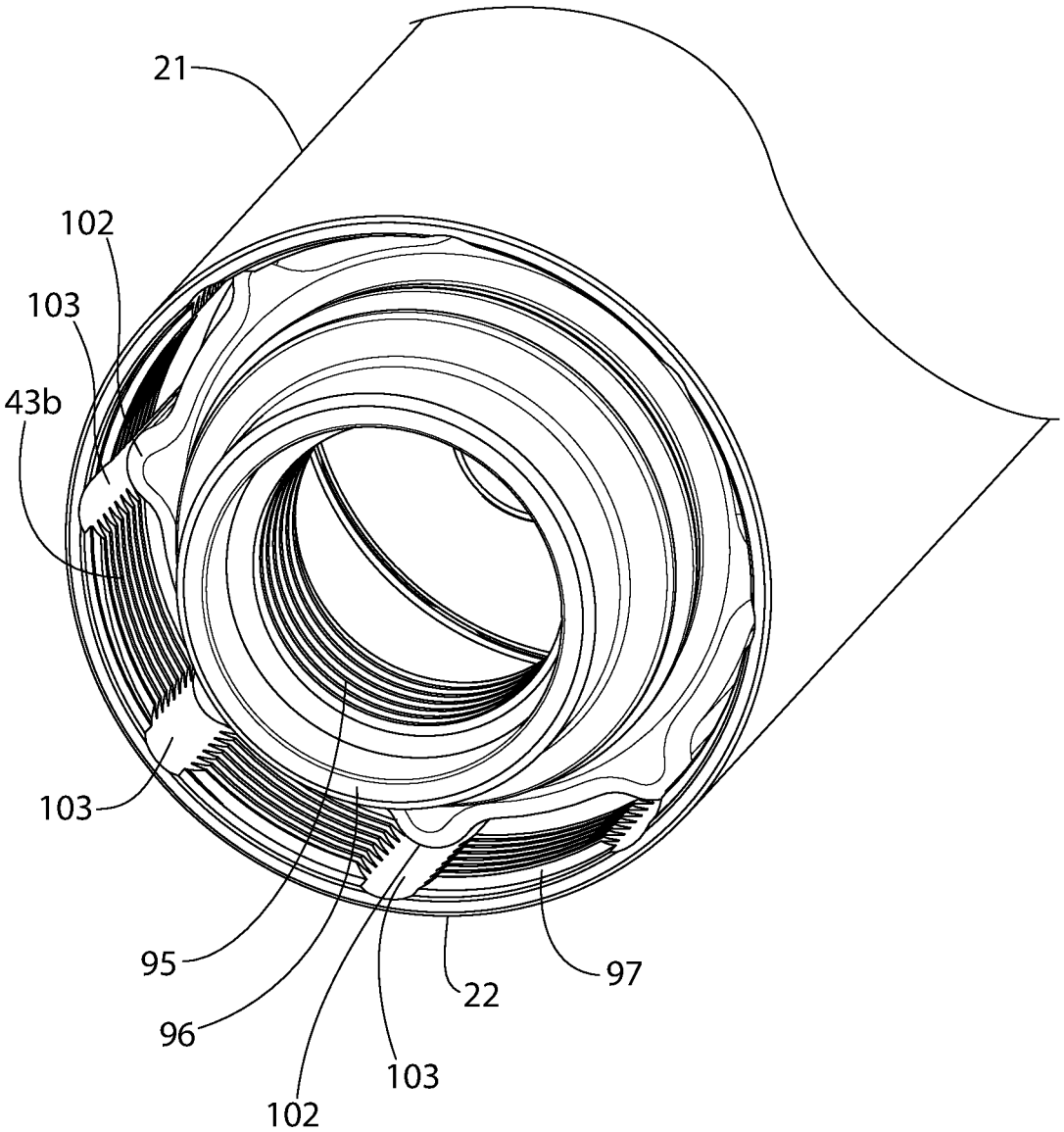
FIG. 27 is a rear perspective view of the silencer with the rear or proximal end cap removed.

In one implementation, the anti-rotation splines 102 may be formed between the tubular sleeve 94 and nozzle 96 on the muzzle mount 90 and extend outwards beyond the sleeve to engage axial grooves 103. The splines 102 are circumferentially spaced apart on the muzzle mount adjacent shoulder 98 on the larger diameter tubular sleeve 94 and extend around the entire circumference of the mount. Grooves 103 inside outer tube 21 are circumferentially spaced apart and have a complementary arrangement so that each groove corresponds to and cooperates with a mating spline 102 to rotationally key the mount to the tube. In one embodiment, the axial grooves 103 form interruptions in the internal threads 43*b* of the outer tube 21 as best shown in FIG. 27. The axial grooves 103 penetrate and extend forward from the rear proximal end 22 of outer tube 21 for a sufficient distance so that a proximal-most portion of the internal threads 43*b* of the outer tube remain exposed to engage the threads on the rear end cap 27 (see, e.g. FIG. 27).

Figure 3:
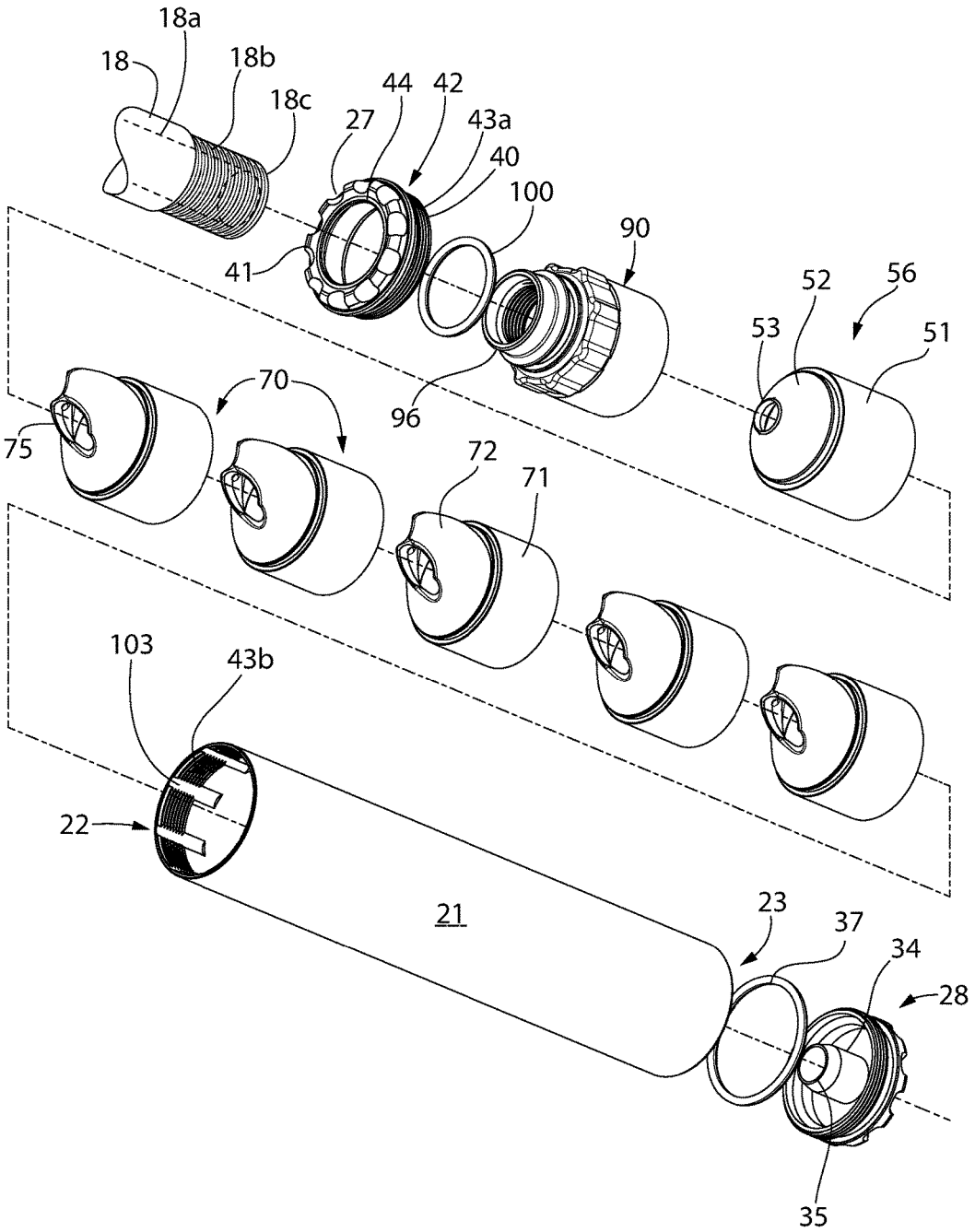
FIG. 3 is an exploded perspective view of the silencer.
Figure 4:
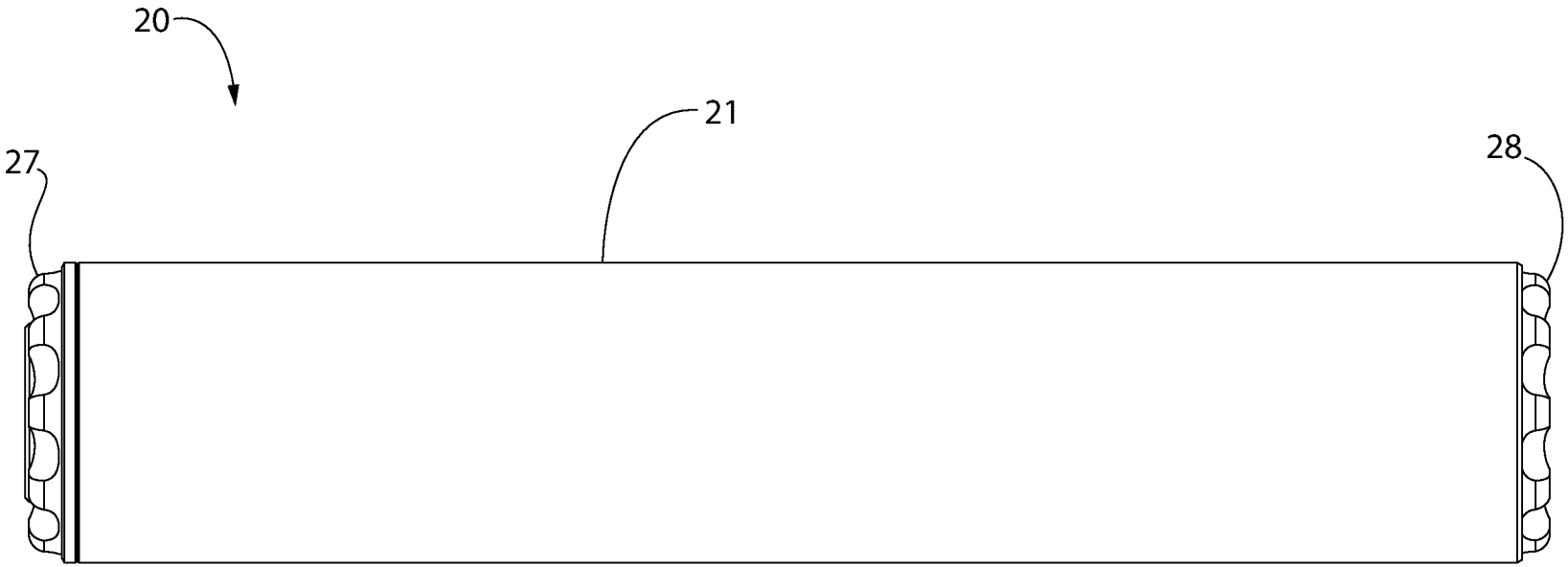
FIG. 4 is a side view of the silencer.
Figure 5:
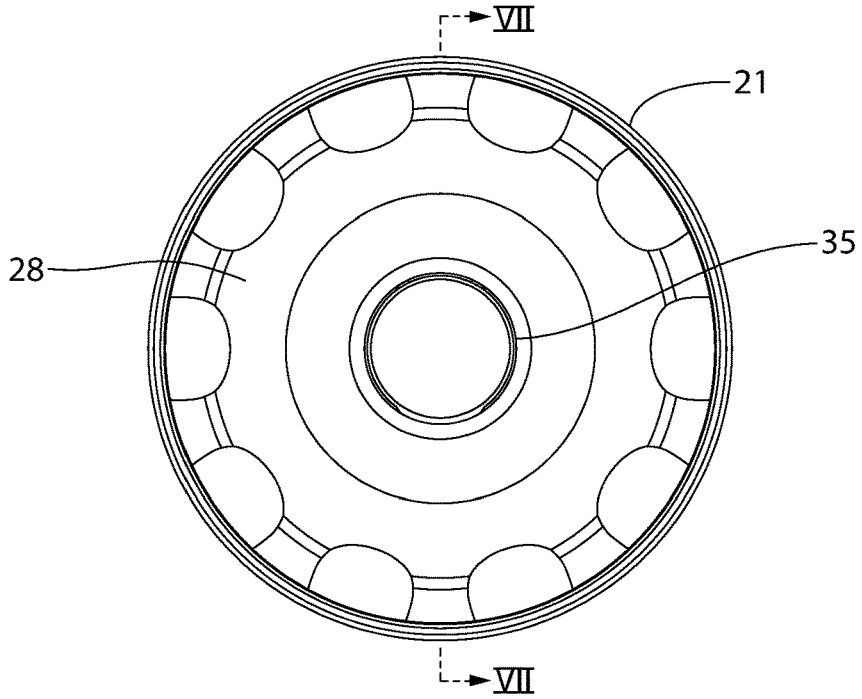
FIGS. 5 and 6 are front and rear end views of the silencer.
Figure 6:
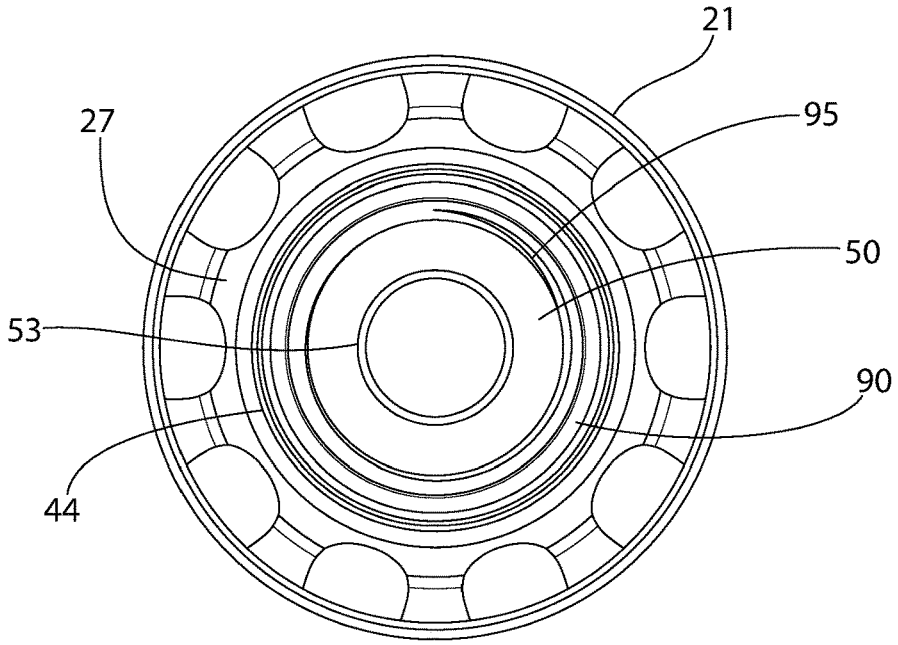
Figure 7A:
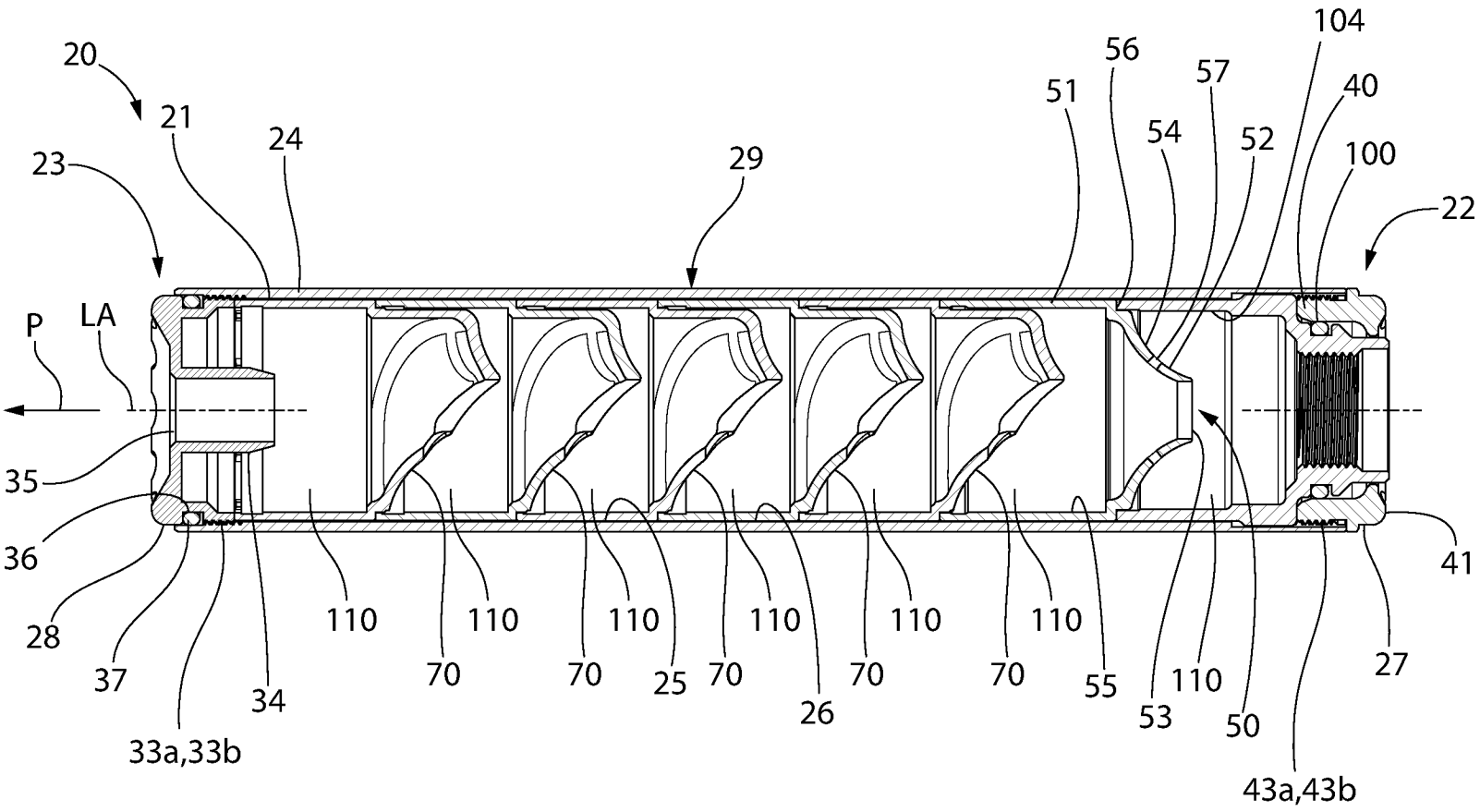
FIG. 7A is a longitudinal cross-sectional view of the silencer.
Figure 7B:
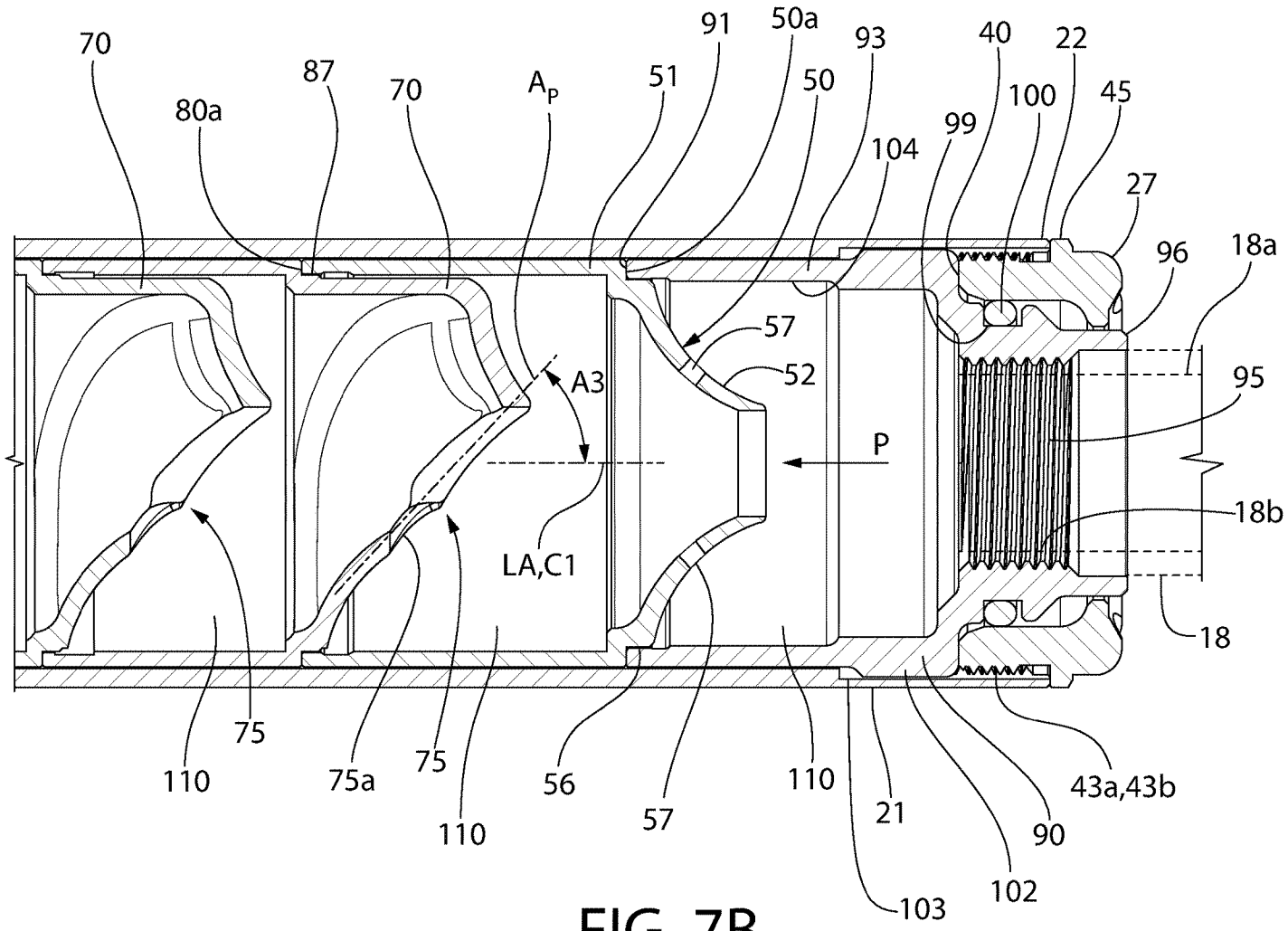
FIG. 7B is an enlarged detail view of the rear end of the silencer from FIG. 7A.
Figure 8:
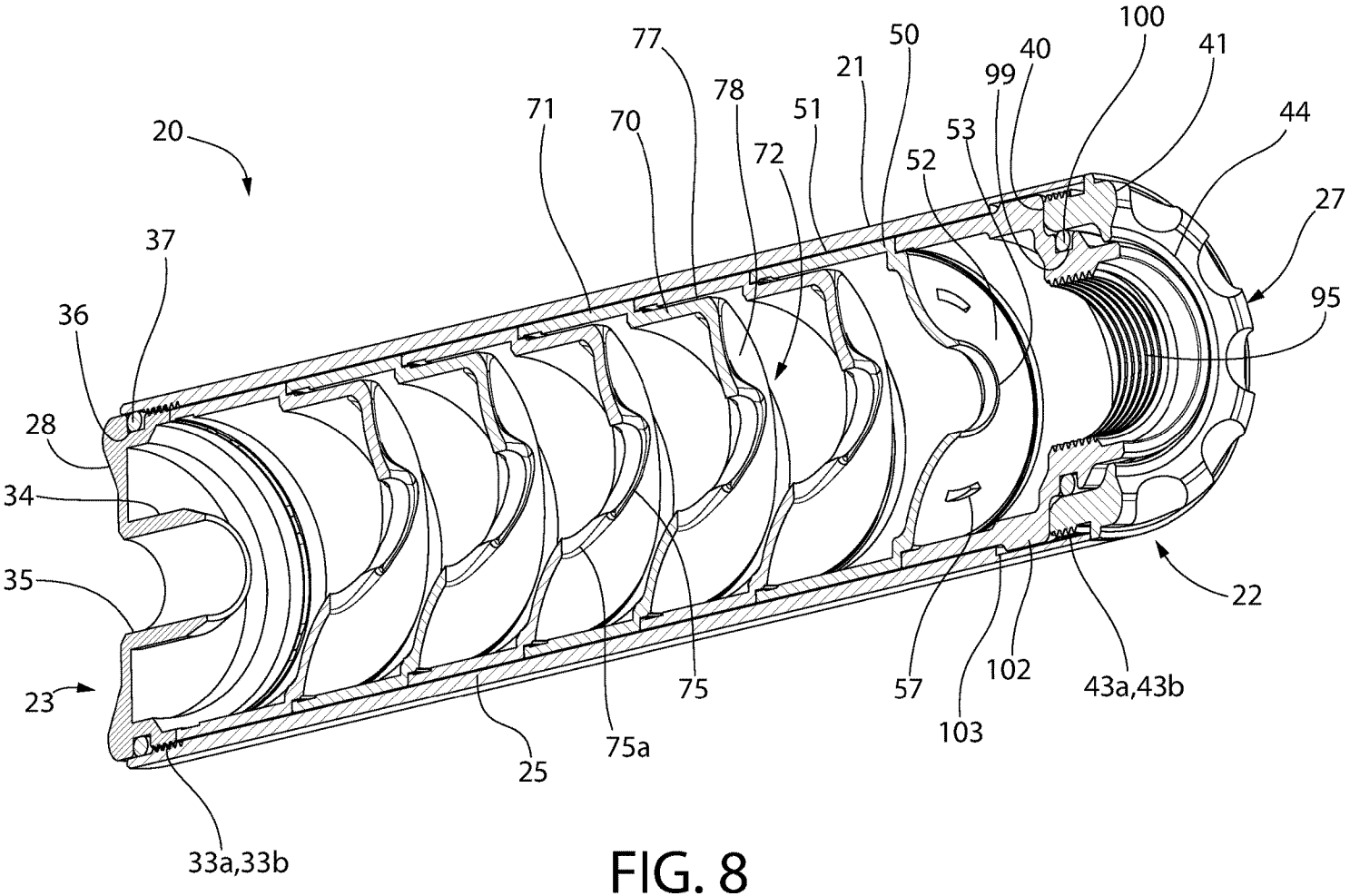
FIG. 8 is a rear cross-sectional perspective view of the silencer.
Figure 9:
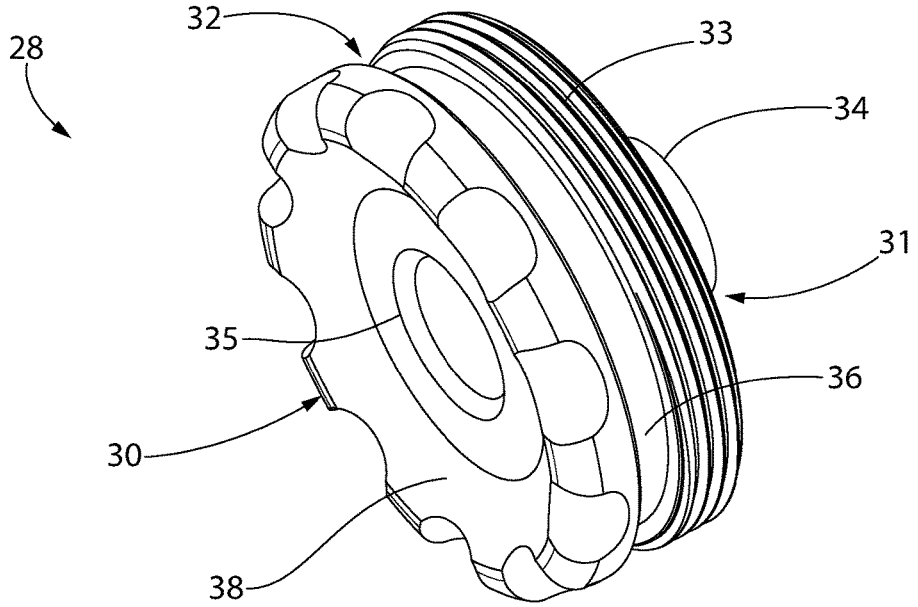
FIGS. 9 and 10 are front and rear perspective views respectively of the front end cap of the silencer.
Figure 10:
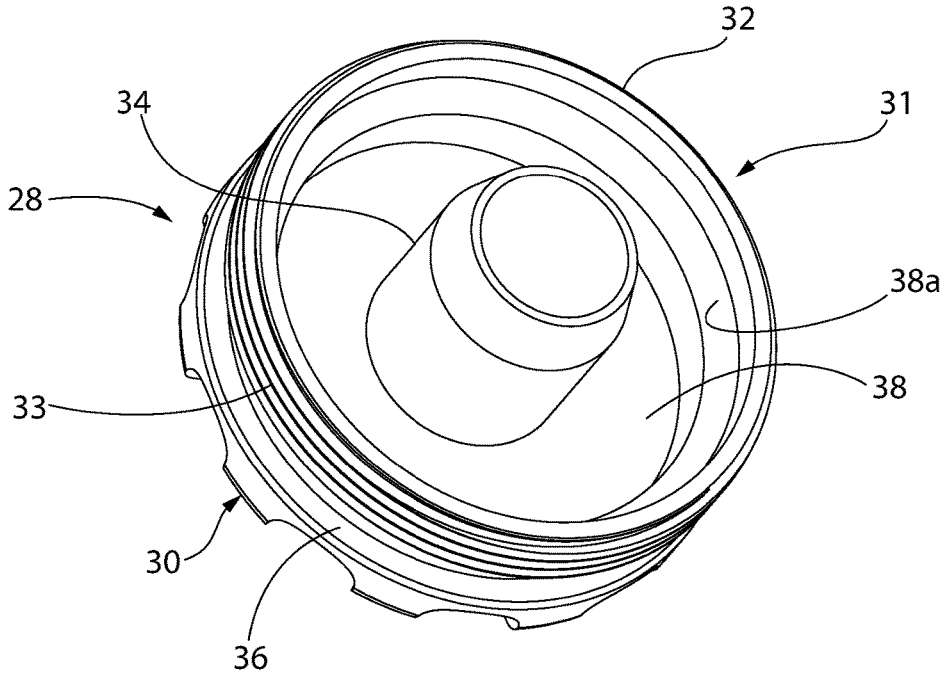
Figure 11:
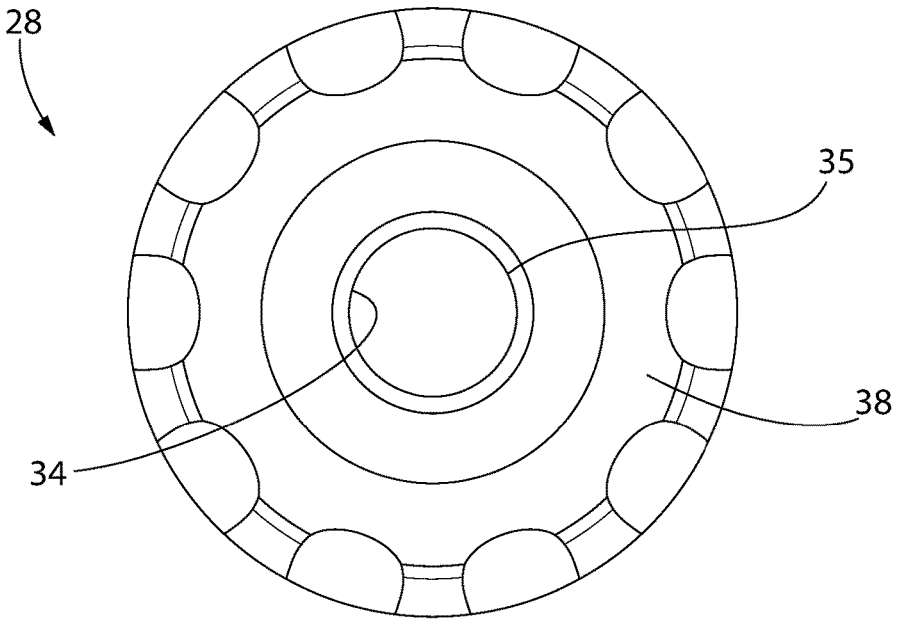
FIGS. 11 and 12 are front and rear end views respectively thereof.
Figure 12:
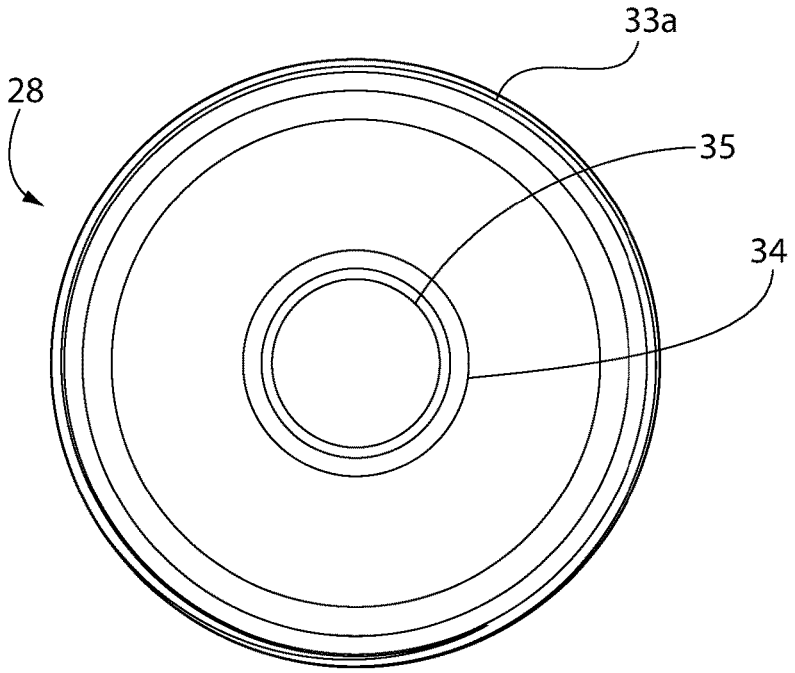
Figure 13:
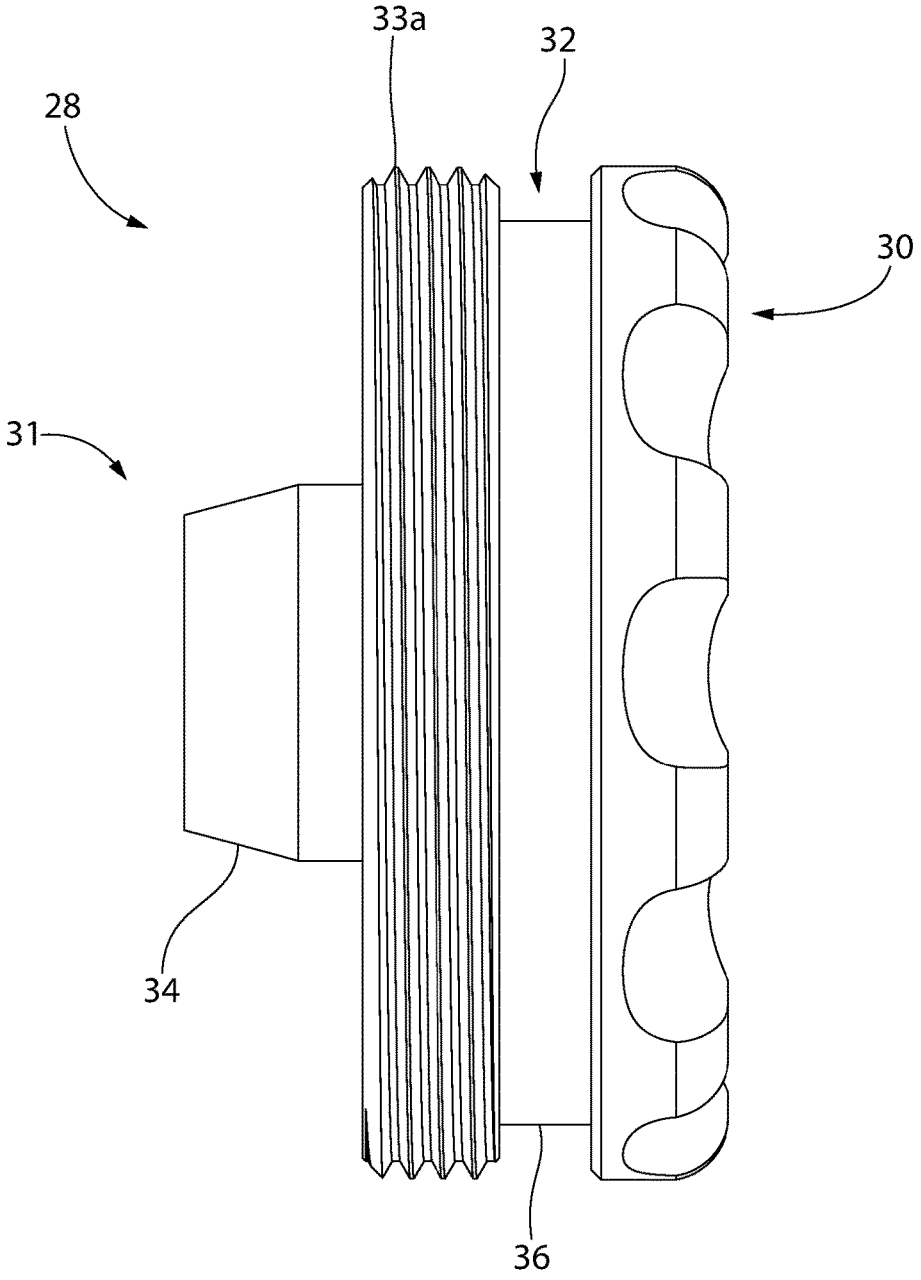
FIG. 13 is a side view thereof.
Figure 14:
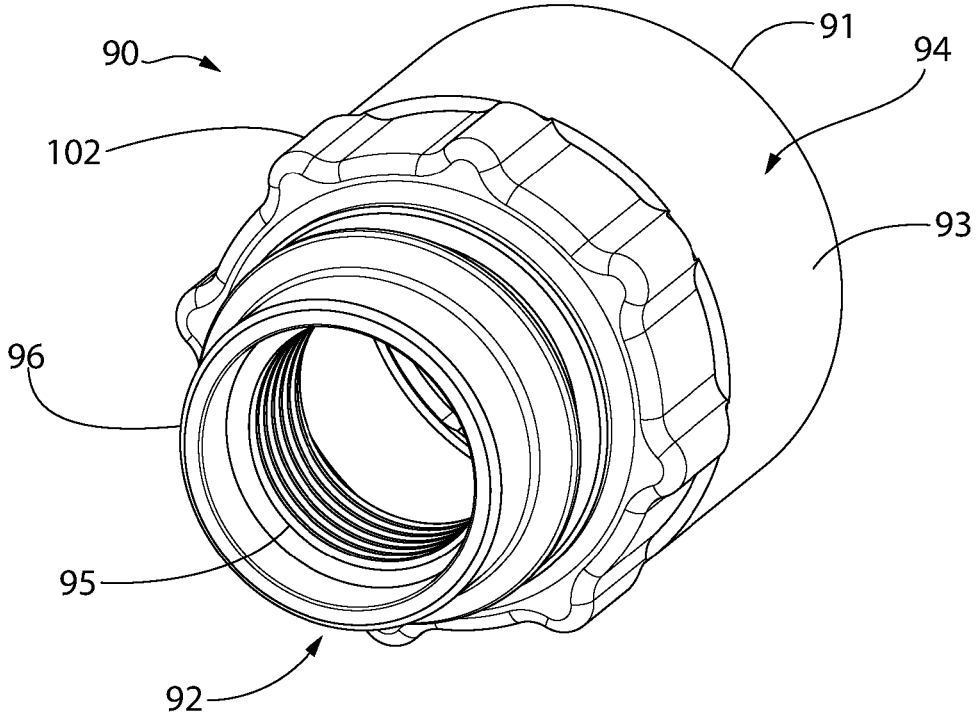
FIGS. 14 and 15 are front and rear perspective views respectively of a muzzle mount of the silencer of FIGS. 1 and 2.
Figure 15:
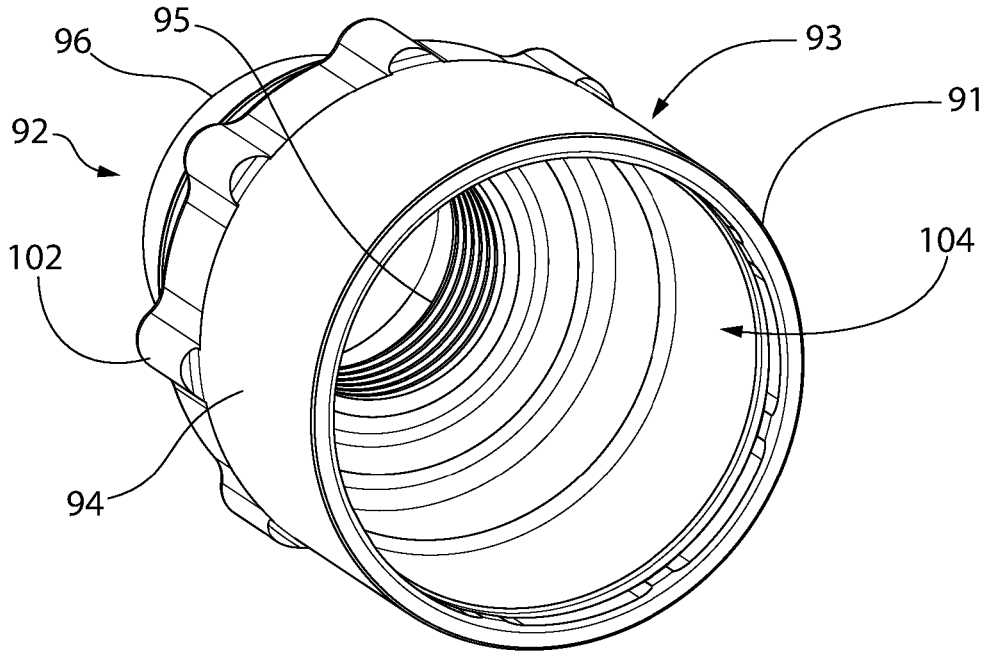
Figure 16:
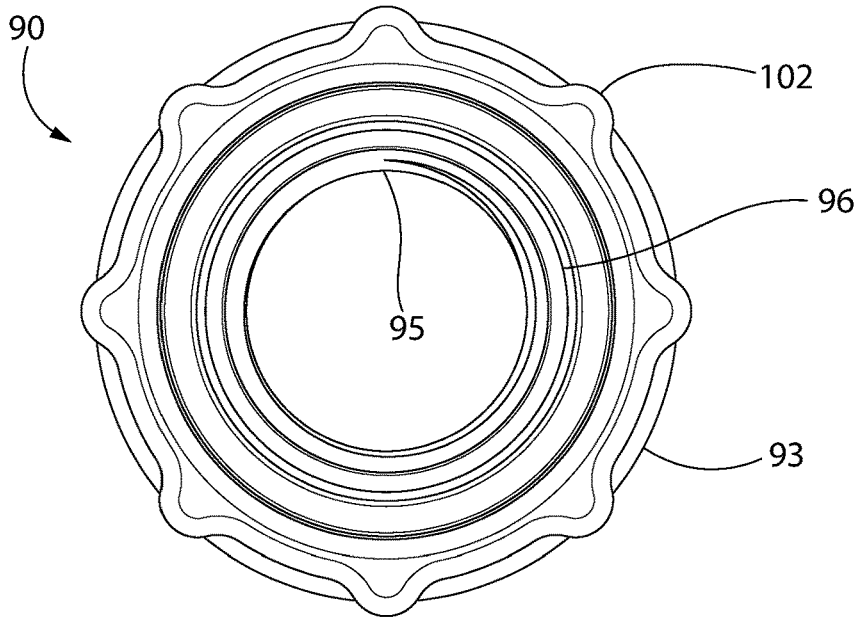
FIGS. 16 and 17 are front and rear end views respectively of the muzzle mount.
Figure 17:
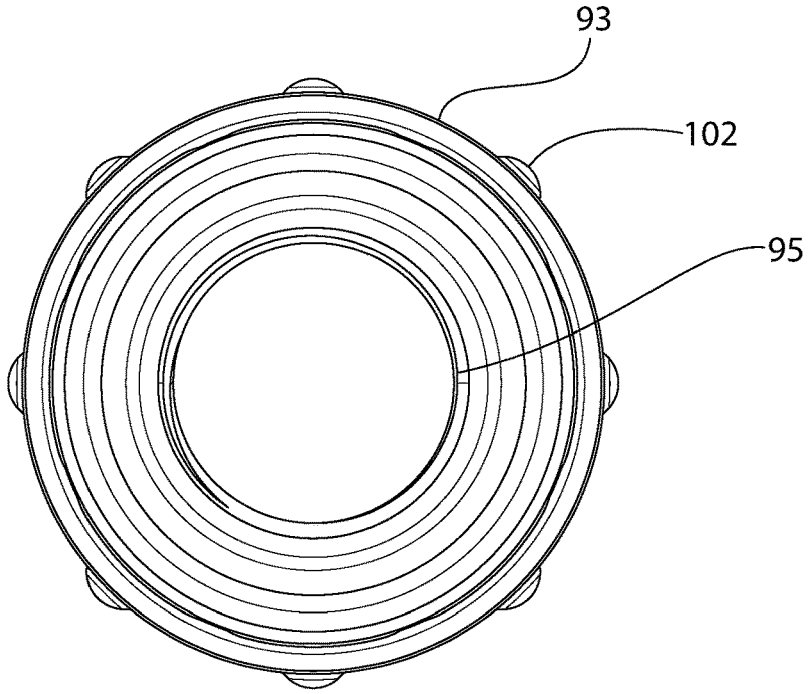
Figure 18:
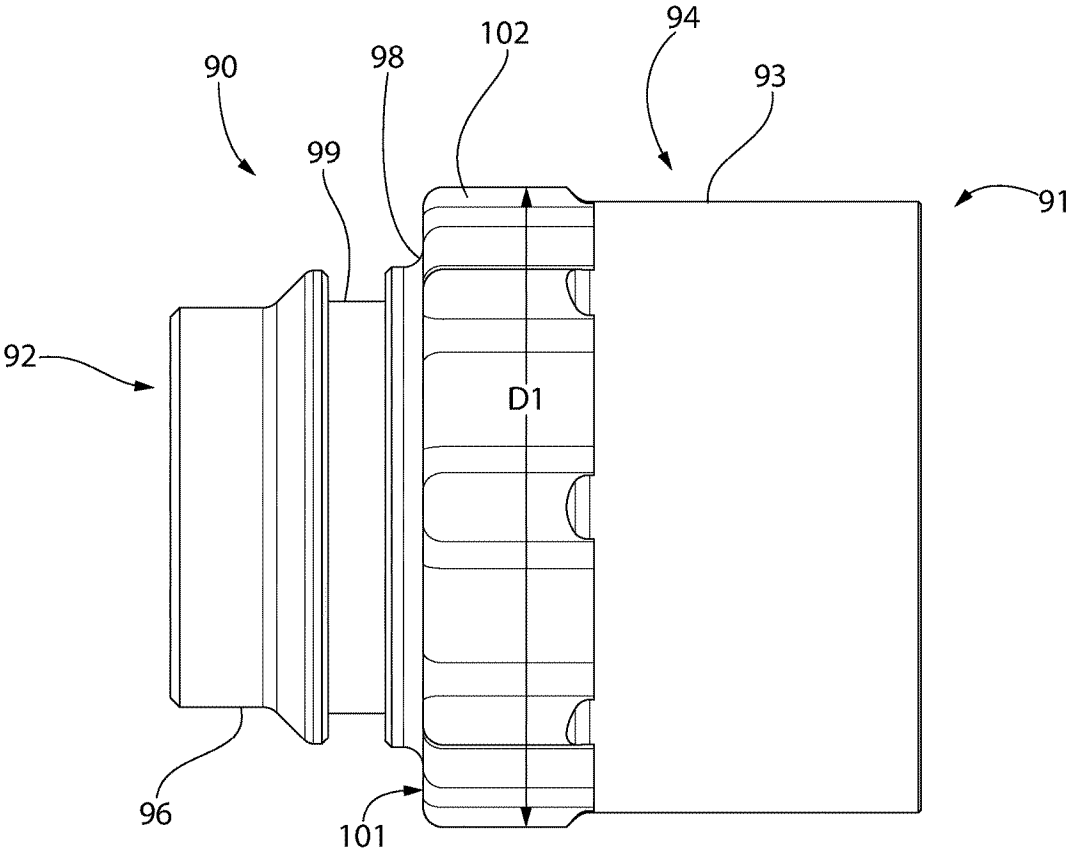
FIG. 18 is a side view thereof.
Figure 19:
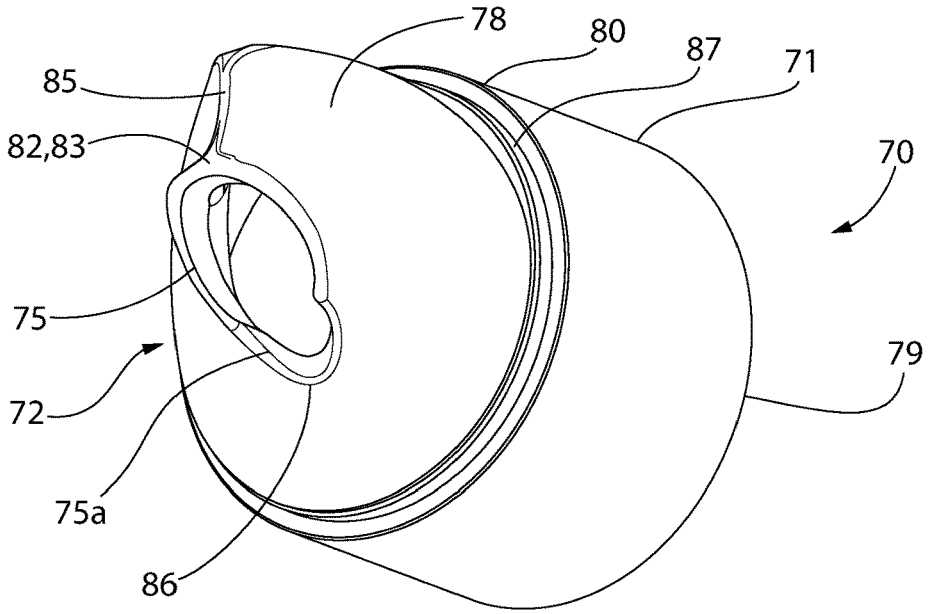
FIGS. 19 and 20 are front and rear perspective views respectively of a primary baffle of the silencer of FIGS. 1 and 2.
Figure 20:
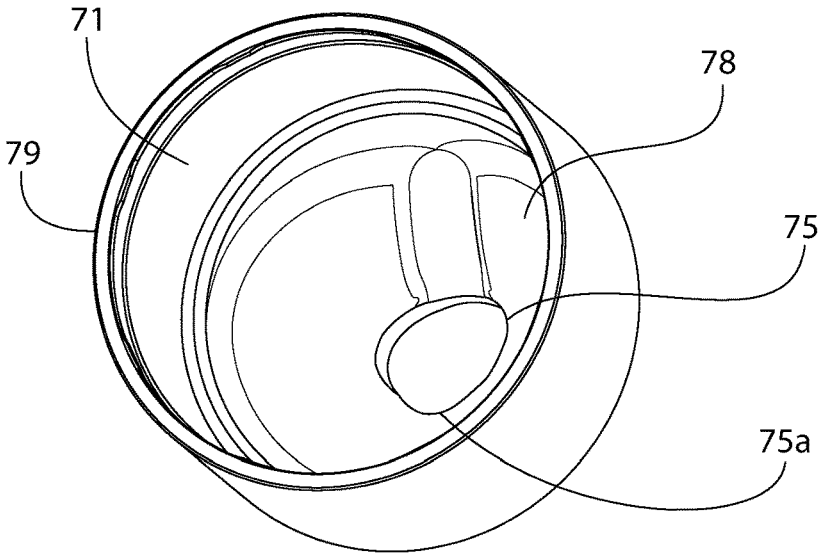
Figure 21:
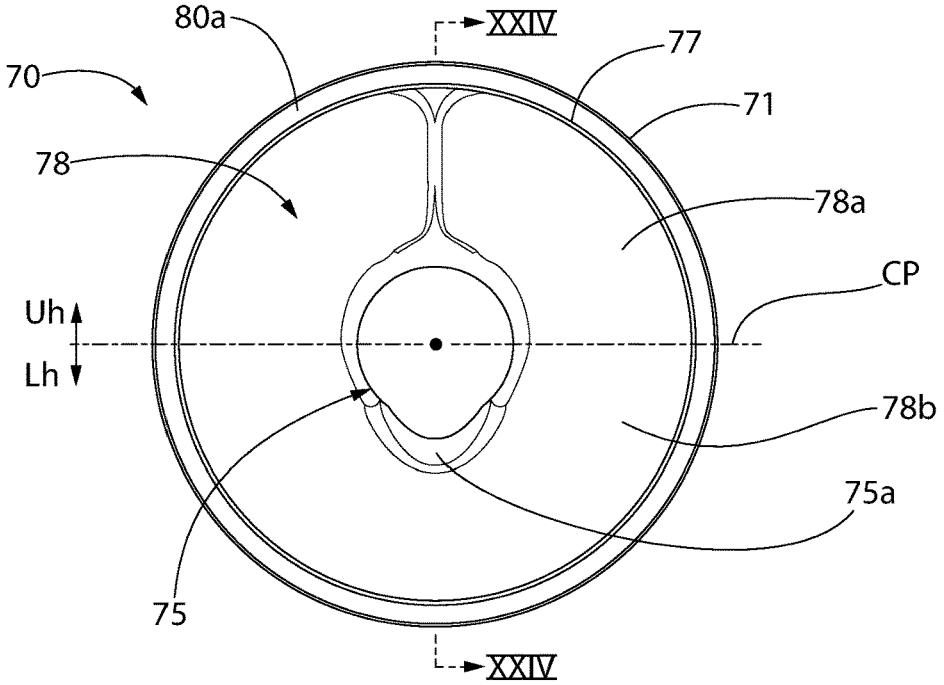
FIGS. 21 and 22 are front and rear end view respectively thereof.
Figure 22:
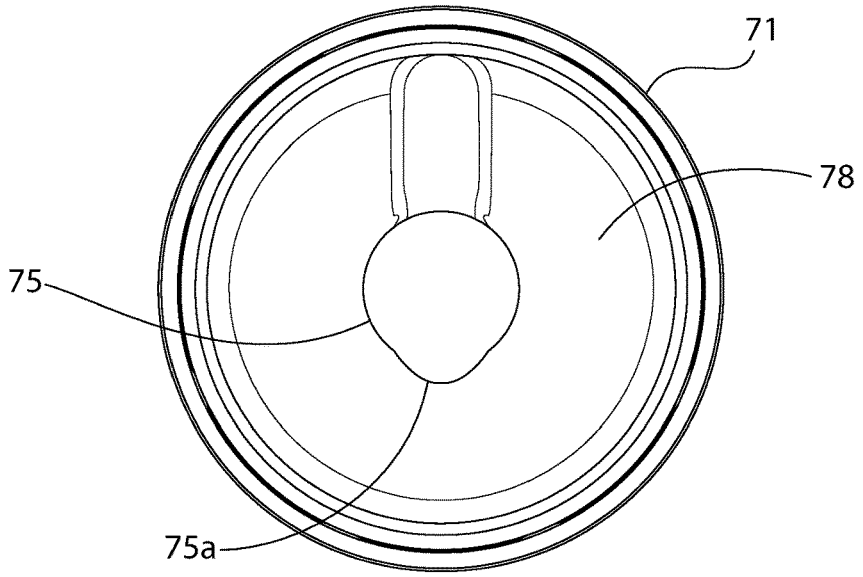
Figure 23:
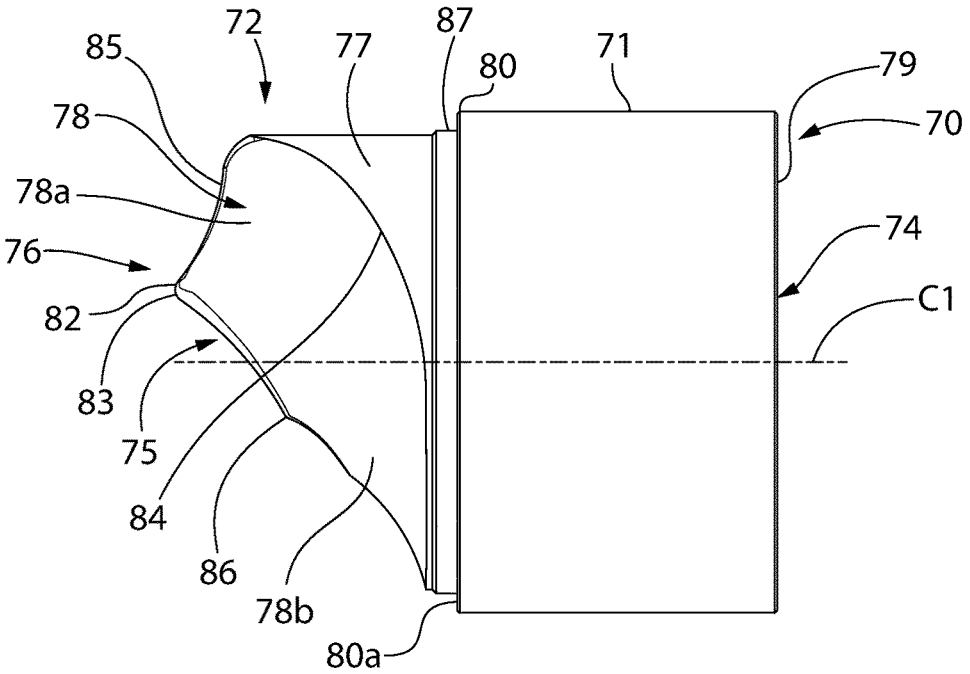
FIG. 23 is a side view thereof.
Figure 24:
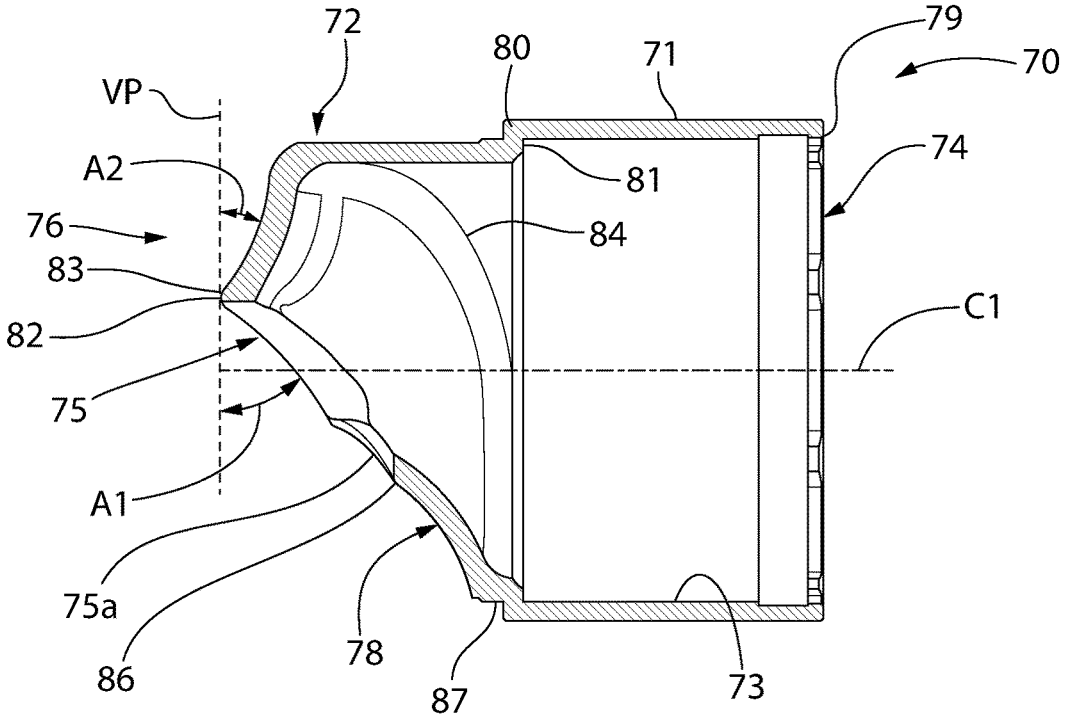
FIG. 24 is a longitudinal cross-sectional view thereof.
Figure 25:
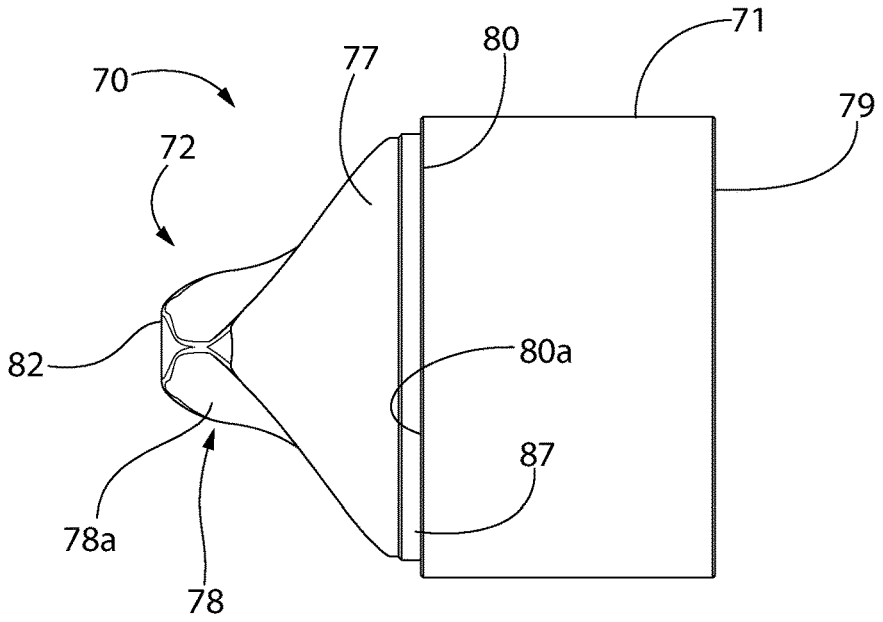
FIGS. 25 and 26 are top and bottom plan views thereof.
Figure 26:
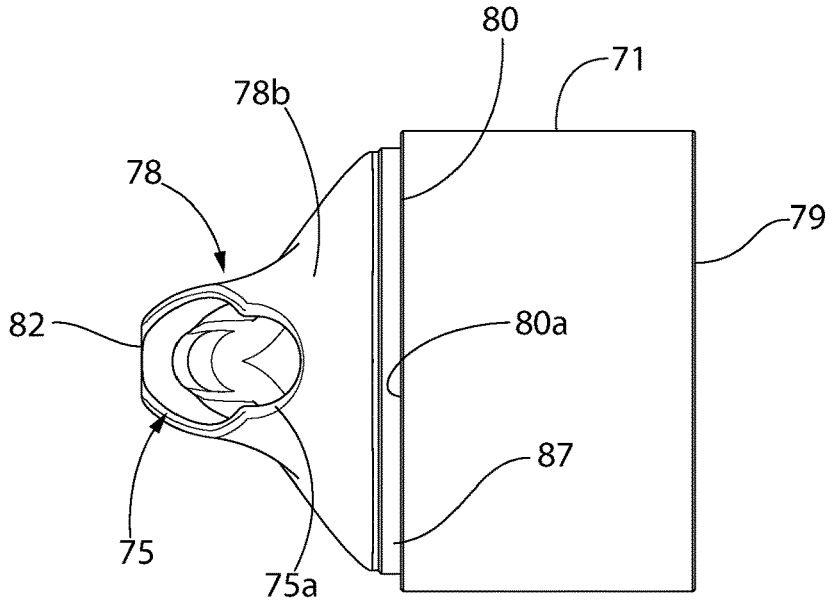

The blast baffle 50 and primary baffles 70 will next be described. Referring now to FIGS. 3 and 7-8, blast baffle 50 includes a tubular annular mounting sleeve 51 and an adjoining cone 52. In one embodiment, the cone 52 is formed integrally with the sleeve 51 as a unitary structural part thereof. Cone 52 may have a generally symmetrical hyperbolic shape in one embodiment with an arcuately curved sidewall 54 having an enlarged open front end adjacent to and communicating with the interior of sleeve 51, and which converges at a rear end to a central aperture 53 for receiving a projectile. Aperture 53 may be round and preferably has a diameter that matches the bore diameter of the barrel bore 18*a*. Central aperture 53 is coaxially and concentrically aligned with the longitudinal axis LA and barrel bore 18*a*, respectively. Longitudinal axis LA is concentrically aligned and coaxial with the barrel bore 18*a*.

Sleeve 51 has an outer diameter sized for placement adjacent the inside surface 26 of the silencer outer tube 21. Sleeve 51 thus has an outside diameter which is slightly smaller than the inside diameter of outer tube 21 sufficient to allow the blast baffle 50 to be slid inside the tube. The front end of the sleeve 51 is fully open and rear end transitions into the interior space of cone 52. Sleeve 51 in conjunction with cone 52 defines a cavity 55 sized for insertion of a cone of a primary baffle 70 at least partially therein, as best shown in FIGS. 7 and 8. Cavity 55 in conjunction with the primary baffle 70 immediately forward in the silencer forms one of several gas expansion chambers 110 in the silencer.

A recessed annular lip 56 is formed at a stepped transition on the outer surfaces between the sleeve 51 and cone 52. Lip 56 is defined by shoulder 50*a* that defines a rear facing abutment surface. The abutment surface and lip 56 engage the front end 91 of the muzzle mount 90 when the silencer is assembled. This forms an abutting interlocked gas-tight joint intended to prevent escape of combustion gases and fouling of the inside of the outer tube 21 with gummy carbon deposits which may make disassembly of the silencer for cleaning more difficult.

In one embodiment, cone 52 may have one or more through holes 57 to help equalize and balance the pressure of the combustion gases between blast baffle 50 and muzzle mount 90. The through holes 57 extend from the front side of the cone and cavity 55 completely through the cone to the rear side and adjoining cavity 104 of the muzzle mount. Any suitable size, shape, and number of through holes 57 as necessary to balance the pressure may be used. In one representative example, the holes 57 may be elongated and shaped as arcuately curved slots. Other shapes holes such as round or elliptical may be used in other non-limiting examples.

The primary baffles will now be described with reference to FIGS. 3, 7-8, and 19-24. For convenience in describing the primary baffles, the orientation of the primary baffles 70 shown for example in FIGS. 7, 8, and 21-24 will arbitrarily be considered an upright position defining a top and bottom of the baffle. It should be recognized that the baffle however may assume any rotational orientation when the silencer 20 is mounted to the barrel 18. The rotational orientation of baffles 70 does not affect the performance of the silencer for suppressing muzzle blast noise. Furthermore, the primary baffles 70 can be assembled with any individual baffle rotational alignment without any degradation to accuracy or noise suppression.

Primary baffles 70 may each be configured similarly and include a hollow annular mounting body or sleeve 71 which is tubular in shape and an adjoining hollow cone 72. The interior region of the annular mounting sleeve 71 and cone 72 are in fluid communication and contiguous between the ends of the baffle 70. Baffles 70 thus each include an open front end 74, partially closed rear end 76, and axially extending cavity 73 formed therebetween extending through the mounting sleeve and cone. In one embodiment, the cone 72 is formed integrally with the sleeve 71 as a unitary structural part thereof. In other embodiments, the cone may be a separate component attached to sleeve via any suitable means such as welding, adhesives, fasteners, etc.

Figure 28:
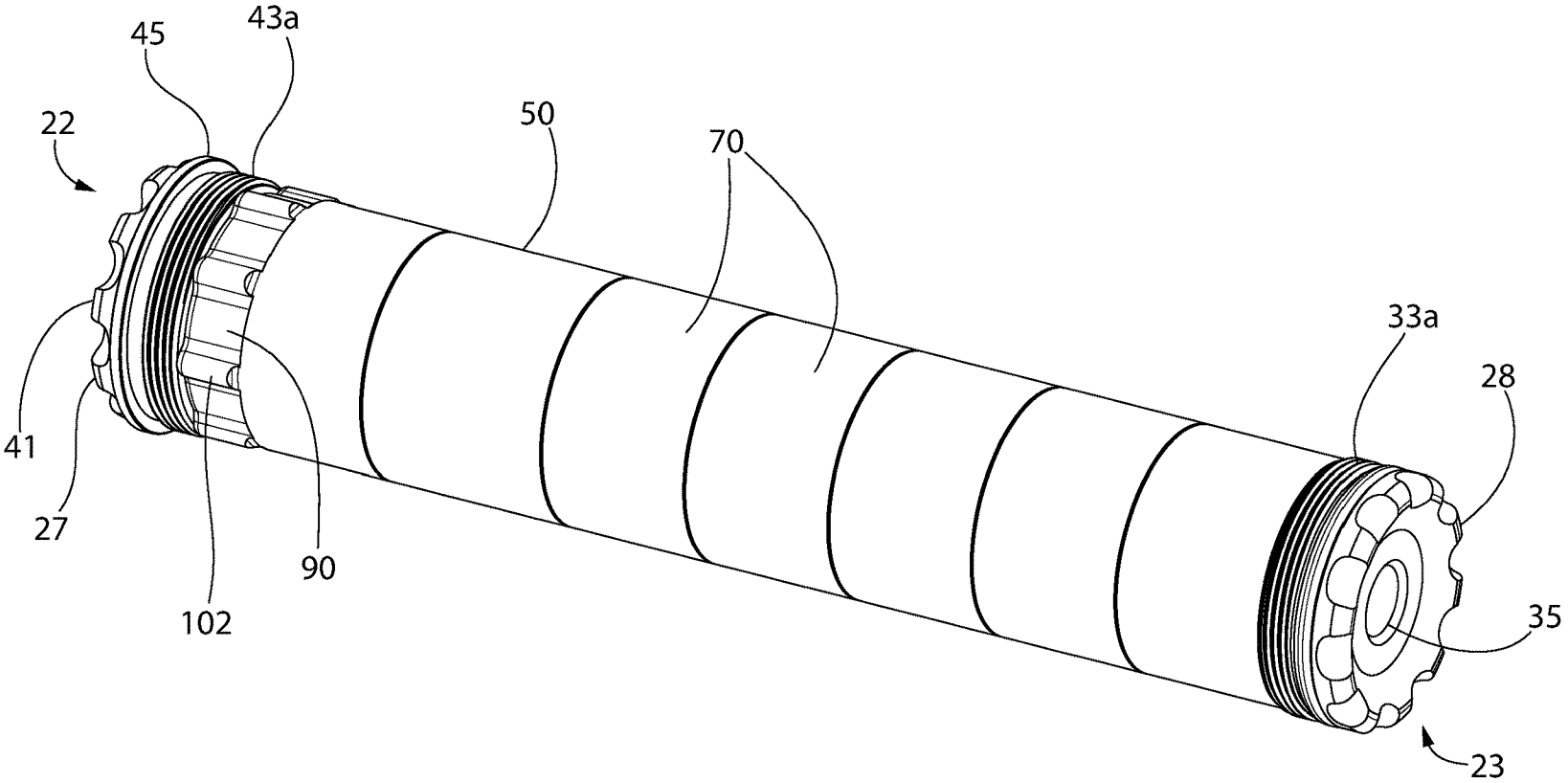
FIG. 28 is a perspective view of the silencer without the outer tube to show the stacked assembly of components.

Mounting sleeve 71 may be configured similarly to sleeve 51 of the blast baffle 50. The mounting sleeve 71 has an outer diameter sized for placement adjacent the inside surface 26 of the silencer outer tube 21. The outside diameter of sleeve 71 thus is slightly smaller than the inside diameter of outer tube 21 sufficient to allow the blast baffle 50 to be slid inside the tube. Mounting sleeve 71 defines a majority portion of the forwardly open cavity 73 sized for insertion of the cone 72 of the next adjacent forward primary baffle 70 at least partially therein, as best shown in FIGS. 7 and 8. Cavity 73 in conjunction with the next primary baffle 70 forward in the stack of baffles in the silencer defines another gas expansion chamber 110. The mounting sleeve 71 has a distal edge 79 which defines the front end 74 of the baffle and a proximal edge 80 which adjoins and from which the cone 72 extends axially towards the proximal end 22 of the outer tube 21. The proximate edge has a stepped configuration in one embodiment forming a shoulder 80*a* which defines a rear facing abutment surface for engaging the distal edge 79 of the next adjacent forward primary baffle 70 when the silencer is assembled, or the distal end of the blast baffle 50 for the rear-most primary baffle (see, e.g. FIGS. 7A, 7B, and 8). A raised annular lip 87 may be disposed between the mounting sleeve 71 and cone 72 adjacent shoulder 80*a* which forms a frictional press fit into the distal edge 79 of the next adjacent baffle to create a gas tight seal and self-supporting assembled baffle array which does not require the outer tube 21 for support outside of the tube (see, e.g. FIG. 28). This creates a primary pressure retention boundary or barrier for retaining the combustion gas pressure which does not rely on the secondary pressure retention boundary or barrier formed by the outer sleeve 21. Note that the primary baffles 80, blast baffle 50, and muzzle mount 90 collectively create a sealed internal volume to prevent carbon/lead from building up on the inside of the outer tube 21.

Cone 72 includes an internally open base end 81 connected to mounting sleeve 71 and a free terminal end 82 defining a rear prominence. Terminal end 82 may be straight in one embodiment (see, e.g. FIGS. 25 and 26). Cone 72 has a complex asymmetrical and skewed compound shape in one embodiment combining an axially-straight part-cylindrical wall segment 77 extending rearward from sleeve 71 and an arcuately curved concave wall segment 78 adjoining wall segment 77. Wall segment 77 has a partial cylindrical configuration (hereafter "partial cylinder wall segment" for brevity) having a maximum axial length along a top surface of the wall segment (see, e.g. FIGS. 19, 23, 24, and 25). The axial length gradually decreases along arcuate contour lines 84 formed at a transition between adjoining portions of the partial cylindrical wall segment 77 and concave wall segment 78 moving downward along each of the lateral sides of the cone 72. Accordingly, an arcuate contour line 84 is present on both lateral sides of the cone 72. The axial length of the partial cylindrical wall segment 77 is at a minimum and transitions into the mounting sleeve 71 near the axial centerline C1 of the baffle 70 (see, e.g. FIGS. 23-24). When positioned in the silencer, the partial cylindrical wall segment 77 forms a portion of the entire cone 72 which is disposed adjacent and closest to the interior surface 26 of the outer tube 21. In top plan view, partial cylindrical wall segment 77 has a substantially triangular shape with the apex forming a prominence (see, e.g. FIG. 25).

The concave wall segment 78 of cone 72 extends obliquely to and from the axially-straight partial cylindrical wall segment 77. The concave wall segment 78 of cone 72 defines an oblong central aperture 75 which receives a projectile therethrough from the barrel bore. Central aperture 75 is coaxially and concentrically aligned with the longitudinal axis and barrel bore 18*a*, respectively. Central aperture 75 has a smaller open area than the inside diameter of the open base end 81 of the cone 72. The major axis of central aperture 75 is longer than a minor axis like an ellipse. Conversely for comparison, the symmetrical cone section of the proximal blast baffle 50 has a round central aperture 53. Preferably, the open area of central aperture 75 presents a rearward projected vertical diameter that matches or is slightly larger than the diameter of the barrel bore 18*a* to receive a projectile therethrough.

The central aperture 75 of primary baffle 70 is obliquely arranged and oriented to the longitudinal axis LA of the silencer 20 (see, e.g. FIG. 7B). Accordingly, an acute and oblique angle A3 is formed between longitudinal axis LA and the angled plane Ap in which the central aperture 75 substantially lies. Aperture 75 faces generally rearwards and downwards forming the hood or overhang above the aperture shown. Advantageously, the top hood of the aperture encourages the majority of the combustion gases to spill over the wall of the baffle at the lowest, or forward-most, opening into the central aperture through the lower minor portion 75*a* of the aperture 75. This path of least resistance creates a strong cross-jetting that slows the progression of the gases traveling in-line with the central aperture 75. This increases the sound deadening performance of the silencer, all of which is further described below For an arbitrary reference system to facilitate description, the baffle 70 has a horizontal centerline C1 which defines a horizontal reference plane Cp which includes centerline C1. Centerline C1 is coaxial with the longitudinal axis LA of the silencer when mounted therein and bisects the baffle 70 into upper and lower halves Uh and Lh (see FIGS. 21-24). The concave wall segment 78 defines a rear face of the baffle 70 which is divided into a concave upper half section 78*a* defined above the centerline C1 and reference plane Cp, and a concave lower half section 78*b* defined below the centerline C1 and horizontal reference plane Cp. The shape and axial length of the upper and lower half sections is different giving the upper and lower half sections a different side profile as illustrated in the side and side cross-sectional views of the baffle 70 (see, e.g. FIGS. 23-24). The upper half section 78*a* protrudes axially rearward towards rear or proximal end 22 of silencer 20 farther than the lower half section 78*b*. Accordingly, the upper half section 78*a* of the concave wall segment 78 has portions particularly above the terminal end 82 of the baffle 70 which are spaced farther rearward and apart from the mounting sleeve 71 of baffle 70 than any portions of the lower half section 78*b* in the illustrated embodiment. Upper half section 78*a* is disposed at an acute angle A2 to a vertical reference plane Vp that intersects the terminal end 82 of cone 78 which is less than the acute angle A1 formed between the lower half section 78*b* and reference plane Vp. Accordingly, the lower half section 78*b* has a greater slope than the upper half section 78*a*. The upper half section 78*a* primarily adjoins the partial cylindrical straight wall segment 77 whereas the lower half section 78*b* adjoins the mounting sleeve 71.

The upper and lower half portions 78*a*, 78*b* of the concave wall segment 78 collectively define the oblong central aperture 75. A rear prominence on the upper half portion 78*a* of the cone concave segment adjacent central aperture 75 defines a leading edge 83 of the aperture and a trailing edge 86 of the aperture is defined by the lower half portion 78*b*. In the orientation of silencer 20 shown in FIGS. 7A and 23-24, the leading edge 83 is a top edge and trailing edge 86 is a bottom edge of central aperture 75. Leading edge 83 projects farther rearward than the trailing edge 86 such that a projectile entering the central aperture 75 from the barrel bore 18*a* of barrel 18 after discharging the firearm first encounters the leading edge. The leading edge 83 thus creates a cantilevered hood or overhang above the central aperture 75 forcing a portion of the gas not traveling directly through the aperture downwards around the aperture and along the rear face of the cone. A concavely sloped prominent ridge 88 extends rearwards and downward from the apex of the part-cylindrical segment 77 to the leading edge 83 of central aperture 75 where the right and left halves of the upper portion 78*a* of concave wall segment 78 meet (see, e.g. FIGS. 19, 23, 24, and 25).

In some embodiments, a lower minor portion 75*a* of the central aperture 75 may have a smaller lateral width which is less than the diameter of the barrel bore 18*a* so that the projectile does not pass through this portion. Conversely, the upper major portion of the central aperture 75 having a lateral width larger than the minor portion 75*a* has a lateral width the same as or larger than the barrel bore 18*a* to allow passage of a projectile therethrough. The lower minor portion 75*a* adds extra open space below the projectile as it is passing through the central aperture 75 to permit combustion gas cross-jetting to initiate simultaneously.

Each primary baffle 70 is essentially shaped like a skewed cone. The axially longer (or taller) upper half section 78*a* section of the baffle cone segment 78 is designed to ramp the combustion gas pressure away from and around the central aperture 75 to gather at the lowest point on the lower half section 78*b* of the cone segment against the baffle face. As the combustion gas pressure builds enough to "spill" over the oblong rim of the cone segment that defines the aperture 75 and flows into the aperture through the lower minor portion 75*a*, this causes gas cross-jetting into the next forward baffle chamber 110.

Cross-jetting is extremely effective at disrupting the high speed combustion gases traveling along the bore-line (i.e. longitudinal axis LA coaxial with central aperture 75), which if left alone would escape out of the suppressor at high pressures, thus creating a loud report. The gases need to be slowed down to give them time to expand and cool. The cross-jetting of the first primary baffle 70 causes the gases to divert from the bore-line, get caught in the next downstream baffle chamber 110, and then add to the cross-jetting flow of that baffle. Thus, the efficacy of each baffle 70 progressively improves closer to the front distal end 23 of the silencer. The asymmetrically skewed shape of the primary baffle 70 encourages this cross-jetting to occur faster than normal cone shapes. It is advantageous for this cross-jetting effect to occur quickly in order to slow as much escaping gas as possible.

The primary baffle 70 can be formed by any suitable method. In some fabrication processes, this compound baffle shape may be machined from a single piece of metal bar stock or investment cast to net shape and then finished by appropriate machining techniques. The invention is not limited by the production method(s) used.

A method for assembling a silencer 20 will now be generally described. The method described herein is one of several possible sequential approaches for assembling the silencer. Accordingly, numerous sequential variations are possible and the invention is not limited to any one approach.

The present method comprises providing an outer tube 21, a rear end cap 27, a front end cap 28, a muzzle mount 90, a blast baffle 50, and a plurality of primary baffles 70. The baffles 50, 70 are slideably inserted into the internal passageway 25 of the outer tube 21 through either the open front or rear ends 23, 22 of the tube. Accordingly, the baffles may be sized to fit through either open end of the tube. The baffles 50, 70 are inserted such that the cones 52, 72 face rearwards in the tube 21. As the baffles are inserted, the annular mounting sleeves 51, 71 of the baffles slideably engage the interior surface of the outer tube 21. In some embodiments, the baffles 50 and 70 may be press fit together to form a preassembled baffle stack outside of the outer tube 21 before insertion. In other embodiments, the baffles 50 and 70 may be inserted one at a time into the outer tube. Either approach may be used.

Next, the radially protruding splines 102 on the muzzle mount 90 are axially aligned with the mating axial grooves 103 in the rear end 22 of the outer tube. In other embodiments where the axial grooves 103 are formed in the muzzle mount and the splines 102 are formed on the rear end 22 of the outer tube 21 in the internal passageway 25, the grooves on the muzzle mount are axially aligned with the splines on the tube. The muzzle mount 90 is then inserted through the open rear end 22 of the outer tube with the splines 102 slideably engaging the grooves 103 regardless of which of these two components the grooves and splines are formed on. This leaves an end portion of the internal threads 43*b* inside the outer tube 21 exposed to receive the rear end cap 27 which is mounted after the muzzle mount 90 is installed, thereby locking the muzzle mount in the tube.

It bears noting that the radial splines 102 on the muzzle mount protrude outwards by an amount such that the ends of the splines define a diameter D1 (see, e.g. FIG. 18) which is larger than the inside diameter of the outer tube 21. Accordingly, the muzzle mount 90 in the present embodiment cannot be inserted through the front end 23 of the tube 21. The grooves 103 in the rear end of the outer tube however provide the additional clearance necessary allow insertion of the splines and muzzle mount 90 into the outer tube 21. Preferably, the grooves 103 extend only partially through the outer tube in the axial direction to avoid unnecessary machining, and more preferably the grooves have an axial length sufficient to engage the splines and limit insertion of the muzzle mount at a point which leaves some of the internal threads 43*b* of the tube exposed for mounting the rear end cap 27.

With the muzzle mount 90 seated now in the outer tube 21, the rear end cap 27 is then threadably coupled to the rear end of the tube. This traps and locks the muzzle mount into the outer tube 21. If not already installed, the front end cap 28 is threadably coupled to the front end of the outer tube. The rear and front end caps 27, 28 may be tightened using the castellations to secure the silencer assembly. The end put all internal components in compression and the outer tube 21 into tension. These components utilize the seals 37 and 100 such as rubber O-rings previously described that help prevent loss of torque due to the repeated firing of a mounted firearm. The assembled silencer 20 may be threadably coupled to the threaded muzzle end 18*c* of the barrel 18 by rotating the tube. The keyed anti-lock feature of the splines 102 and grooves 103 prevent the silencer assembly from being disassembled or loosened when the outer tube 21 of the silencer is affixed to the firearm.

Advantageously, the rear end cap mounting arrangement disclosed herein in which the rear end 22 of the outer tube 21 is internally threaded 43*b* for coupling the rear end cap 27 allows the outer tube to be made mechanically simple and with a basic tube configuration being formed from a standard solid tube without any appurtenances, flanges, protrusions, or other surface features needed for mounting the end cap that may otherwise make fabrication more complex and expensive. In addition, it bears noting that the rear end cap has a plain aperture 44 without threading since it is not relied upon for mounting the silencer 20 to the firearm barrel 18. Rather, the threaded nozzle 96 of the muzzle mount 90 which extends through the entrance aperture 44 of the rear end cap 27 mounts the silencer to the firearm barrel.

Any suitable materials may be used for any silencer assembly and its components. Preferably, the components are all formed of an appropriate metal or metal alloy (with exception of the seals described herein) such as aluminum, steel, titanium, or other. In one representative but non-limiting example, the rear and front end cap 27, 28 may be formed of aluminum or stainless steel. The muzzle mount 90 may be formed of stainless steel. The blast and primary baffles 50, 70 may be formed of stainless steel or aluminum. The outer tube 21 may be formed of aluminum, preferably in some embodiments from barstock or cold hammer forged aluminum. The tube 21 could also be made of preferably titanium due to its light weight and strength, or alternatively but less preferably of a steel material such as stainless due to its added weight.

Figure 29:
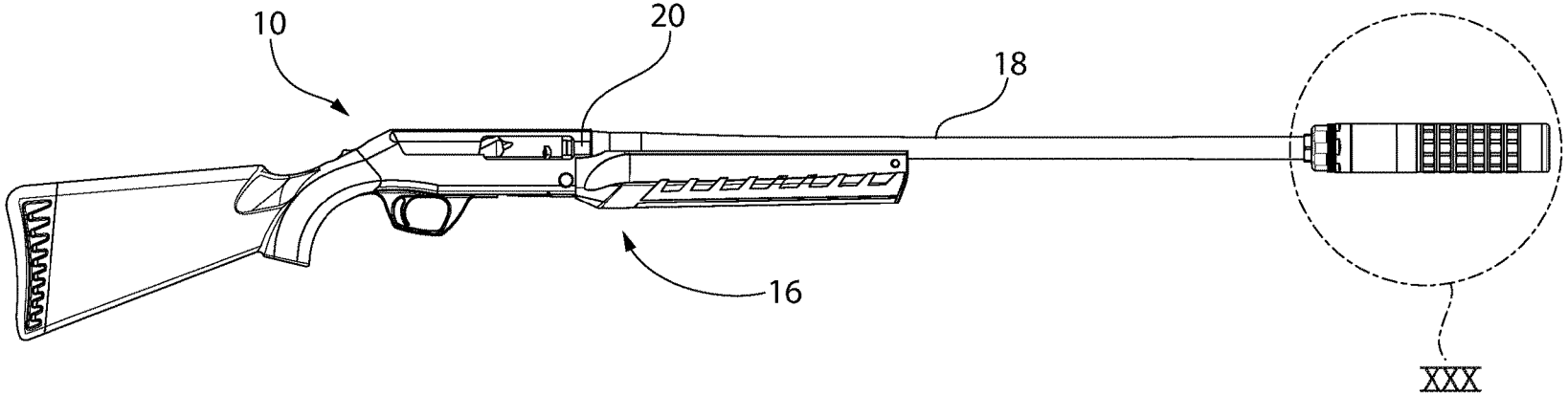
FIG. 29 shows a firearm including a second embodiment of a silencer according to the present disclosure.
Figure 30:
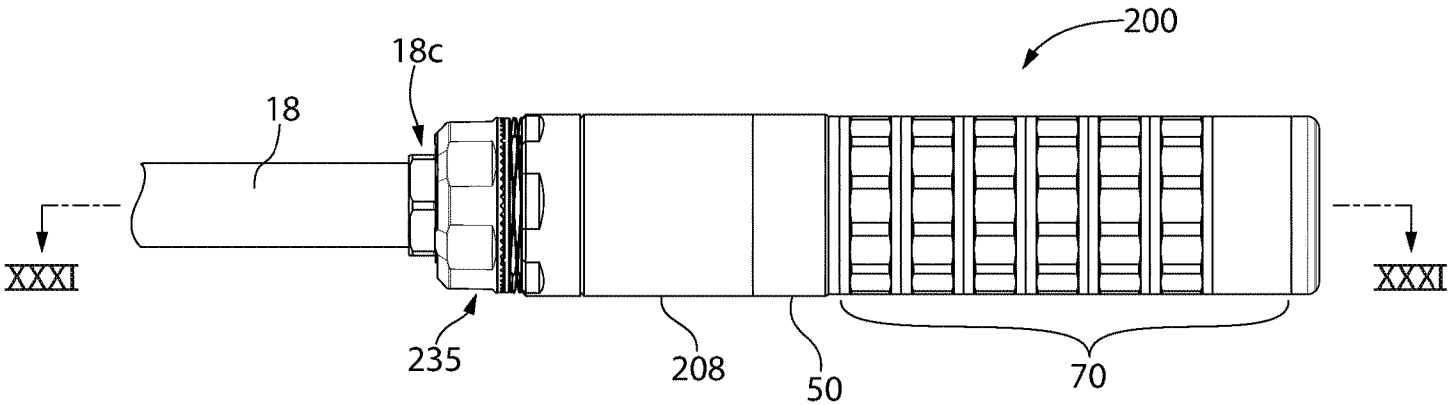
FIG. 30 is an enlarged detail taken from FIG. 29.
Figure 31:
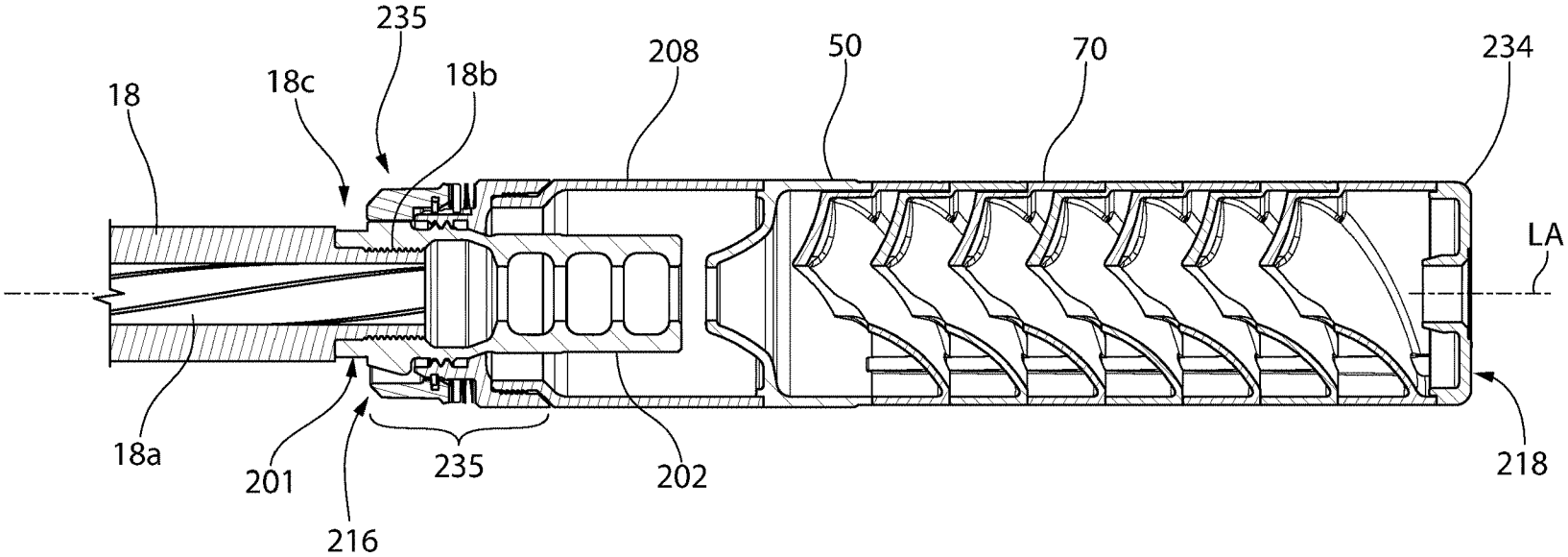
FIG. 31 is a side longitudinal cross-sectional view thereof taken along line XXXI in FIG. 30.
Figure 32:
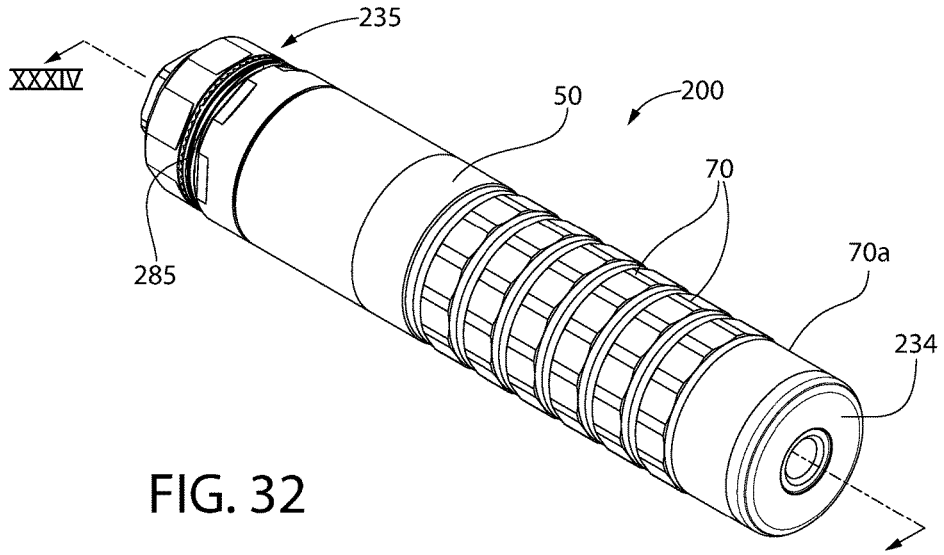
FIG. 32 is a front perspective view of the silencer of FIG. 31.
Figure 33:
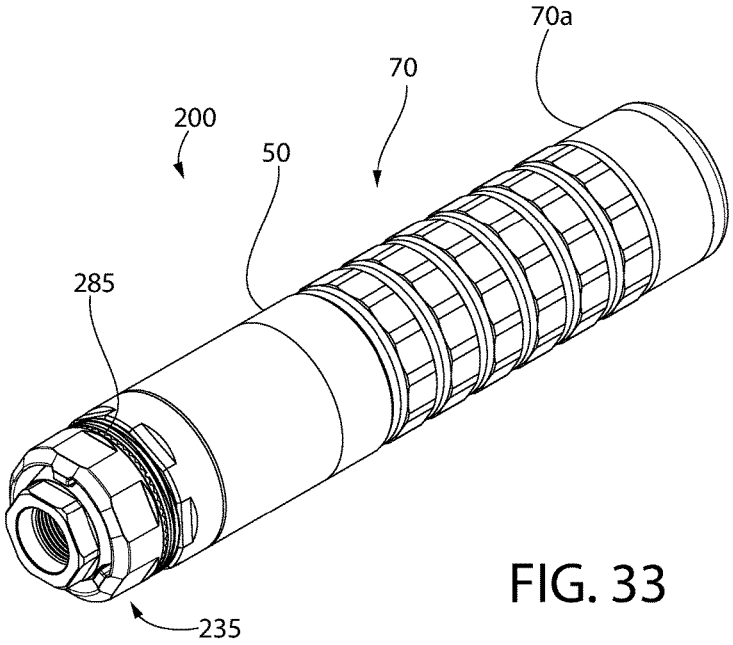
FIG. 33 is rear perspective view thereof.

According to another aspect, the baffles disclosed herein may be embodied in a silencer system configured for quick mounting and detachment to/from the firearm barrel. Referring to FIGS. 29-31, the silencer system comprises an assembly and combination including a quick-coupling ratcheting silencer 200 and muzzle device 201. Muzzle device 201 is configured for attachment to the muzzle end 18*c* of the firearm barrel 18 and mounts the silencer 200 to the firearm. Muzzle device 201 may be any type of device or fixture which may be coupled to the barrel 18 of a firearm 10. Firearm 10, which may be in the form of a conventional rifle in the non-limiting illustrated embodiment, includes the usual major components including a stock 16, receiver 20 supported by the stock, and barrel 18 supported by the stock and/or receiver. In one embodiment, muzzle device 201 may be a muzzle brake 202 as shown, or alternatively a flash hider in other embodiments. In yet other possible embodiments contemplated, muzzle device 201 may simply be configured as a coupling interface for removably mounting silencer 200 to the firearm barrel 18 without any further functionality associated with ameliorating the discharge of the firearm in some way like a muzzle brake or flash hider.

With additional reference to FIGS. 40-43, muzzle brake 202 includes an axially elongated body comprising a front portion 224 defining an open distal front end 219, a diametrically enlarged rear portion 225 defining an open proximal rear end 220, and a longitudinally-extending internal passageway 223 extending between the ends for receiving a projectile discharged by firearm 10 therethrough. An obliquely angled and sloped annular engagement surface 227 is formed at the stepped transition between the front and rear portions 224, 225. Surface 227 is disposed at an oblique angle to the longitudinal axis LA and faces in a generally forward direction to engage a complementary-angled mating surface 282 disposed on a coupling member 235, as further described herein.

Rear portion 225 may include internal threads 226 configured for removable mounting to the firearm barrel 18, which has mating external threads 18*b* formed on the muzzle end 18*c* of the barrel. The rear portion 225 may also include external threads 228 which are arranged to rotatably engage mating internal threads 229 formed on the silencer 200 for securing the silencer to the muzzle brake 202. Both the internal and external threads 226, 228 are disposed rearwards of the angled annular engagement surface 227 in one embodiment. Rear portion 225 further defines a raised annular boss 279 extending radially outwards from the rear portion proximate to rear end 220 and oriented perpendicular to the longitudinal axis LA. The boss 279 defines a plurality of axially oriented and extending longitudinal channels or grooves 278 spaced circumferentially apart around the ring. The grooves 278 are used for mounting silencer 200 to the muzzle brake to provide an array of rotational stops for the silencer's quick-coupling system, as further described herein.

Front portion 224 of muzzle brake 202 defines a forwardly projecting tubular gas dispersion extension 221 which is received inside the silencer 200. Extension 221 may be generally cylindrical and includes plural transverse gas exhaust openings 222 in fluid communication with the internal passageway 223 of the muzzle brake 202 for transversely discharging and dispersing a portion of the combustion gases therethrough in a transverse direction to the longitudinal axis LA of the silencer. The openings 222 may be oriented at any rotational position without adversely affecting the performance of the muzzle brake depending on where the openings fall when the brake is threaded onto the firearm barrel.

Referring now to FIGS. 29-40, the quick-coupling ratcheting silencer 200 generally comprises a longitudinal axis LA (and corresponding axial direction), rear proximal end 216 closest to the firearm barrel 18, front distal end 218 farthest from the barrel, an elongated support tube 208, a plurality of horizontally/longitudinally stacked baffles including a proximal blast baffle 50 and plurality of primary baffles 70 all supported by the tube in a cantilevered manner, and front distal end cap 234 affixed to the baffle stack. The silencer is coupled to the muzzle device 201 via a ratcheting coupling member 235 configured and operable to removably couple and lock the support tube 208 to the muzzle brake. Each component of the silencer and coupling member assembly will be now described in further detail below.

Figure 50:
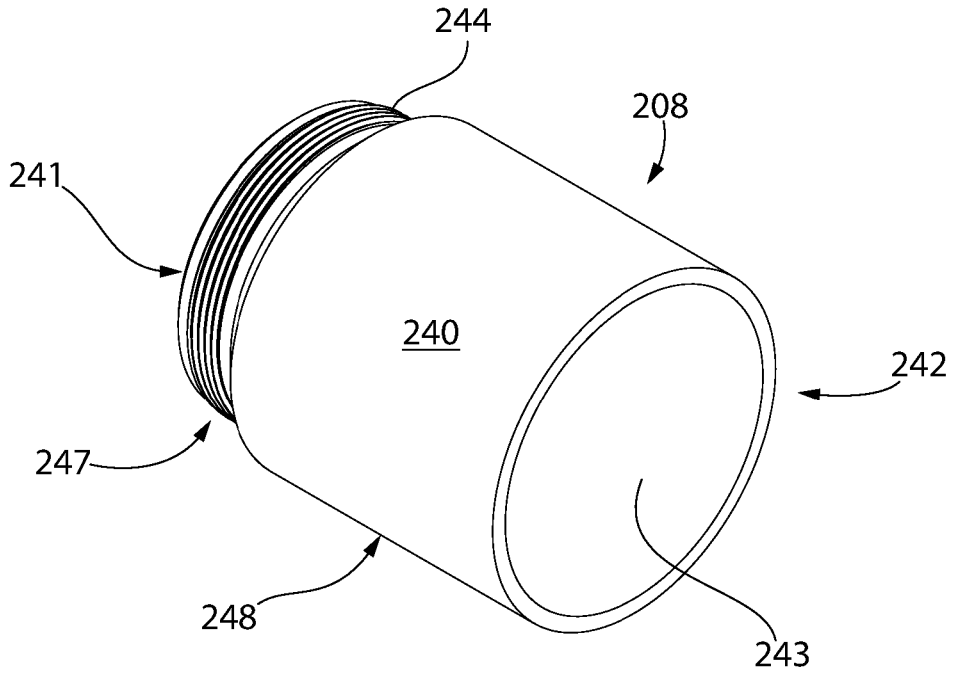
FIG. 50 is a front perspective view of the mounting support tube of the silencer of FIG. 30.
Figure 51:
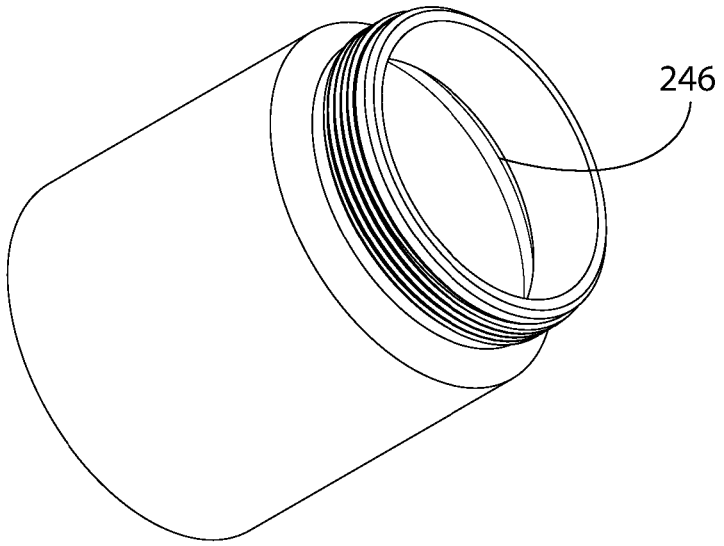
FIG. 51 is a rear perspective view thereof.
Figure 52:
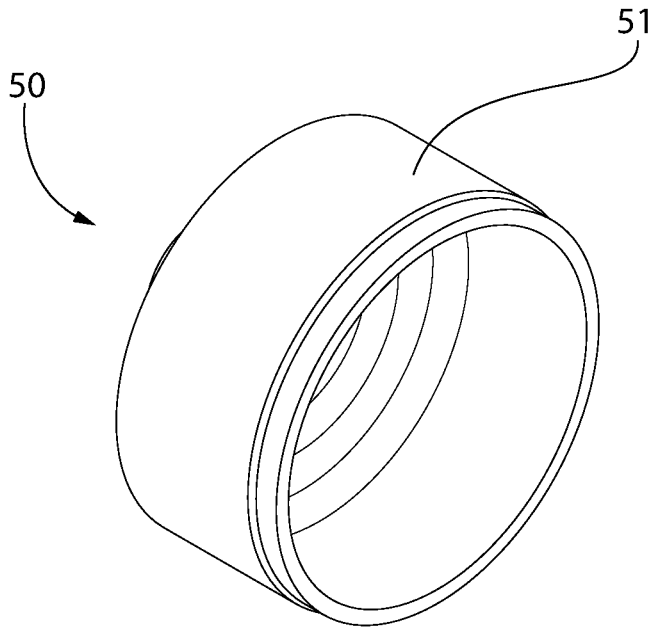
FIG. 52 is a front perspective view of the blast baffle of the silencer of FIG. 30.
Figure 53:
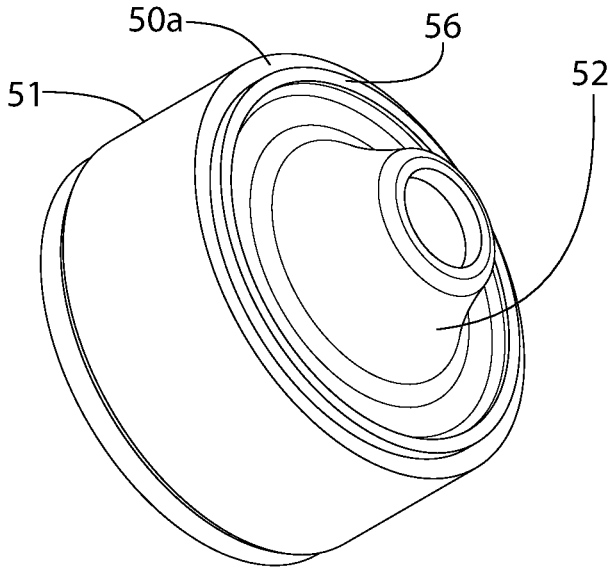
FIG. 53 is a rear perspective view thereof.
Figure 54:
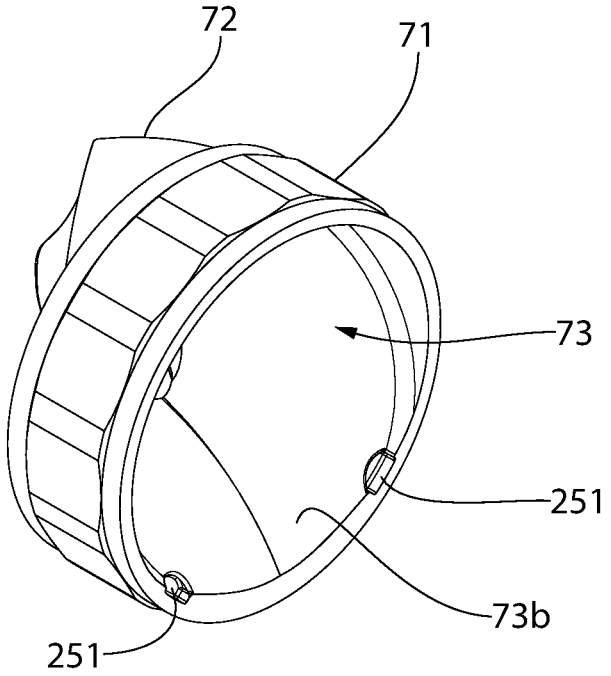
FIG. 54 is a front perspective view of one of the plurality of primary baffle of the silencer of FIG. 30.
Figure 55:
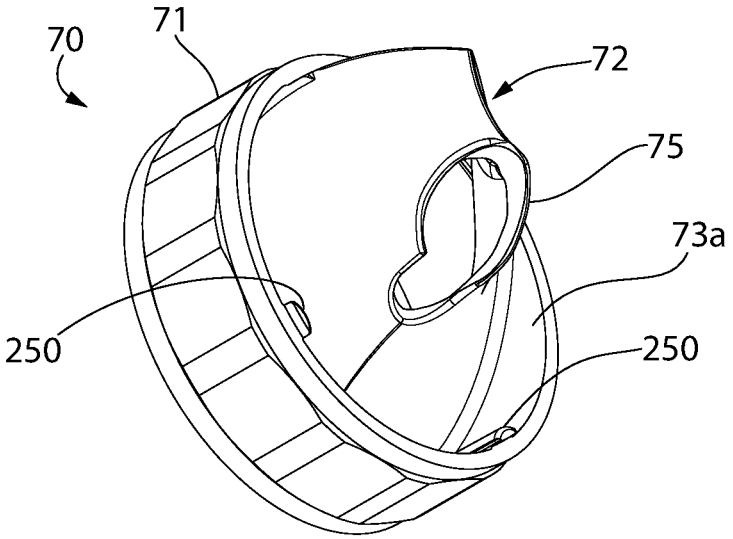
FIG. 55 is a rear perspective view thereof.

Support tube 208 has a hollow tubular body including a longitudinally-extending cylindrical sidewall 240 that defines a rear proximal end 241 ("proximal end" for brevity), a front distal end 242 ("distal end" for brevity), and an internal passageway 243 extending axially between the ends and coaxially aligned with passageway 223 of the muzzle brake (see also FIGS. 50-51). The ends 241 and 242 may be fully open in one embodiment without any flanges or other inwardly or outwardly radially extending protrusions which simplifies manufacture of the tube. The interior surface of the tube (e.g. sidewall 21) is generally smooth and unthreaded. The outer surface of the rear end portion 247 of support tube 208 may include external threading 244 for threadably mounting the ratcheting coupling member 235 thereto, as further described herein. Rear end portion 247 may be diametrically smaller than front portion 248 in some embodiments wherein an obliquely angled and sloped annular shoulder or transition 246 is formed therebetween (best shown in FIGS. 35 and 51). Support tube 208 may be solid in structure (i.e. free of through holes or apertures) in one embodiment.

Figure 34:
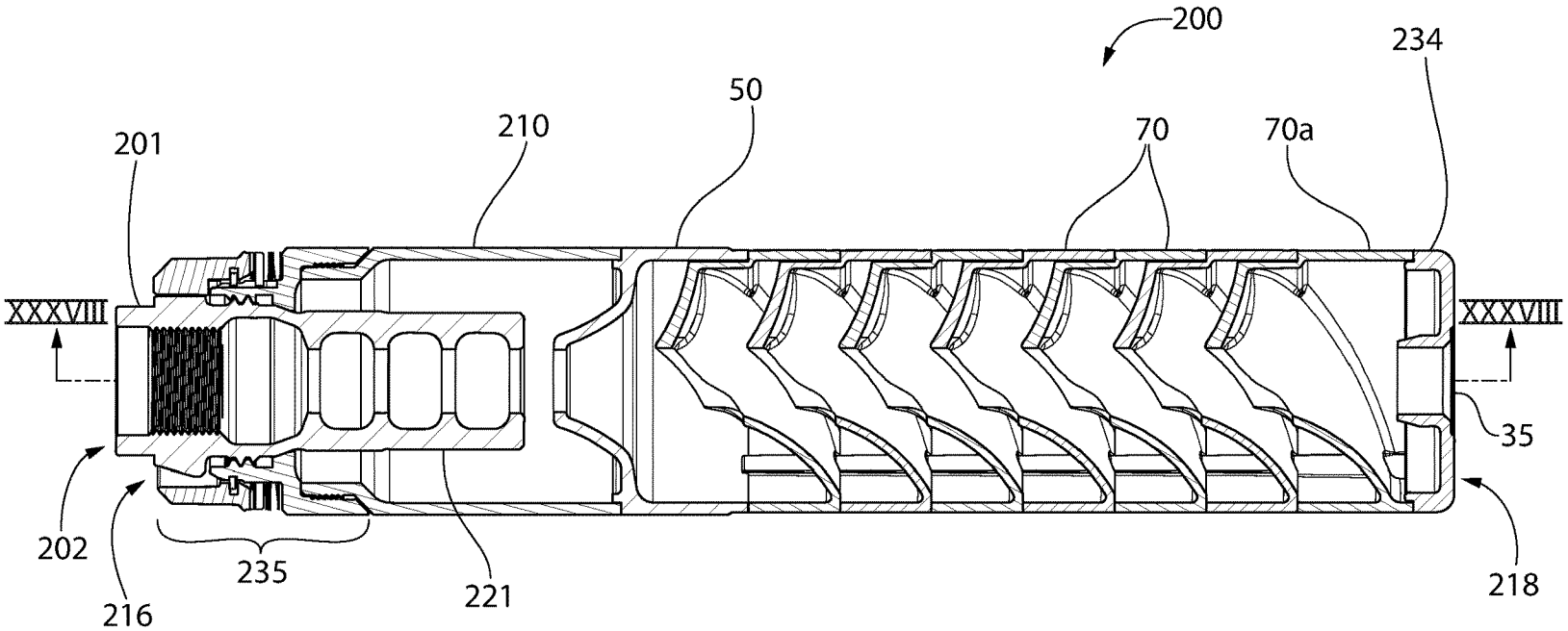
FIG. 34 is side cross-sectional view thereof.
Figure 35:
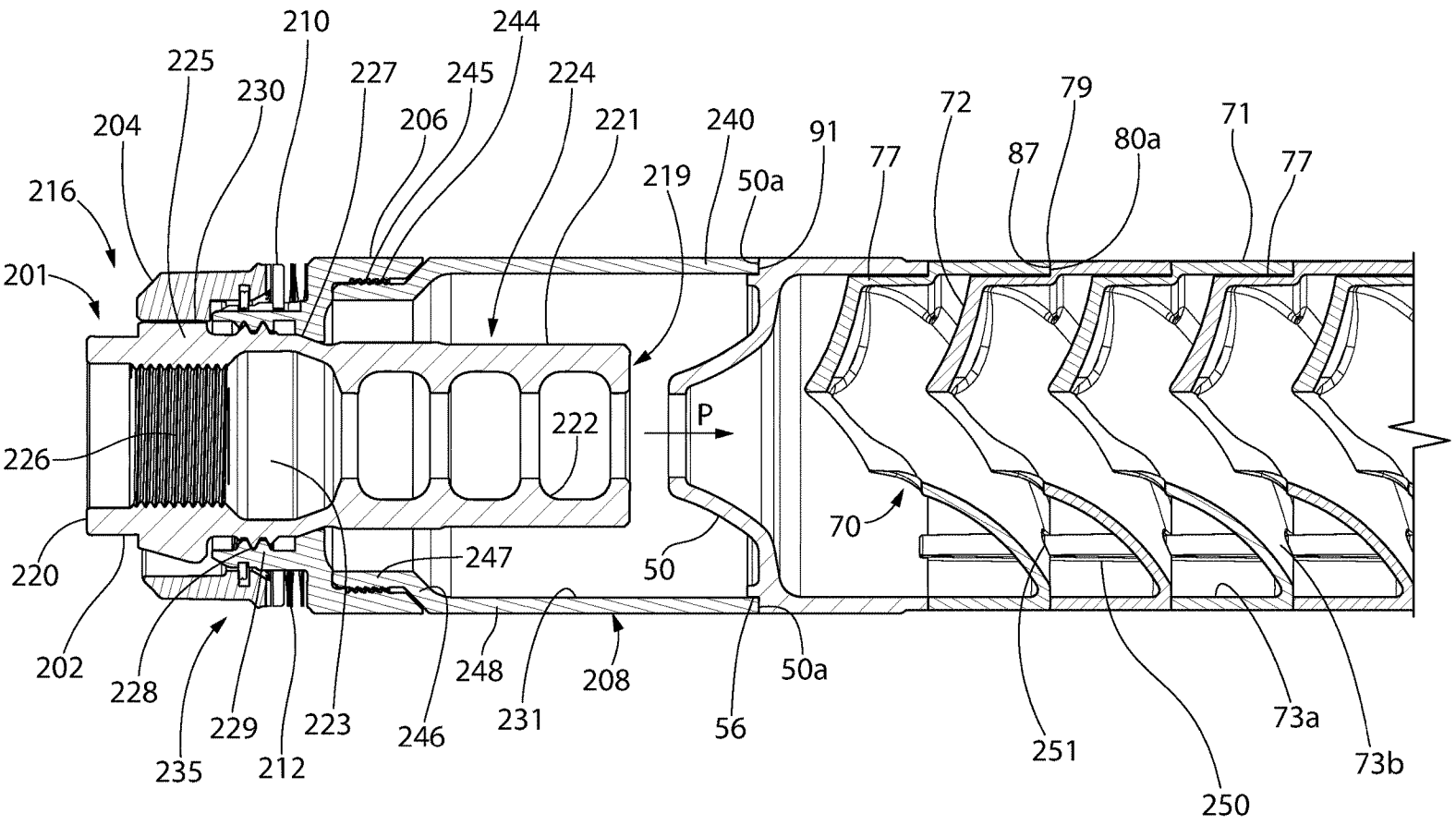
FIG. 35 is an enlarged view of the rear proximal end thereof.
Figure 37:
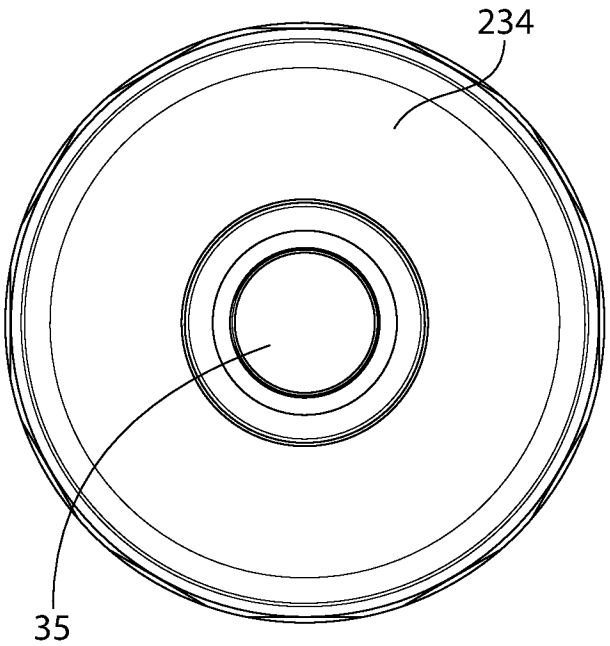
FIG. 37 is a front end view thereof.
Figure 36:
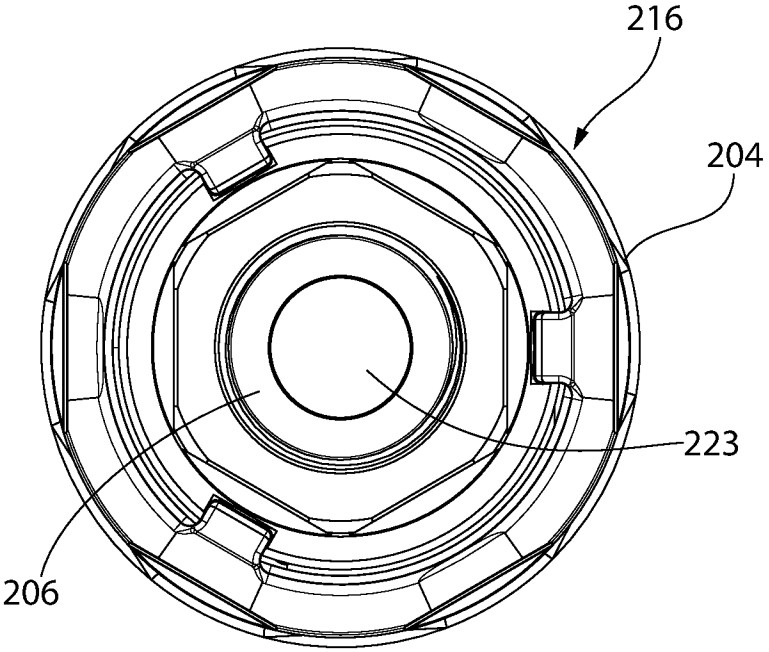
FIG. 36 is rear end view thereof.
Figure 38:
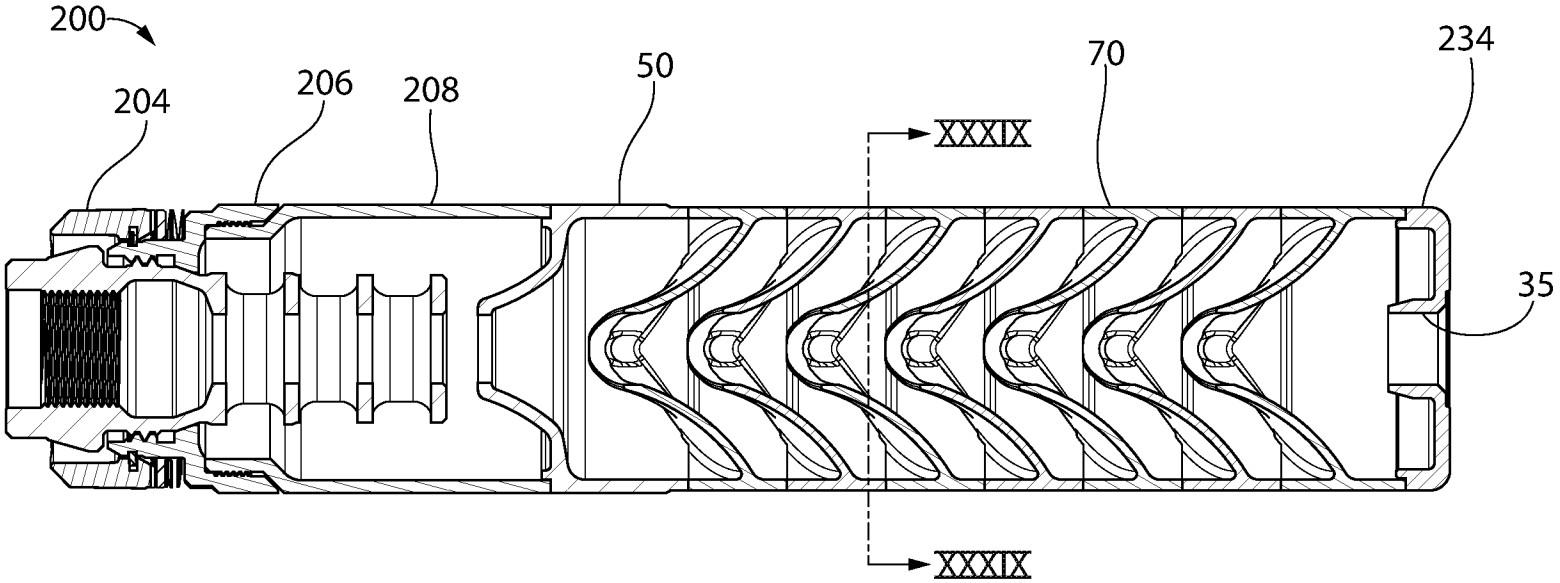
FIG. 38 is a top longitudinal cross-sectional view taken along line XXXVIII in FIG. 34.
Figure 39:
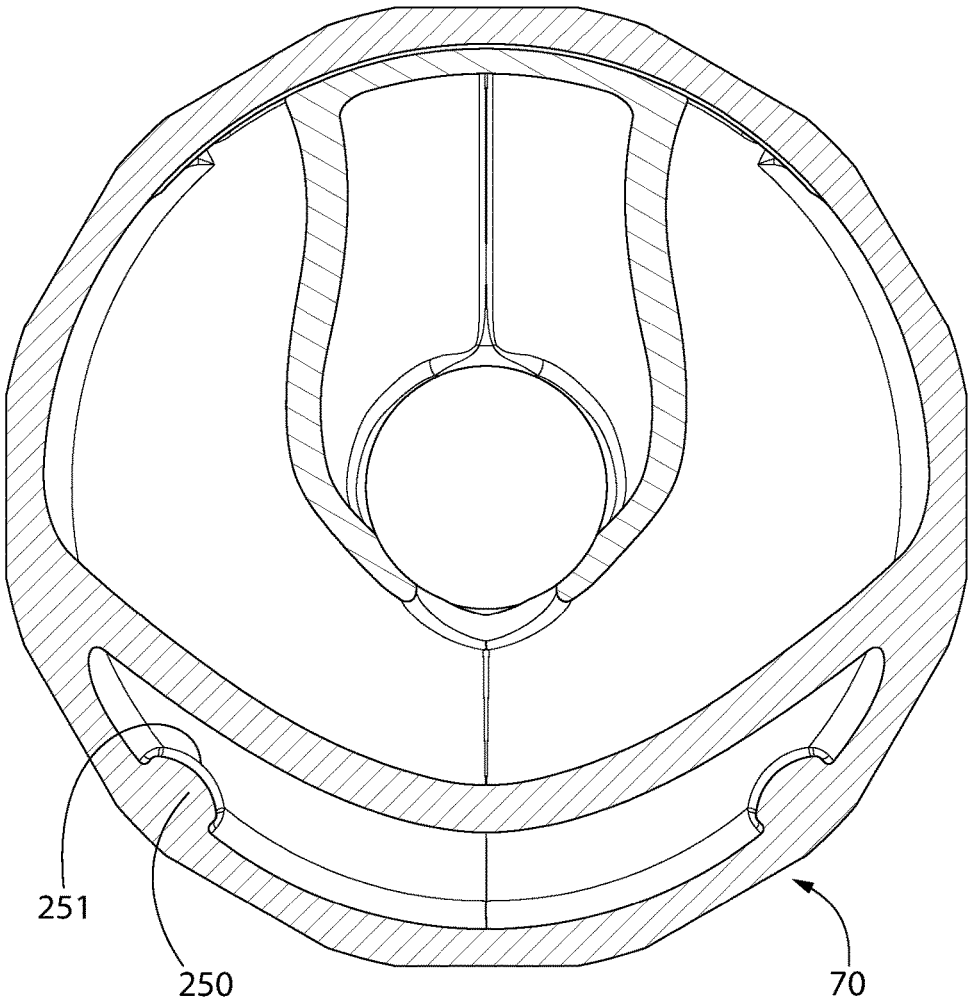
FIG. 39 is a transverse cross-sectional view taken along line XXXIX in FIG. 38.
Figure 40:
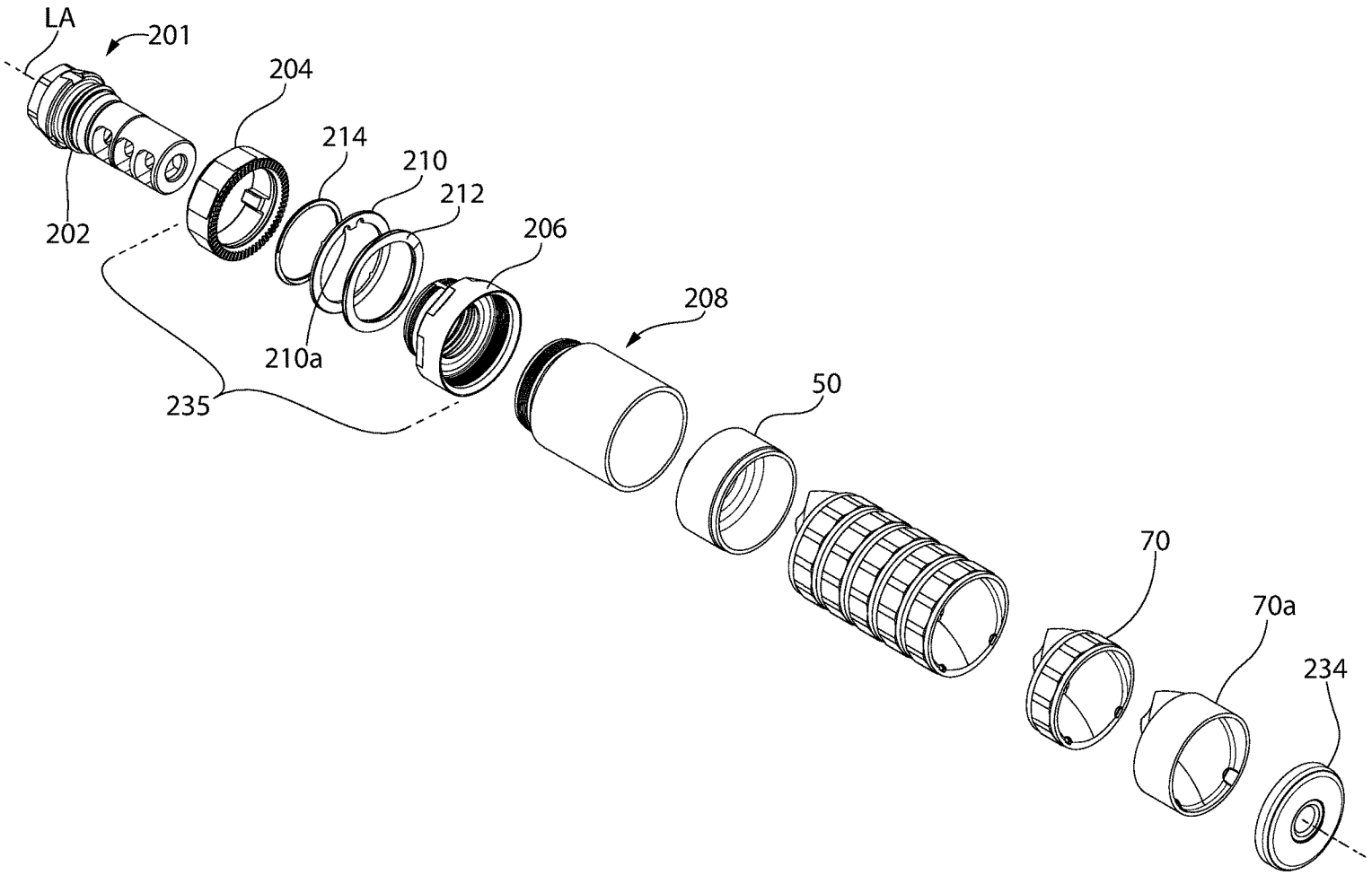
FIG. 40 is an exploded perspective view of the silencer and muzzle device assembly of FIG. 30.

The symmetrical blast baffle 50 and asymmetrically-shaped skewed cone primary baffles 70 may generally be configured and constructed as already shown in FIGS. 3, 7-8, and 19-26 and described herein. With additional reference to FIGS. 52-57, baffles 50 and 70 may therefore include the same frictional press-fit features which allow them to be assembled together via an interlocked fit to form a stacked array of baffles in a similar manner. As shown in FIGS. 34 and 35, blast baffle 50 is directly supported via press-fitting to support tube 208. In the present silencer embodiment, however, the recessed annular lip 56 (defined by shoulder 50*a* that defines a rear facing abutment surface) formed at the stepped transition on the outer surfaces between the sleeve 51 and cone 52 of blast baffle 50 instead engages the front distal end 242 of support tube 208 when the silencer is assembled. The skewed cone primary baffles 70 in the stack are in turn supported from the blast baffle 50.

Baffles 70 may be frictionally press-fitted to the support tube 208 and each other via the same mating frictional press-fit features already described herein. To summarize, each baffle 70 in some embodiments may therefore include the raised annular lip 87 disposed between the mounting sleeve 71 and cone 72 adjacent to shoulder 80*a* which forms a frictional press fit into the distal edge 79 of the next adjacent baffle (see FIGS. 19-26) to create a gas tight seal and self-supporting assembled baffle array which does not require the support tube 208 for support. In some embodiments as shown in FIGS. 34-35, the raised annular lip 87 may be omitted and the frictional press fit may be created directly between the distal interior surface of sleeve 71 within baffle cavity 73 and exterior surface of the part-cylindrical wall segment 77 of the extending rearward from sleeve 71 (see also FIGS. 54-57).

Referring to FIGS. 34-35, 39, and 54-57, each baffle 70 may include rotational indexing elements to ensure all cones 72 in the baffle stack have the same rotational orientation when assembled together. In one embodiment, the indexing elements may comprise a plurality of raised longitudinally-extending protrusions 250 formed in a rear facing portion of baffle cavity 73*a* adjacent to cone 72 and mating forwardly open notches 251 formed proximate to the distal edge 79 of the baffle in the forward facing portion 73*b* of the cavity within sleeve 71. The protrusions 250 and notches 251 are circumferentially spaced apart around the baffle 70 as shown. At least one mating pair of protrusions and notches is provided, and more preferably at least two or more. In the illustrated embodiment, two pairs are disposed in the lower halves of the baffles 70. Engagement between each pair of protrusions 250 and notches 251 rotationally locks each adjoining pair of baffles 70 relative to each other (see, e.g. FIG. 39).

It bears noting that in the present embodiment of baffle 70 being discussed with respect to FIGS. 34-35 and 54-57, the sleeve 71 of the baffle is extended in a rearward direction to encircle a portion of the cone 72 as shown, thereby creating the rear portion 73*a* of the baffle cavity 73. By contrast, the former configuration of the baffle shown in FIGS. 19-26 has a sleeve 71 which terminates at the base of the cone 72. Advantageously, the extended baffle sleeve design of FIGS. 34-35 allows the baffles to be stacked much closer together without adding unnecessary weight, thereby concomitantly reducing the length and improving the balance of the silencer.

Figure 56:
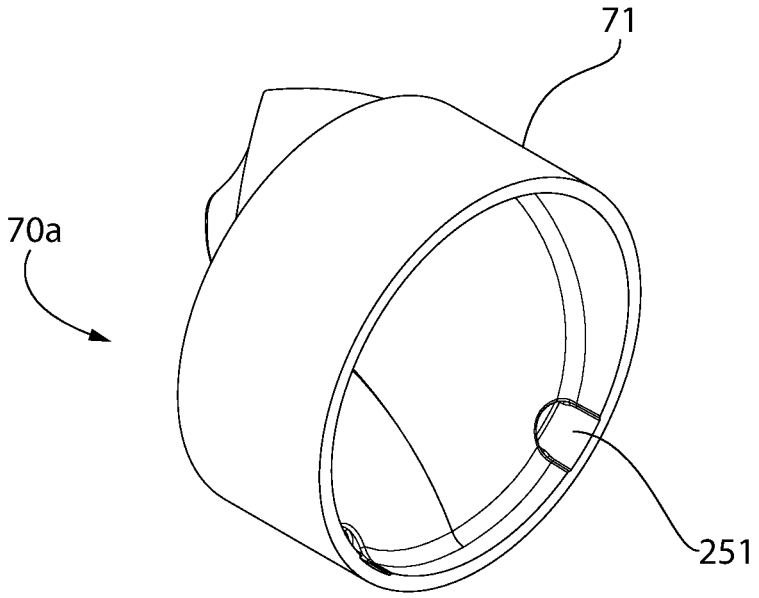
FIG. 56 is a front perspective view of the forward-most primary baffle of the silencer of FIG. 30.
Figure 57:
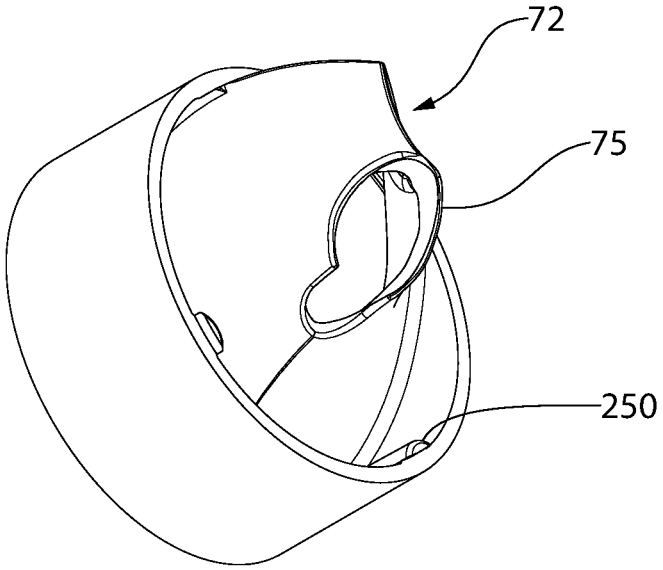
FIG. 57 is a rear perspective view thereof.
Figure 58:
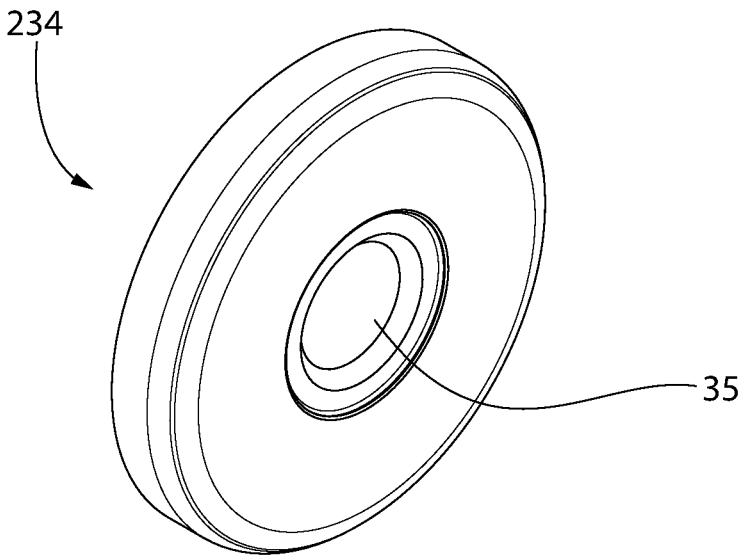
FIG. 58 is a front perspective view of the front end cap of the silencer of FIG. 30.
Figure 59:
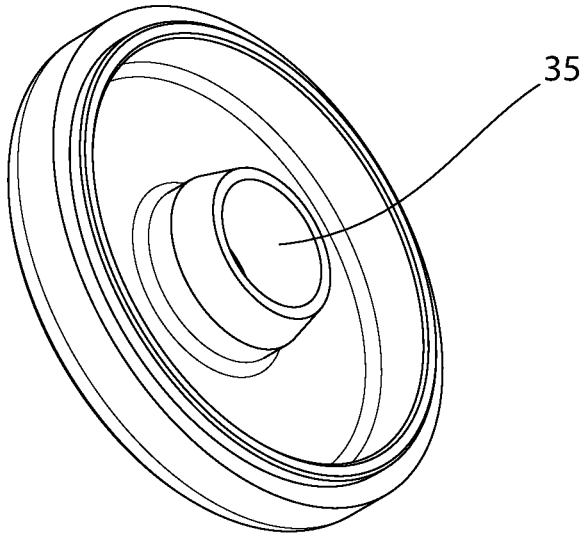
FIG. 59 is a rear perspective view thereof.

The exterior surfaces of baffles 50, 70 may be visibly exposed without any outer shell or tube thereby forming the outermost surface of the silencer body as shown. The exterior surface of some or all of the baffles 50, 70 may be smooth and plain, or may have surface features (e.g. texturing, recesses, undulations, etc.) to facilitate assembly of the baffle stack and/or for aesthetics. The sleeve 71 of the forward-most baffle 70*a* may be plain as shown in FIGS. 56-57, or include the same or different surface features as other baffles 70 in the stack.

In one embodiment, without limitation, the blast baffle 50 and primary baffles 70 may be welded together, and blast baffle may in turn be welded to the front end 242 of the support tube 208 to collectively form an integral gas-tight assembly with pressure retention barrier. End cap 234 may in turn be welded to the forward-most baffle 70 in the stack or removably attached thereto. In another possible embodiment, the support tube 208 may be axially elongated and configured to extend forward for the entire length of the silencer up to the front end cap 234 in the manner shown in FIG. 7A. End cap 234 may be mounted to the tube via a threaded interface between the tube and end cap as shown. In this implementation, the baffles 50, 70 may be configured and dimensioned to fit inside the support tube 208 in a manner similar to the outer tube 21 and baffle assembly of silencer 20 of the first embodiment already described herein with reference to FIG. 7A. The baffles 50, 70 therefore may not be welded together in this embodiment allowing them to be removed from the support tube 208 and disassembled for cleaning if necessary.

The ratcheting coupling member 235 will now be described in detail with general reference to FIGS. 29-40 and 44-49. Coupling member 235 includes a ratchet ring 204, adapter 206, detent ring 210, biasing member such as an annular wave spring 212 sandwiched between the detent ring and the adapter, and a retention ring 214 to lock the ratchet ring and adapter axially together. The ratchet ring and the detent ring each have mating detent surfaces (e.g. radial grooves or teeth) which become mutually engaged under an axially-directed biasing force imparted by a biasing member which provide the ratchet mechanism 285, as further described herein. The detent ring and the adapter may be rotationally locked together in one embodiment such that the detent ring remains stationary with respect to the adapter, as also further described herein.

Figure 47:
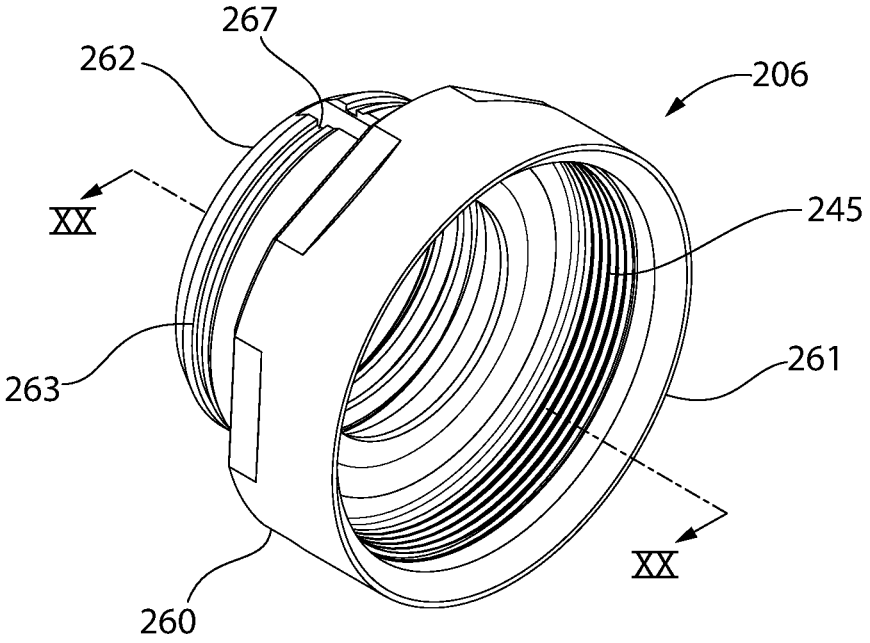
FIG. 47 is a front perspective view of the adapter of the silencer of FIG. 30.
Figure 48:
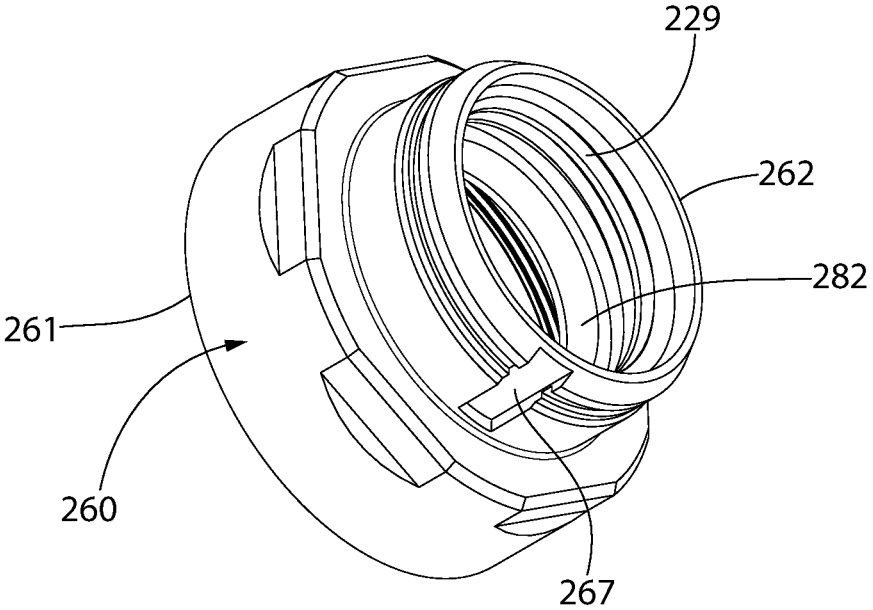
FIG. 48 is a rear perspective view thereof.
Figure 49:
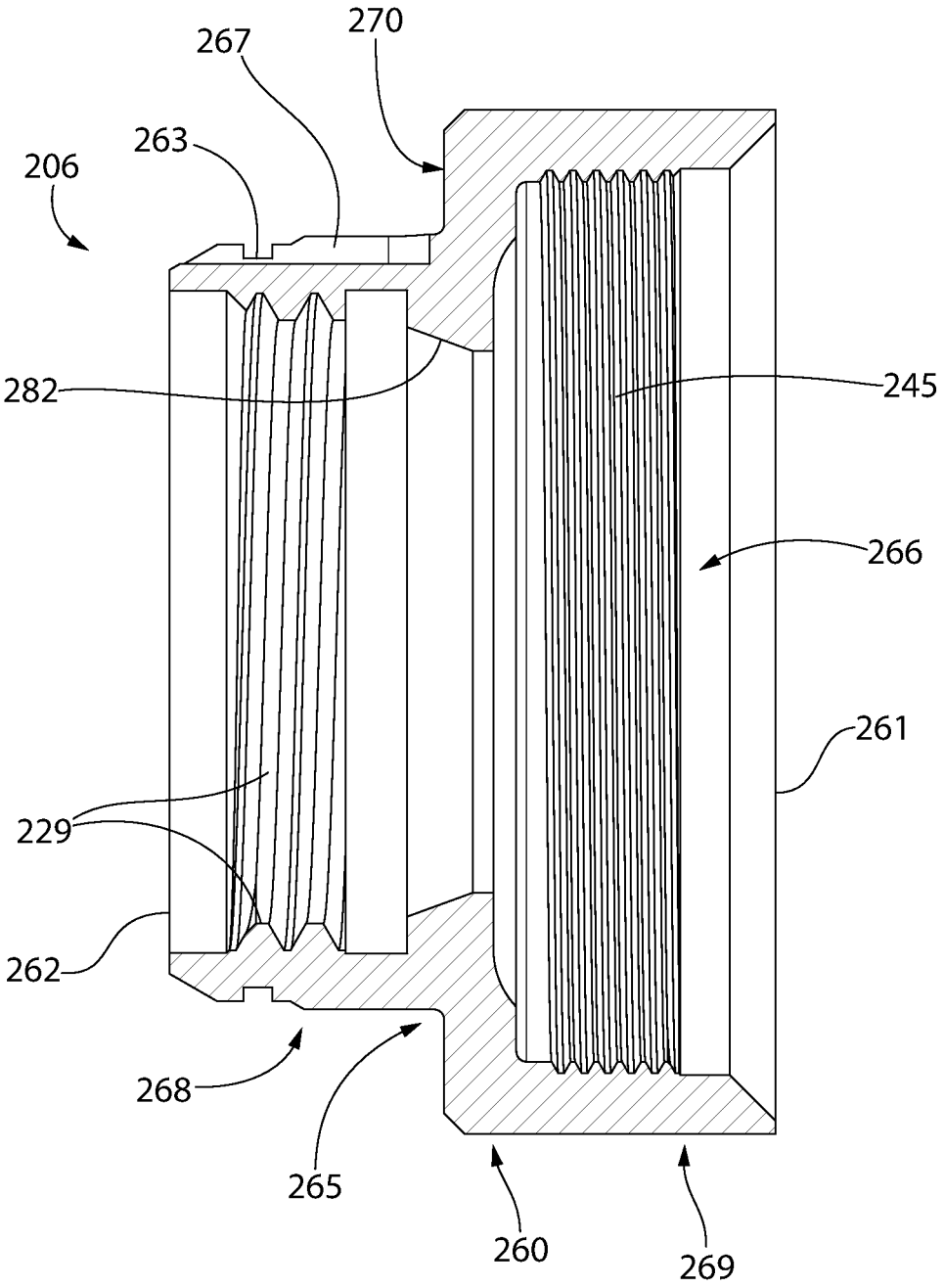
FIG. 49 is a side cross-sectional view thereof.

With additional specific reference to FIGS. 47-49, the adapter 206 provides a base on which other components of the coupling member are attached. Adapter 206 has an annular tubular body including generally cylindrical sidewall 260, open front distal end 261, open rear proximal end 262, and longitudinally-extending cavity 266 extending from end to end. Sidewall 260 may have a stepped configuration as shown defining rear and forward portions 268, 269 of the adapter. Rear portion 268 may be diametrically smaller than front portion 269 defining a shoulder 265 therebetween. Shoulder 265 defines a rear facing annular spring seating surface 270 for abuttingly engaging the annular wave spring 212 which slides onto the smaller diameter rear portion 268 of the adapter. An obliquely angled and sloped annular engagement surface 282 is formed internally in cavity 266 at the stepped transition between the rear and forward portions 268, 269 as shown which engages mating surface 227 formed on the muzzle device 201 as described above.

Adapter 206 includes a first array of internal threads 245 disposed near distal end 261 in forward portion 269 which rotatably engage mating threads 244 formed on the distal end of the mounting sleeve 208 (see also FIGS. 50 and 51). Threads 244 and 245 may be fine threads in one embodiment. The adapter may further include a second array of internal threads 267 disposed near proximal end 262 in rear portion 268 which rotatably engage mating threads 228 on the muzzle device 202 (see also FIGS. 41-43). Threads 267 and 228 may be coarse threads in one embodiment. The first and second arrays of internal threads 245 and 229 of the adapter 206 are axially spaced apart.

Figure 60:
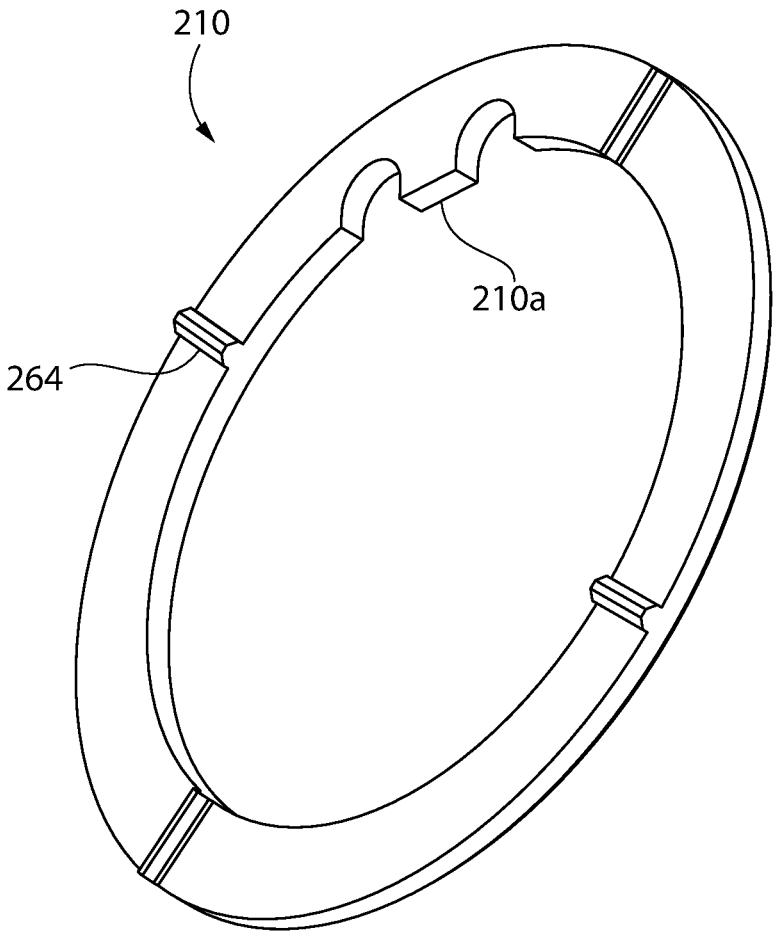
FIG. 60 is rear perspective view of the detent ring of the silencer of FIG. 30.

The smaller diameter rear portion 268 of adapter 206 further includes a longitudinally-extending slot 267 configured for receiving and engaging an inwardly projecting lock tab 210*a* formed on annular detent ring 210 (see also FIGS. 35 and 60). The rear or proximal end of slot 267 may be open to allow the tab 210*a* to be slid directly onto the rear portion 268 of the adapter 206. Engagement between the tab 210*a* and slot 267 rotationally locks the detent ring 210 to the adapter 206, thereby preventing relative rotation therebetween. Detent ring 210 includes a plurality of radial teeth 264 extending circumferentially around the ring and forming alternating peaks and valleys. The detent ring is the fixed and stationary first part of the ratchet mechanism via the tab and slot engagement.

Rear portion 268 of adapter 206 also includes a circumferentially extending annular groove 263 which receives and engages the annular retention ring 214. During assembly, the wave spring 212 and detent ring 210 are first slipped onto the adapter 206 from the rear. The retention ring 214 is then slid onto the adapter and engaged by annular groove 263 which locks the ring to the adapter. The detent ring 210 is movable back and forth a short axial distance on adapter 206 in a reciprocating motion under the rearward biasing force of wave spring 212 as the ratchet mechanism 285 operates. Wave spring 212 biases the detent ring 210 rearward into engagement with the radial teeth 275 on the ratchet ring 204.

Referring now to FIGS. 35, 40, and 44-46, the ratchet ring 204 has a hollow tubular body including generally circular sidewall 271 with optional flat tooling lands 276, open front distal end 272, open rear proximal end 273, and longitudinally-extending cavity 274 extending from end to end. The distal end of ratchet ring 204 comprises a forward facing annular surface defining a plurality of radial teeth 275 extending circumferentially around the ring and forming alternating peaks and valleys. This forward facing array of teeth 275 is configured and arranged to engage the mating rearward facing array of radial teeth 264 disposed on the detent ring 210 (see FIG. 60). The meshed teeth provide the ratcheting action of the silencer, as further described herein.

In one embodiment, radial teeth 275 extend continuously for 360 degrees circumferentially around the entire forward facing annular surface of the ring 204 as illustrated.

The mounting interface between the ratchet ring 204 and adapter 206 is configured to allow the ratchet ring to be freely and infinitely rotatable on the adapter in opposing rotational directions. This facilitates assembly of the silencer 200 to the muzzle device 201, as explained below. In one embodiment, ratchet ring 204 includes a circumferentially-extending annular retention groove 280 formed in cavity 274 which engages retention ring 214 disposed on adapter 206. Groove 280 is disposed proximate to front end 272 of the ratchet ring 204, and preferably immediately rearward and adjacent to an obliquely angled and sloped annular surface 281 formed between the groove and front end of the ratchet ring (best shown in cross-sectional FIG. 46). When the ratchet ring 204 is installed on the rear portion 268 of adapter 206 from the rear, the sloped surface 281 engages the retention ring 214 causing it to gradually deform a slight amount. This is sufficient to allow the ratchet ring 204 to fully seat on the adapter such that the retention ring 214 snaps into the annular retention groove 280 to lock the ratchet ring and adapter together.

The term "infinitely rotatable" means that once the ratchet ring 204 is coupled to the adapter 206, the ratchet ring can spin freely in either rotational direction for an unlimited number of revolutions greater than 360 degrees without uncoupling from the adapter or tightening. This operability contrasts to a threaded connection or other types of coupling having a limited number of revolutions until either the run of threads ends or rotational stops are encountered.

To summarize, the coupling member 235 may be fully assembled as follows. The wave spring 212 and detent ring 210 are first slipped onto the adapter 206 from the rear. The retention ring 214 is then slid onto the adapter and engaged by annular groove 263 which locks the ring to the adapter. Next, with the retention ring 214 already emplaced, the ratchet ring 204 is slid onto the rear of the adapter until the retention groove 280 of ring 204 engages the retention ring 214, thereby locking the ratchet ring to the adapter in the freely and infinitely rotatable manner described above. As best shown in FIG. 35, the detent ring 210 and wave spring 212 are trapped between the front end of the ratchet ring 204 and rear-facing spring seating surface 270 on the adapter 206. It should be noted that there is no threaded engagement between the ratcheting ring 204 and adapter 206 or muzzle device 201. After assembly, the coupling member 235 is threaded onto support tube 208. Baffles 50 and 70 may be then installed on tube 208 or alternatively may first be installed on the tube before attaching the coupling member 235.

Figure 41:
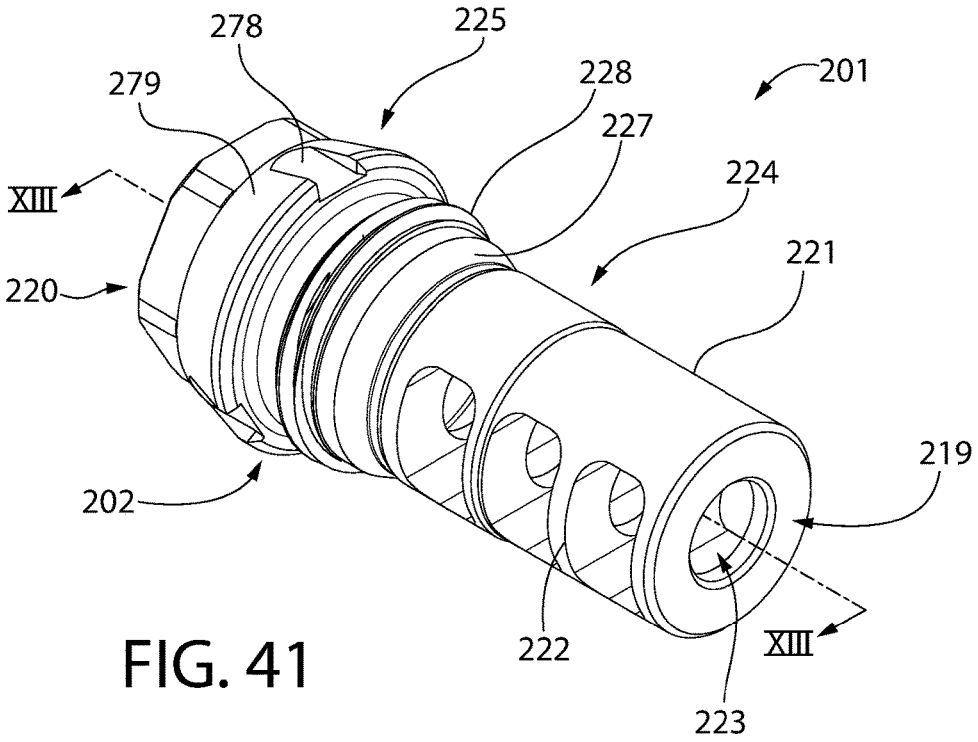
FIG. 41 is a front perspective view of the muzzle device.
Figure 42:
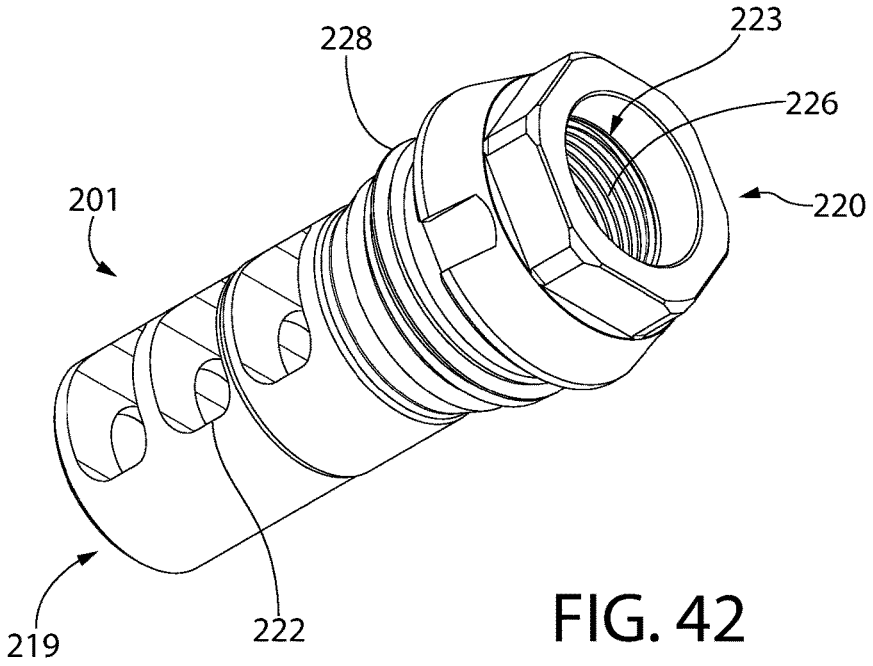
FIG. 42 is rear perspective view thereof.
Figure 43:
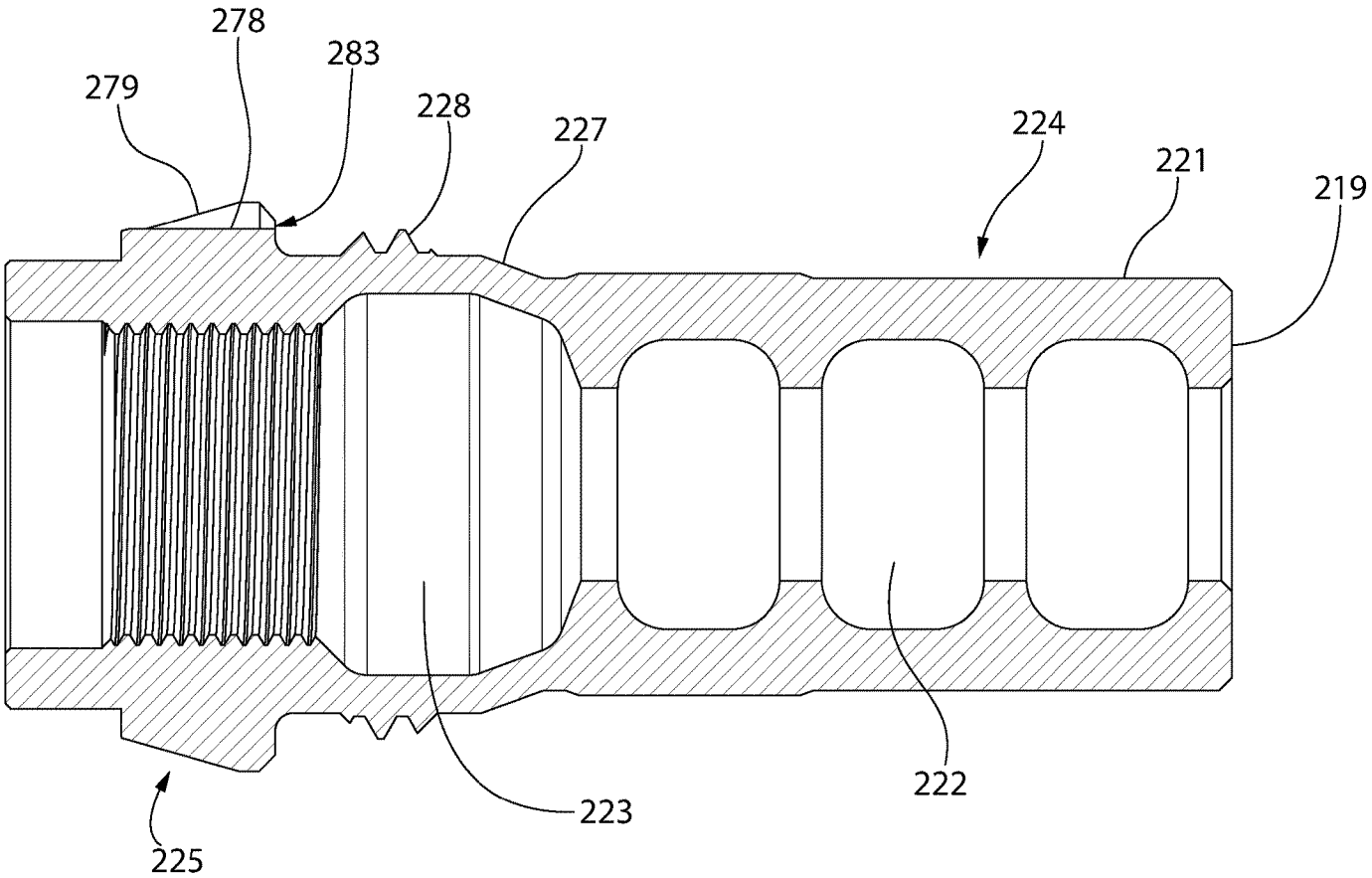
FIG. 43 is a side cross-sectional view thereof.
Figure 44:
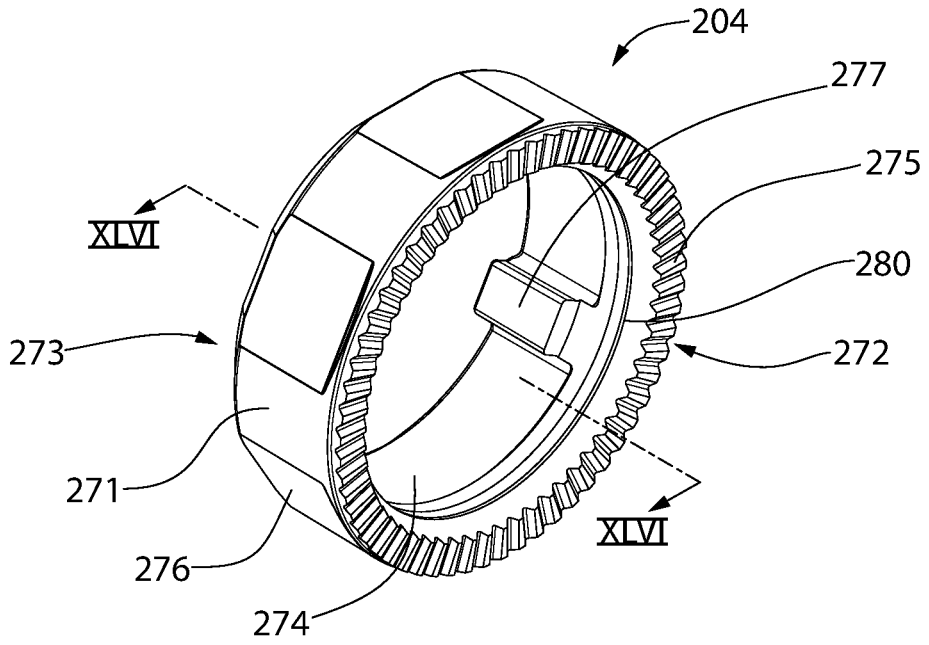
FIG. 44 is a front perspective view of the ratchet ring of the silencer of FIG. 30.
Figure 45:
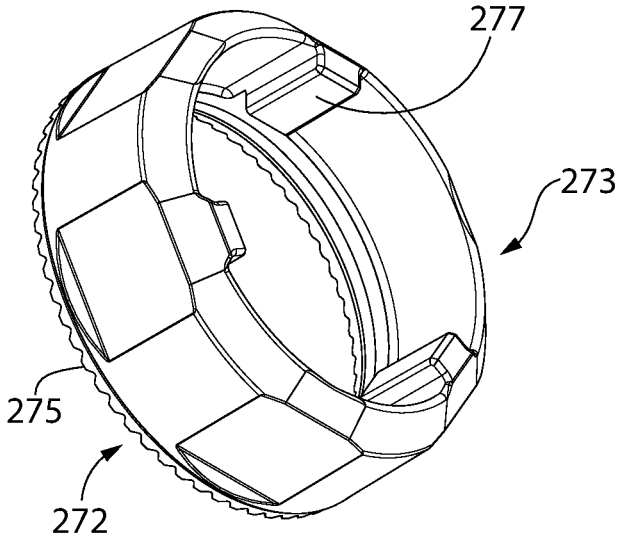
FIG. 45 is a rear perspective view thereof.
Figure 46:
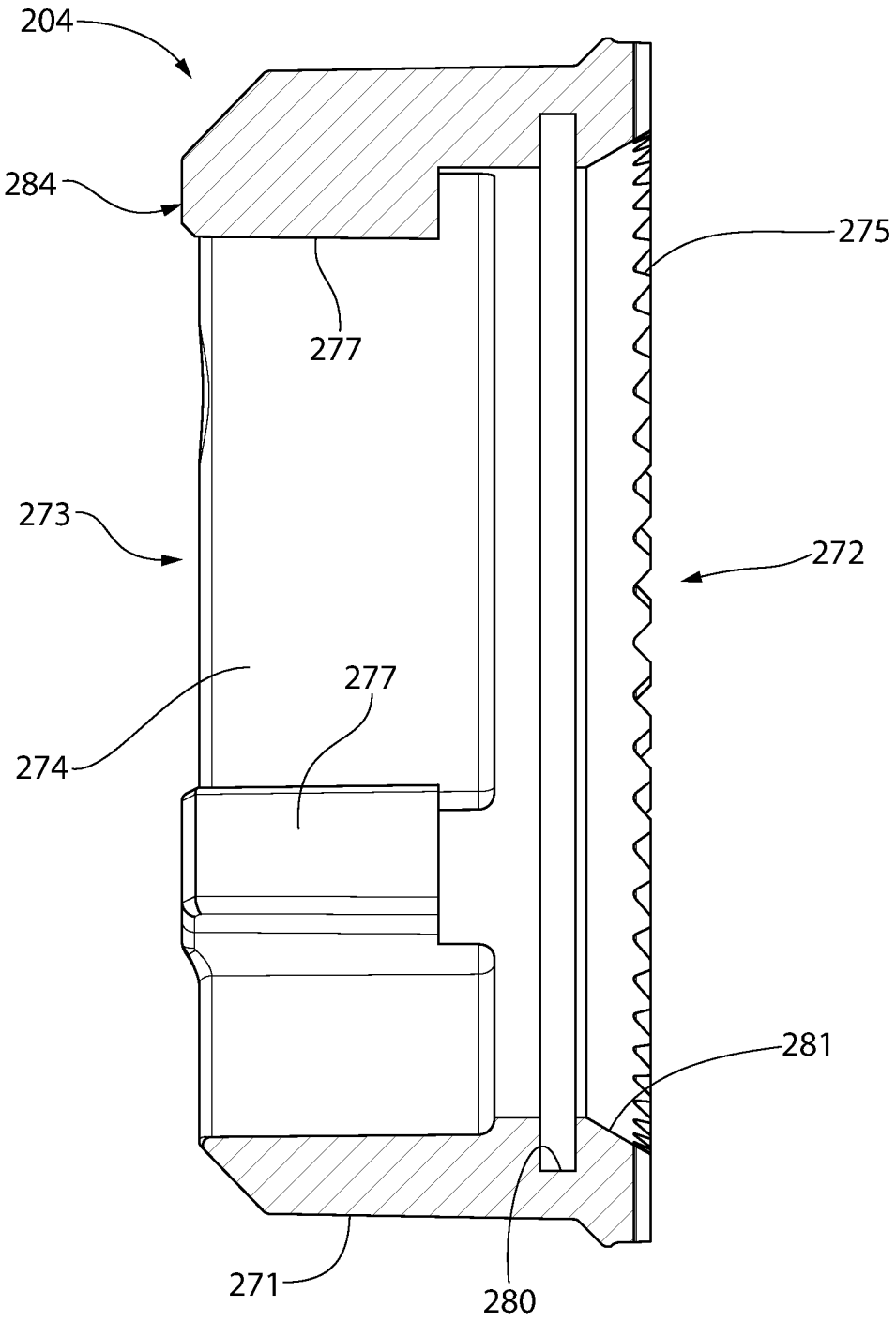
FIG. 46 is a side cross-sectional view thereof.

With additional reference now to FIGS. 41-43, ratcheting ring 204 further includes a plurality of internal longitudinal splines 277 disposed in cavity 274 proximate to the rear proximal end 273 of the ring. The splines 277 are circumferentially spaced apart inside cavity 274. Splines 277 are configured to engage mating longitudinal channels or grooves 278 formed in the outer circumference of muzzle device 201, which in one embodiment may be disposed on the rear portion 225 of the device proximate to its rear proximal end 220. Splines 277 and grooves 278 are axially oriented and arranged parallel to longitudinal axis LA. In some alternative embodiments, the longitudinal splines 277 may instead be formed on muzzle device 201 and longitudinal grooves 278 may be formed on the ratchet ring 204. Either arrangement may be used.

Splines 277 are insertably received in grooves 278 when the silencer 200 is installed on the muzzle device 201. Splines 277 may protrude slightly beyond the proximal end 273 of ratchet ring 204 to facilitate insertion of the splines into the grooves. In one embodiment, the longitudinal grooves 278 may be formed in a raised annular boss 279 disposed on the rear portion 225 of the muzzle device 201, such as by machining or other means. The mating pairs of longitudinal splines 277 and grooves 278 provide rotational stops for the ratchet ring 204 which preclude rotation of the ring after the coupling member 235 is mounted on the muzzle device 201.

Figure 61:
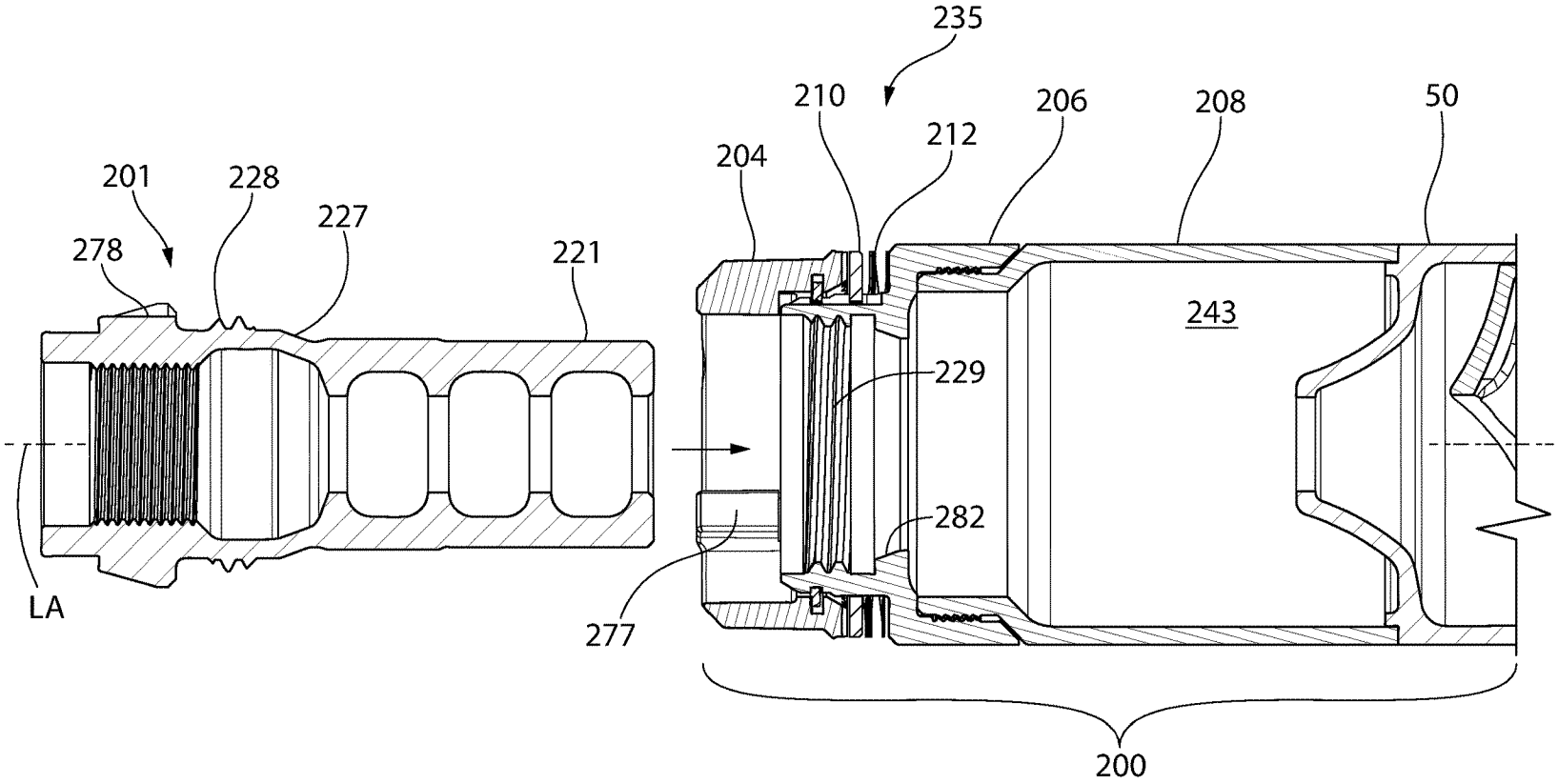
FIGS. 61-63 shown sequential side cross-sectional views of a method for mounting the silencer on the muzzle device shown in FIG. 30.
Figure 62:
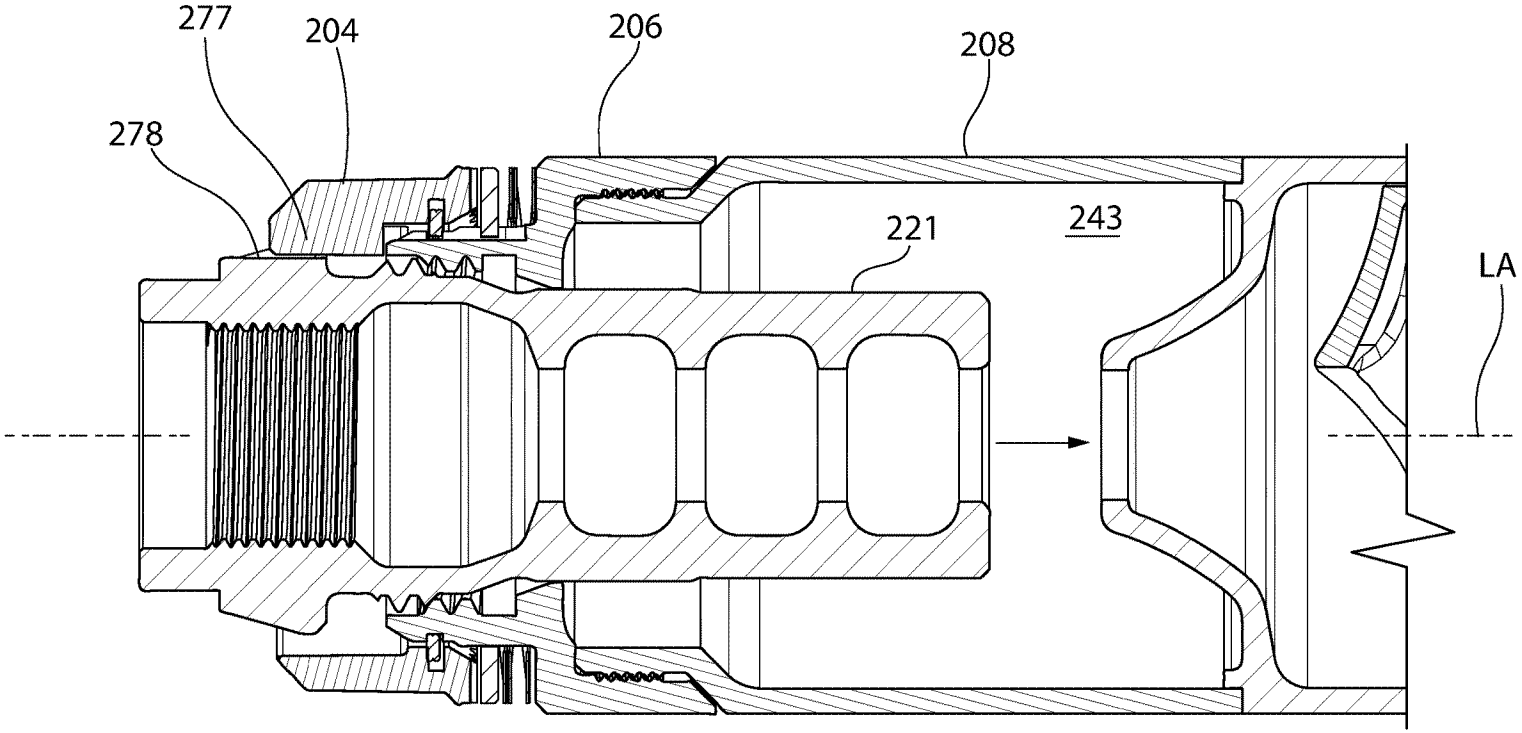
Figure 63:
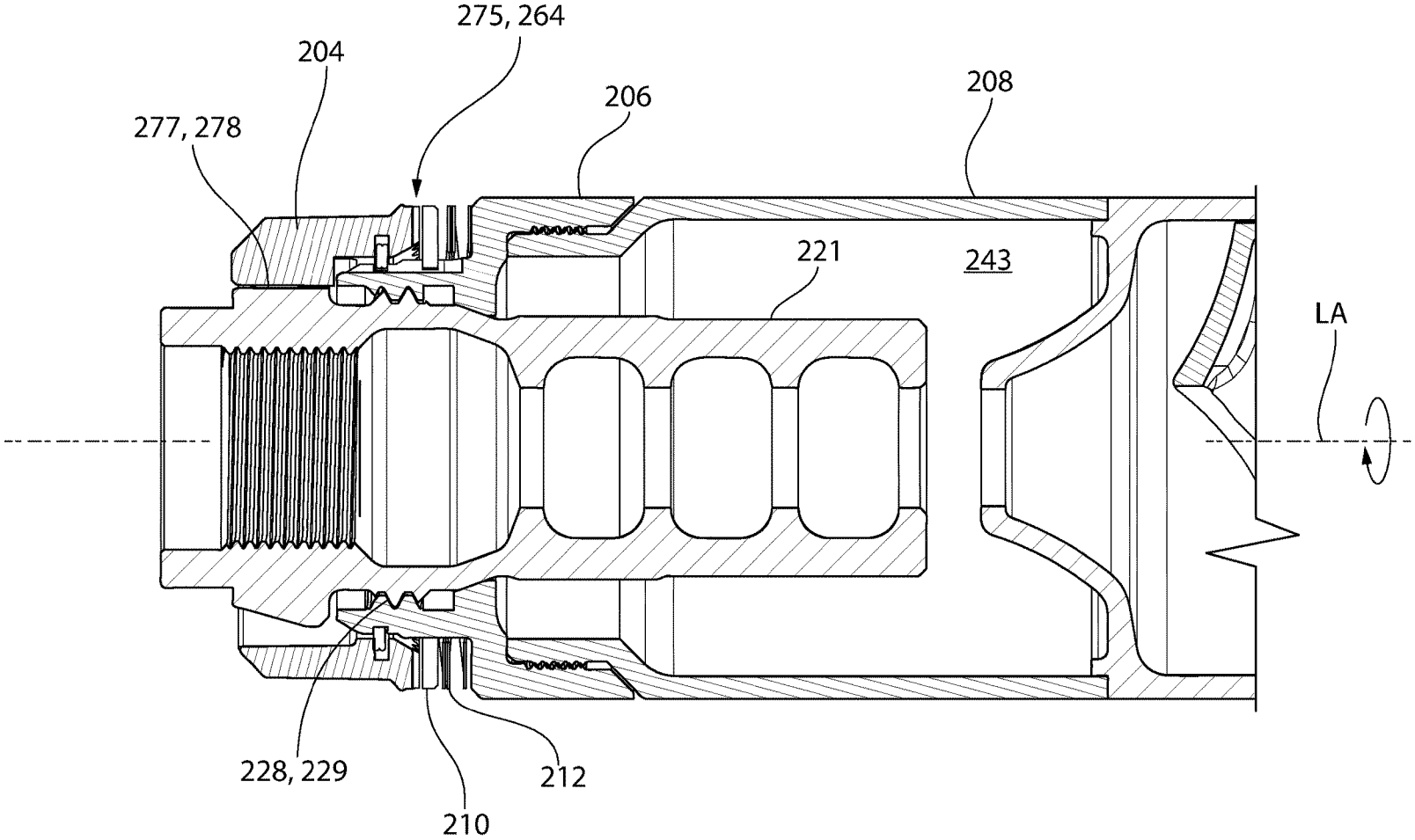

A method for mounting the silencer 200 to firearm 10 will now be briefly described with general reference to FIG. 35 and specific reference to FIGS. 61-63 showing sequential steps in mounting the silencer. Starting with FIG. 61, the fully assembled silencer 200 (i.e. support tube 208 and baffle assembly) with the coupling member 235 threadably mounted thereon is grasped by a user and coaxially aligned with muzzle device 201 which preferably may be already mounted on firearm barrel 10. Silencer 200 may then be pushed or moved axially rearward a first distance towards the muzzle while applying a rearward pushing force on the silencer 200. In the process, the forward gas dispersion extension 221 of muzzle device 201 is first inserted through the rear end of the coupling member 235 and then enters the open cavity 231 of the support tube 208 (see directional insertion arrows). Rear facing annular abutment surface 284 abuttingly engages forward facing annular abutment surface 283 on the muzzle device 201 (prior to the position shown in FIG. 62). This occurs if the internal longitudinal splines 277 on ratchet ring 204 do not each happen to coincidentally be axially aligned with their corresponding longitudinal groove 278 on the muzzle device. Advantageously, the user is not required to and cannot visually align the splines and grooves because the splines are inside the ratchet ring preventing them from being visually sighted. The engagement of the abutment surfaces blocks further and full insertion of the muzzle device into the silencer.

While continuing to apply a rearward pushing force on the silencer 200 towards the muzzle device, the user simply starts rotating/twisting the silencer body after feeling the abutment. The rotatable ratchet ring 204, engaged and turnable with the detent ring 210 (fixed in position on the coupling member 235) via the biasing force applied by wave spring 212, will rotate in unison with the silencer until the splines 277 and mating grooves 278 become automatically axially aligned via the rotational motion. Advantageously, this obviates any need for the user to manually rotate the ratchet ring separately in the first place to line up with the splines with the grooves by sight even if possible. The longitudinal splines 277 are instead automatically inserted into and enter the grooves 278 while the silencer is rotated and the rearward pushing force is applied. The user will tactilely feel when the splines and grooves are indexed and engaged via their hand. The user can now push the silencer farther rearward a second distance as shown in FIG. 62. It is notable that with the longitudinal splines 277 positioned in the grooves 278, the ratchet ring 204 is now rotationally locked in position on muzzle device 201 and no longer freely rotatable on the coupling adapter 206. The detent ring 201 on the adapter 206 rotates with the adapter 206 relative to the ratchet ring 204 as the silencer 200 continues to be rotated or twisted by the user.

The axially rearward movement of the silencer 200 will next reach a point where threads 228 on muzzle device 201 contact the threads 229 on adapter 206 of the coupling member 235 (prior to the position shown in FIG. 63). The silencer 200 can continue to be rotated in a single direction (e.g. clockwise represented by directional rotation arrow) to tighten the threaded engagement between the silencer and muzzle device 201. As the silencer is tightened, the slipping ratcheting action between the mutually engaged radial teeth 275 and 264 of the ratcheting ring 204 and detent ring 210 respectively will provide resistant to turning and prevent the connection from loosening during the coupling process. The mating ratchet teeth provide a plurality of index or detent positions which holds the rotational position of the silencer with respect to the muzzle device 210. As the silencer 200 is turned, the spring-biased detent ring 210 will reciprocated forward and rearward as the toothed ratchet ring 204 and detent ring temporarily disengage and re-engage via the ratcheting action. When the silencer becomes fully threaded and installed onto the muzzle device 201 as shown in FIG. 63, the angled mating tapers or surfaces 282 and 227 of the adapter 206 and muzzle device respectively will engage to assist with locking the silencer onto the device by tightening the engagement therebetween.

To remove the silencer 200, the silencer body may be grasped by the user and simply rotated or twisted in an opposite rotational direction (e.g. counter-clockwise) until the adapter 206 no longer threadably engages the muzzle device 201. During this process, the ratchet mechanism 285 will provide resistance to turning the silencer. The silencer 200 may then be axially withdrawn forward from the muzzle device 201 by the user and dismounted.

Any suitable materials may be used for muzzle device 201, silencer 200, coupling member 235 and any components thereof as appropriate. Preferably, these parts and components are all formed of an appropriate metal or metal alloy (with exception of any seals described herein) such as aluminum, steel, titanium, or other. In one representative but non-limiting example, the muzzle device 201 such as muzzle brake 202 may be formed of stainless steel. The blast and primary baffles 50, 70 may be formed of stainless steel or aluminum.

Figure 64:
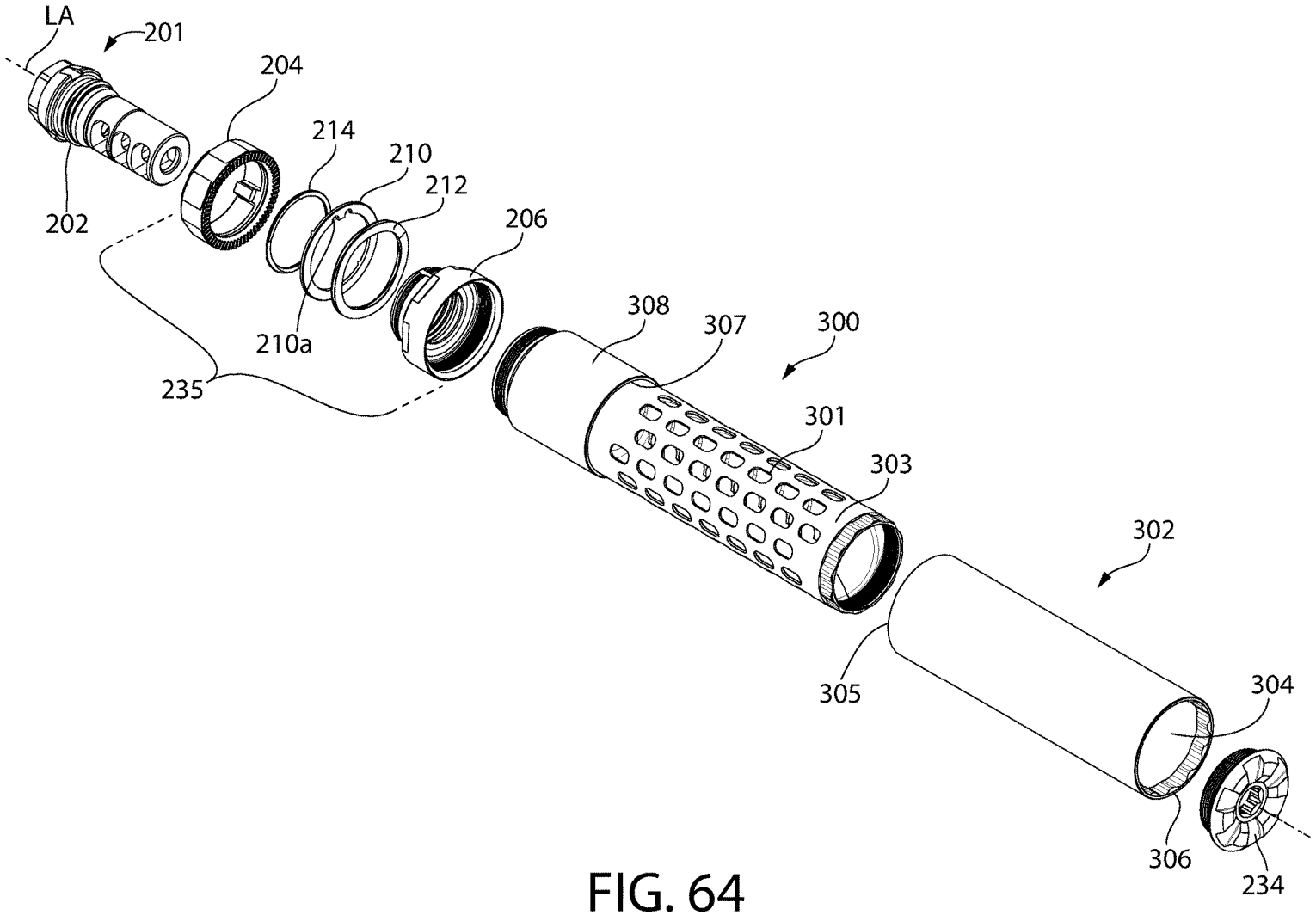
FIG. 64 is an exploded perspective view showing an alternate construction of a single-piece cast monolithic support tube and baffle assembly.
Figure 65:
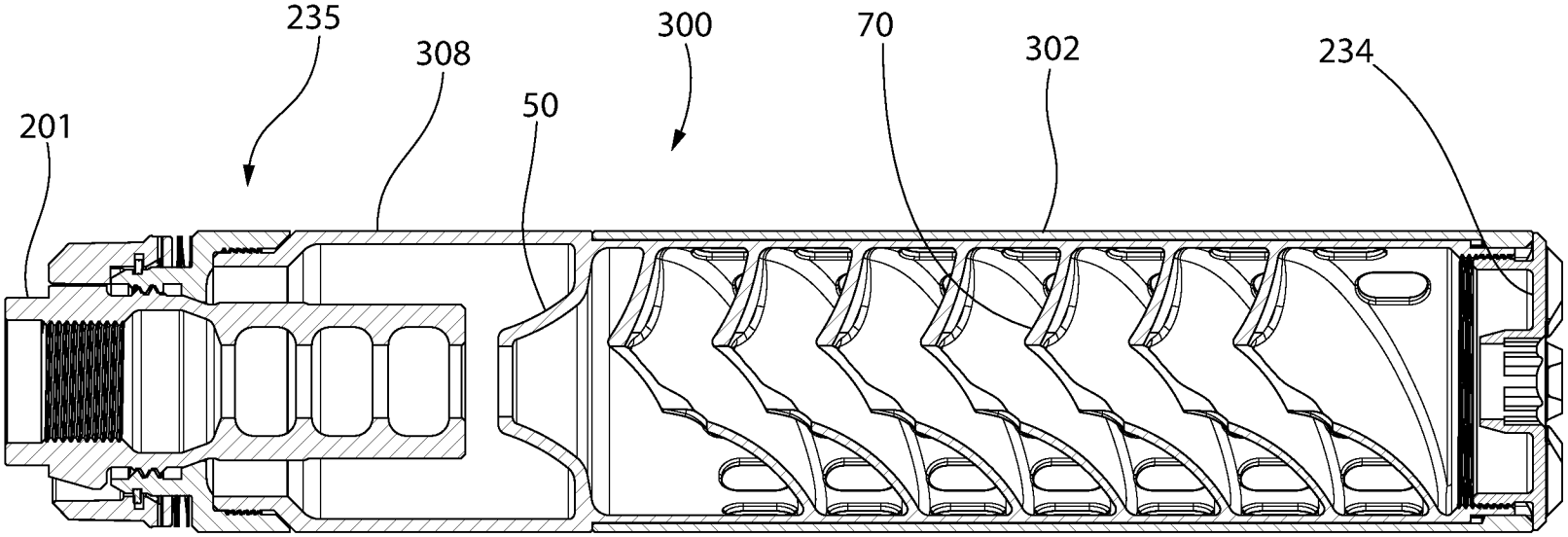
FIG. 65 is side longitudinal cross-sectional view thereof; All drawings are schematic and not necessarily to scale.

FIGS. 64 and 65 depict an alternate construction of a single-piece cast monolithic combined support tube-baffle assembly 300. The muzzle device 201 and coupling member 235 components are the same as described above with reference to FIG. 30. In lieu of a separate support tube 208 and individual blast and primary baffles 50, 70 that require assembly, however, these components are instead formed as a monolithic unitary construction via metal casting. The cast support tube-baffle assembly 300 comprises mounting tube 308 at rear and integral generally cylindrical baffle extension 303 in front. The baffles 50 and 70 are cast as an integral part of this extension 303 as shown. A plurality of circumferentially and longitudinally arranged perforations or apertures 301 may be formed in the cylindrical sidewall of baffle extension 303 to facilitate casting of the baffles disposed therein. The baffle extension 303 is enclosed in a gas tight longitudinally-extending outer tube 302 which forms a pressure retention boundary for the silencer 200 in this embodiment. Tube 302 may be generally configured the same as outer tube 21 describe above. The present outer tube 302 includes a longitudinally-extending internal cavity 304 extending from distal front end 306 to proximal rear end 305. Rear end 305 may be permanently attached to an external annular shoulder 307 disposed on support tube 308 which allows the exterior surface of outer tube 302 to flushly interface with the mating exterior surface of the support tube 308. In one embodiment, outer tube 302 may be welded to support tube 308. Other methods however may be used. Front end cap 234 may be attached to front end 306 of the baffle extension 303 using any suitable method. In one embodiment, end cap 234 may be threadably connected to the baffle extension 303. In one embodiment, the cast support tube-baffle assembly 300 may be formed of aluminum; however, other metallic materials such as titanium or steel may be used. The outer tube 302 may be formed of a suitable metal, such as aluminum, titanium, or steel.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A quick-coupling silencer assembly for a firearm, the assembly comprising:

a longitudinal axis;

a muzzle device configured for attachment to a muzzle end of a firearm barrel, the muzzle device including a first rotational stop;

a support tube having a proximal end and a distal end;

a plurality of baffles arranged in a longitudinal stack and supported by the support tube, the baffles defining a plurality of gas expansion chambers;

a coupling member attached to the proximal end of the support tube and having a second rotational stop engageable with the first rotational stop of the muzzle device, the coupling member rotatably securing the support tube to the muzzle device;

a ratcheting mechanism comprising a freely rotatable first array of radial teeth disposed on the coupling member and a second array of radial teeth disposed on the coupling member in a fixed rotational position;

a biasing member biasing the second array of radial teeth into engagement with the first array of radial teeth;

wherein the first array of radial teeth is infinitely rotatable in opposing directions when the coupling member is not secured to the muzzle device, and wherein the first array of radial teeth is locked in rotational position when the coupling member is secured to the muzzle device.

2. The silencer assembly according to claim 1, wherein the first and second rotational stops engage when the coupling member is secured to the muzzle device which locks the first array of radial teeth in rotational position.

3. The silencer assembly according to claim 2, wherein the first rotational stop is disposed proximate to a rear end of the muzzle device and the second rotational stop is disposed proximate to a rear end of the coupling member.

4. The silencer assembly according to claim 3, wherein the first rotational stop comprises an external longitudinal groove formed on an exterior annular surface of the muzzle device and the second rotational stop comprises an internal longitudinal spline disposed inside a rearwardly open cavity of the coupling member.

5. The silencer assembly according to claim 3, wherein the second rotational stop is disposed on a ratchet ring disposed and freely rotatable on the rear end of the coupling member.

6. The silencer assembly according to claim 5, wherein the ratchet ring is mounted on a tubular adapter threadably attached to the support tube at a front end of the adapter, and the adapter is threadably attached to the muzzle device at a rear end of the adapter.

7. The silencer assembly according to claim 5, wherein the ratchet ring is coupled to the coupling member via a retention ring.

8. The silencer assembly according to claim 5, wherein the first array of radial teeth is disposed on the ratchet ring.

9. The silencer assembly according to claim 8, wherein the second array of radial teeth is disposed on a detent ring attached to the coupling member in a fixed rotational position, the detent ring axially movable in a reciprocating manner.

10. The silencer assembly according to claim 9, wherein the biasing member is a wave spring engaged with the detent ring to bias the second array of radial teeth into the first array of radial teeth.

11. The silencer assembly according to claim 1, where the baffles comprise a blast baffle coupled directly to the support tube and plurality of primary baffles each comprising an annular mounting sleeve and a skewed cone projecting axially rearward from the mounting sleeve, the cone defining an oblong central opening concentrically aligned with the longitudinal axis for receiving a projectile therethrough, the oblong central opening being obliquely angled to the longitudinal axis.

12. The silencer assembly according to claim 1, wherein the baffles are supported in a cantilevered manner from the support tube and are exteriorly exposed.

13. The silencer assembly according to claim 1, wherein the muzzle device is a muzzle brake.

14. A quick-coupling silencer assembly for a firearm, the assembly comprising:

a longitudinal axis;

a muzzle device configured for attachment to a muzzle end of a firearm barrel;

a support tube assembly including proximal end, a distal end, and a longitudinal stack of baffles defining a plurality of gas expansion chambers;

an annular adapter threadably coupling the support tube assembly to the muzzle device;

a ratchet ring movably coupled to the annular adapter and comprising first radial teeth, the ratchet ring being freely and infinitely rotatable on the adapter when the adapter is not coupled to the muzzle device;

a detent ring disposed on the adapter and comprising second radial teeth, the detent ring locked in rotational position on the coupling member;

an annular biasing member biasing the second radial teeth of the detent ring into engagement with the first radial teeth of the ratchet ring which collectively defines a ratchet mechanism;

wherein the ratchet ring is lockable in rotational position when the adapter is coupled to the muzzle device and the detent ring rotates with the adapter.

15. The silencer assembly according to claim 14, wherein the detent ring comprises a lock tab which engages the adapter to lock the detent ring in rotational position.

16. The silencer assembly according to claim 14, wherein the muzzle device includes a plurality of first rotational stop elements and the ratchet ring includes a plurality of second rotational stop elements engaged therewith when the adapter is coupled to the muzzle device which locks the ratchet ring in rotational position.

17. The silencer assembly according to claim 16, wherein the first rotational stop elements comprise one of a longitudinal channel and spline and the second rotational stop elements comprise the other of the longitudinal channel and spline.

18. The silencer assembly according to claim 14, wherein ratchet ring is movably coupled to the adapter by a retention ring which engages a circumferential groove on the ratchet ring.

19. A method for installing a silencer on a firearm, the method comprising:

providing a silencer comprising a support tube with array of stacked baffles and an annular coupling adapter attached to a rear end of the silencer;

axially moving the silencer rearward a first distance onto the muzzle device while applying a rearward pushing force on the silencer;

engaging an abutment surface of a toothed ratchet ring disposed on the coupling adapter with a mating abutment surface on the muzzle device while applying the rearward pushing force on the silencer, the ratchet ring being freely rotatable on the coupling adapter;

rotating the silencer while applying the rearward pushing force, the ratchet ring and coupling adapter rotating with the silencer;

automatically axially aligning a rotational stop on the ratchet ring with a mating rotational stop on the muzzle device via rotating the silencer;

slideably engaging the rotational stops of the ratchet ring and muzzle device, the engagement rotationally locking the ratchet ring in position on the muzzle device such that the ratchet ring no longer rotates with rotation of the silencer and coupling adapter;

axially moving the silencer rearward a second distance while applying the rearward pushing force on the silencer; and threadably engaging the coupling adapter with the muzzle device.

20. The method according to claim 19, further comprising a spring-biased toothed detent ring rotationally engaged with the toothed ratchet ring, the detent ring rotationally locked to the coupling adapter such that rotating the silencer in turn rotates the detent ring on the coupling adapter in unison therewith.

21. The method according to claim 19, wherein the automatically axially aligning step does not require a user manually rotating the ratchet ring to axially align the rotational stop on the ratchet ring with the mating rotational stop on the muzzle device.

* * * * *